US007173594B2

(12) United States Patent
Nakamura et al.

(10) Patent No.: US 7,173,594 B2
(45) **Date of Patent: *Feb. 6, 2007**

(54) DISPLAY DEVICE AND DRIVING METHOD THEREOF

(75) Inventors: Masashi Nakamura, Chosei (JP); Hiroyuki Nitta, Fujisawa (JP); Nobuhiro Takeda, Mobara (JP); Masahiro Tanaka, Yotsukaido (JP)

(73) Assignee: Hitachi Displays, Ltd., Mobara (JP)

( * ) Notice: Subject to any disclaimer, the term of this patent is extended or adjusted under 35 U.S.C. 154(b) by 379 days.

This patent is subject to a terminal disclaimer.

(21) Appl. No.: 10/760,362

(22) Filed: Jan. 21, 2004

(65) Prior Publication Data

US 2004/0164976 A1 Aug. 26, 2004

(30) Foreign Application Priority Data

Jan. 21, 2003 (JP) ..... 2003-012066

(51) Int. Cl.
*G09G 3/36* (2006.01)
*G09G 5/00* (2006.01)

(52) U.S. Cl. ..... 345/98; 345/96; 345/100; 345/209

(58) Field of Classification Search ..... 345/87–102, 345/204–212; 315/169.1–169.4
See application file for complete search history.

(56) References Cited

U.S. PATENT DOCUMENTS 5,510,805 A * 4/1996 Lee ..... 345/58
5,648,790 A * 7/1997 Lee ..... 345/58
6,448,718 B1 * 9/2002 Battersby ..... 315/169.3
6,882,103 B2 * 4/2005 Kim et al. ..... 313/504

* cited by examiner

*Primary Examiner*—Vijay Shankar
(74) *Attorney, Agent, or Firm*—Antonelli, Terry, Stout and Kraus, LLP.

(57) ABSTRACT

A data driver of a display device alternately repeats a first step of sequentially generating a display signal corresponding to each one of the lines of image data for a fixed period and outputting the display signal to a pixel array N-times and a second step of generating a display signal which makes the luminance of pixels lower than the luminance of the pixel in the first step for the fixed period and of outputting the display signal to the pixel array M-times. A scanning driver circuit alternately repeats selecting a plurality of pixel rows for every Y rows sequentially from one end to another end of the pixel array along the second direction in the first step and selecting the plurality of pixel rows other than the pixel rows (Y×N) sequentially from one end to another end of the pixel array for every Z rows along the second direction.

7 Claims, 30 Drawing Sheets

4n+0 F2 ③ → F3 ②

4n+0 F3 ② → F4 ④

4n+0 F4 ④ → F1 ①

4n+1 F1 ① → F2 ③

4n+1 F2 ③ → F3 ②

4n+1 F3 ② → F4 ④

4n+1 F4 ④ → F1 ①

4n+2 F1 ① → F2 ③

4n+2 F2 ③ → F3 ②

4n+2 F3 ② → F4 ④

4n+3 F1 ① → F2 ③

4n+3 F2 ③ → F3 ②

4n+3 F3 ② → F4 ④

4n+3 F4 ④ → F1 ①

DISPLAY DEVICE AND DRIVING METHOD THEREOF

BACKGROUND OF THE INVENTION

The present invention relates to a display device and a driving method thereof, and, more particularly, the invention relates to a so-called active matrix type display device and driving method.

In an active matrix type display device, a plurality of gate signal lines, which extend in the x direction and are arranged in parallel in the y direction, and a plurality of drain signal lines, which extend in the y direction and are arranged in parallel in the x direction, are formed on a surface of a substrate, respective regions surrounded by these signal lines constitute pixel regions, and an array of these pixel regions constitutes a display part.

In each pixel region, there is at least a switching element which is driven by a scanning signal from the gate signal line and a pixel electrode to which a video signal from the drain signal line is supplied through the switching element, thus constituting a pixel.

The pixel electrode controls the optical transmissivity or the light emission of an optical material interposed between the pixel electrode and a counter electrode, which generates an electric field or the flow of an electric current together with the pixel electrode.

By sequentially supplying the scanning signal to respective gate signal lines, each pixel of a group of pixels arranged in parallel along the gate signal line to which the scanning signal is supplied is selected one after another, and the video signal which is supplied to each drain signal line is supplied to the pixel electrode of each pixel at the time of selection of the pixel.

In a display device having such a constitution, at the time of displaying moving pictures, to make a display image more vivid, an attempt has been made to produce a black display on a whole region of the screen over a plurality of frames.

SUMMARY OF THE INVENTION

However, when the whole region of the screen is divided into a plurality of regions along the gate signal lines and a black display is produced on respective divided regions sequentially for every changeover of the respective frames, the inventors of the present invention have found a drawback in that brightness lines which are comparatively bright with respective to other regions are displayed in a stream in the oblique direction of the screen corresponding to every changeover of the respective frames.

Further, the inventors also have found that, in producing the above-mentioned black display, a phenomenon can be observed in which, in respective frames which are sequentially changed over, the black display is not produced on some lines or the image is darker.

The present invention has been made to deal with such circumstances, and it is an object of the present invention to provide a display device and a driving method thereof which can prevent the occurrence of the flow of a display of brightness lines on a screen.

Further, it is another other object of the present invention to provide a display device and a driving method thereof which can make a black display in each frame uniform.

A summary of representative aspects and features of the invention disclosed in this specification will be presented as follows.

EXAMPLE 1

A display device according to the present invention comprises, for example, a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, wherein lines of image data are inputted to the data driver circuit one after another for every horizontal scanning period of the image data, the data driver circuit alternately repeats (i) a first step for generating a display signal corresponding to each one of the lines of the image data one after another for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, the display signal outputted in the first step of the image data is delayed from a memory in which the display signal is stored in the vicinity of a boundary between one frame period and a frame period next to the one frame period within a time-sequential interval between the display signal which is outputted in the second step of the last image data in a certain frame period and the display signal which is outputted from the second step of the first image data in the next frame period.

EXAMPLE 2

The display device according to the present invention is, for example, on the premise of the constitution of the Example 1, characterized in that outputting of the display signal outputted in the second step of the image data is performed with a time-sequential deviation which differs in displaying of respective frames, and the display signal of each frame is distributed such that the display signal does not include (N−2) pieces of time-sequential deviation of the fixed period at maximum with respect to the corresponding display signal of the next frame.

EXAMPLE 3

The display device according to the present invention is, for example, on the premise of the constitution of the Example 1, characterized in that in the vicinity of a boundary between a certain frame period and a frame period next to the certain frame period, a time-sequential interval between the display signal which is outputted in the second step of the last image data in the certain frame period and the display signal which is outputted in the second step of the first image data in the next frame period is set substantially equal to a time-sequential interval between the display signal which is outputted in the second step of other certain image data and the display signal which is outputted in the second step of the next image data.

EXAMPLE 4

The display device according to the present invention is, for example, on the premise of the constitution of the Example 1, characterized in that the number Y of the respective pixel rows selected in the first selection step in response to each output of the display signal in the first step is 1 and the number N of the display signal outputs in the first step is not smaller than 4, and the number Z of the respective pixel rows selected in the second selection step in response to each output of the display signal in the second step is not smaller than 4 and the number N of the display signal outputs in the second step is 1.

EXAMPLE 5

A driving method for a display device according to the present invention in which, for example, to a display device which comprises a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, lines of image data are inputted one after another for every horizontal scanning period, wherein the data driver circuit alternately repeats (i) a first step for generating a display signal corresponding to each one of the lines of the image data one after another and outputting the display signal to the pixel array N-times (N being a natural number equal to or greater than 2) and (ii) a second step for generating a display signal which makes the luminance of the pixels lower than the luminance of the pixel in the first step and outputting the display signal to the pixel array M-times (M being a natural number smaller than N), the scanning driver circuit, in response to inputting of a scanning clock, alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the display signal outputted in the first step of the image data is delayed from a memory in which the display signal is stored in the vicinity of a boundary between one frame period and a frame period next to the one frame period within a time-sequential interval between the display signal which is outputted in the second step of the last image data in a certain frame period and the display signal which is outputted from the second step of the first image data in the next frame period.

EXAMPLE 6

The driving method for a display device according to the present invention is, for example, on the premise of the constitution of the Example 5, characterized in that in the vicinity of a boundary between a certain frame period and a frame period next to the certain frame period, the time-sequential interval between the display signal which is outputted in the second step of the last image data in the certain frame period and the display signal which is outputted in the second step of the first image data in the next frame period is set substantially equal to a time-sequential interval between the display signal which is outputted in the second step of other certain image data and the display signal which is outputted in the second step of the next image data.

EXAMPLE 7

The driving method for a display device according to the present invention is, for example, on the premise of the constitution of the Example 5, characterized in that the number Y of the respective pixel rows selected in the first selection step in response to each output of the display signal in the first step is 1 and the number N of the display signal outputs in the first step is not smaller than 4, and the number Z of the respective pixel rows selected in the second selection step in response to each output of the display signal in the second step is not smaller than 4 and the number N of the display signal outputs in the second step is 1.

DESCRIPTION OF THE PREFERRED EMBODIMENTS

Preferred embodiments of a liquid crystal display device according to the present invention will be explained in conjunction with the drawings.

First Embodiment

A display device and a method of driving the same according to the first embodiment of the present invention will be explained in conjunction with FIG. 1 to FIG. 7. In this embodiment, the explanation will be directed to a display device (liquid crystal display device) which uses an active matrix-type liquid crystal display panel as a pixel array. However, the basic structure and a driving method of the display device according to the present invention are applicable also to a display device which uses an electroluminescence array or a light emitting diode array as a pixel array.

Figure 1:
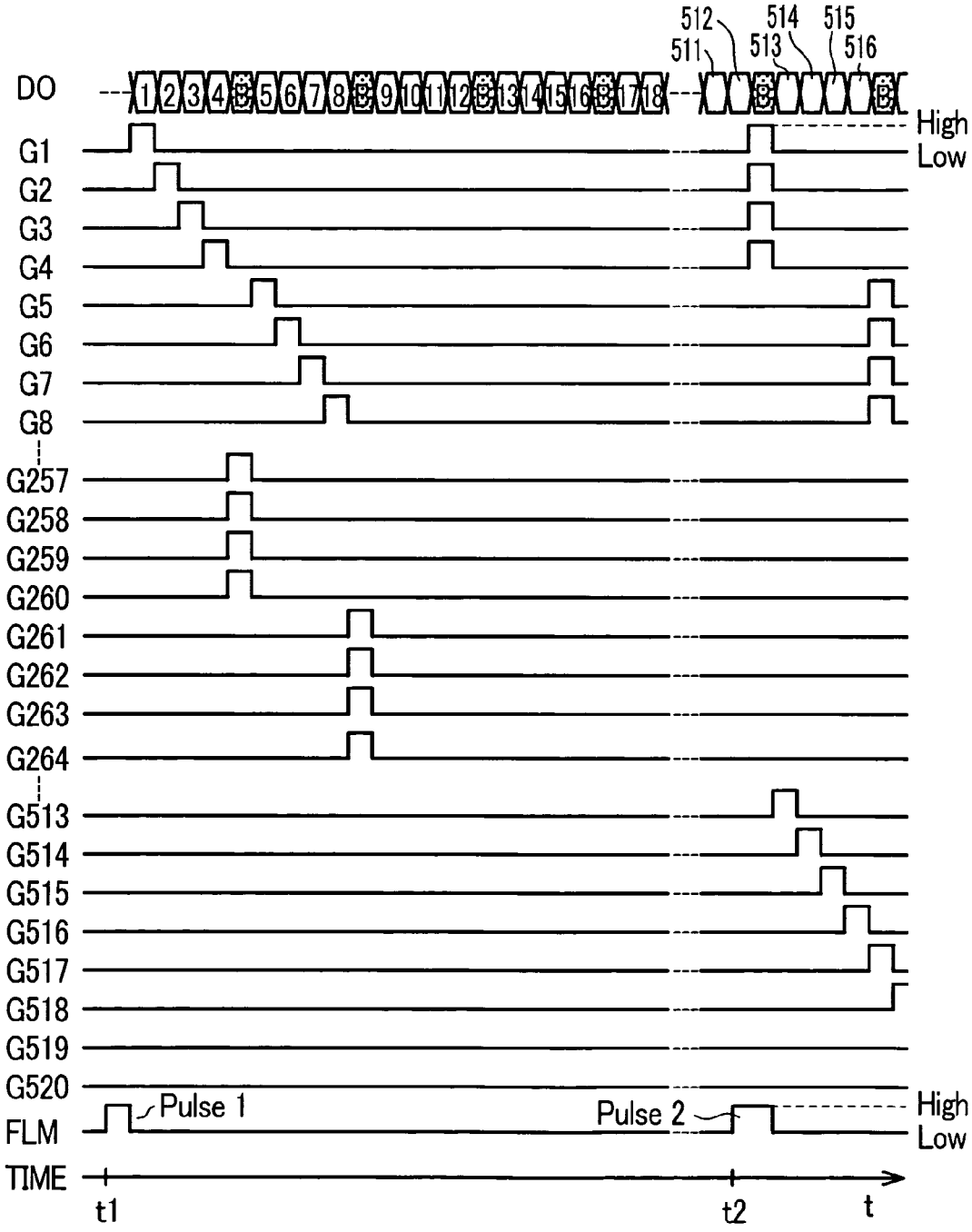
FIG. 1 is a timing diagram which shows output timing of display signals and driving waveforms of scanning lines which correspond to the output timing according to a first embodiment of a driving method of a liquid crystal display device of the present invention.
Figure 2:
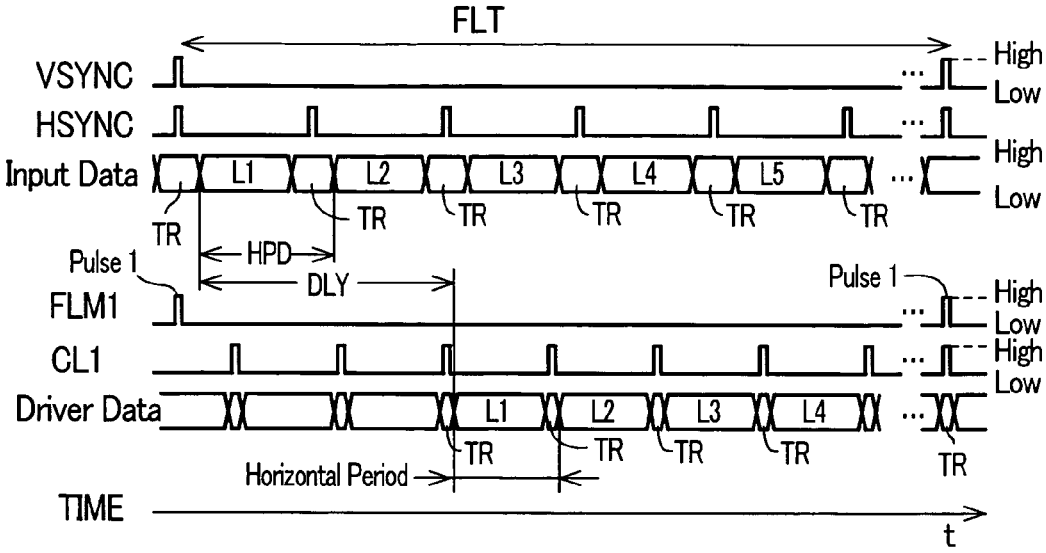
FIG. 2 is a timing diagram showing timing of input waveforms (input data) of image data to a display control circuit (timing controller) and output waveforms (driver data) from the display control circuit according to the first embodiment of a driving method of a liquid crystal display device of the present invention.

FIG. 1 is a timing chart showing selection timing of display signal outputs (data driver output voltages) DO to the pixel array of the display device according to the present invention and scanning signal lines G1 in the inside of the pixel array corresponding to the respective signal outputs (the timing is indicated in accordance with an axis of time TIME). FIG. 2 is a timing chart showing timing of inputting (input data) of image data to a display control circuit (timing controller) provided to the display device and the outputting of image data (driver data) from the display control circuit.

Figure 3:
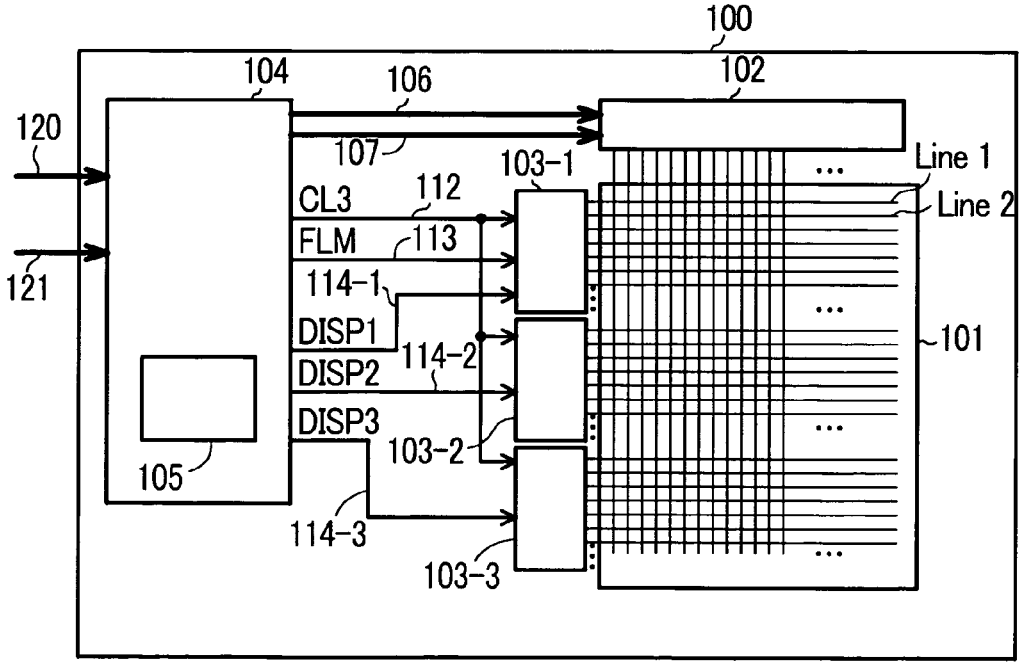
FIG. 3 is a block diagram showing the overall configuration of the liquid crystal display device according to the present invention.
Figure 9:
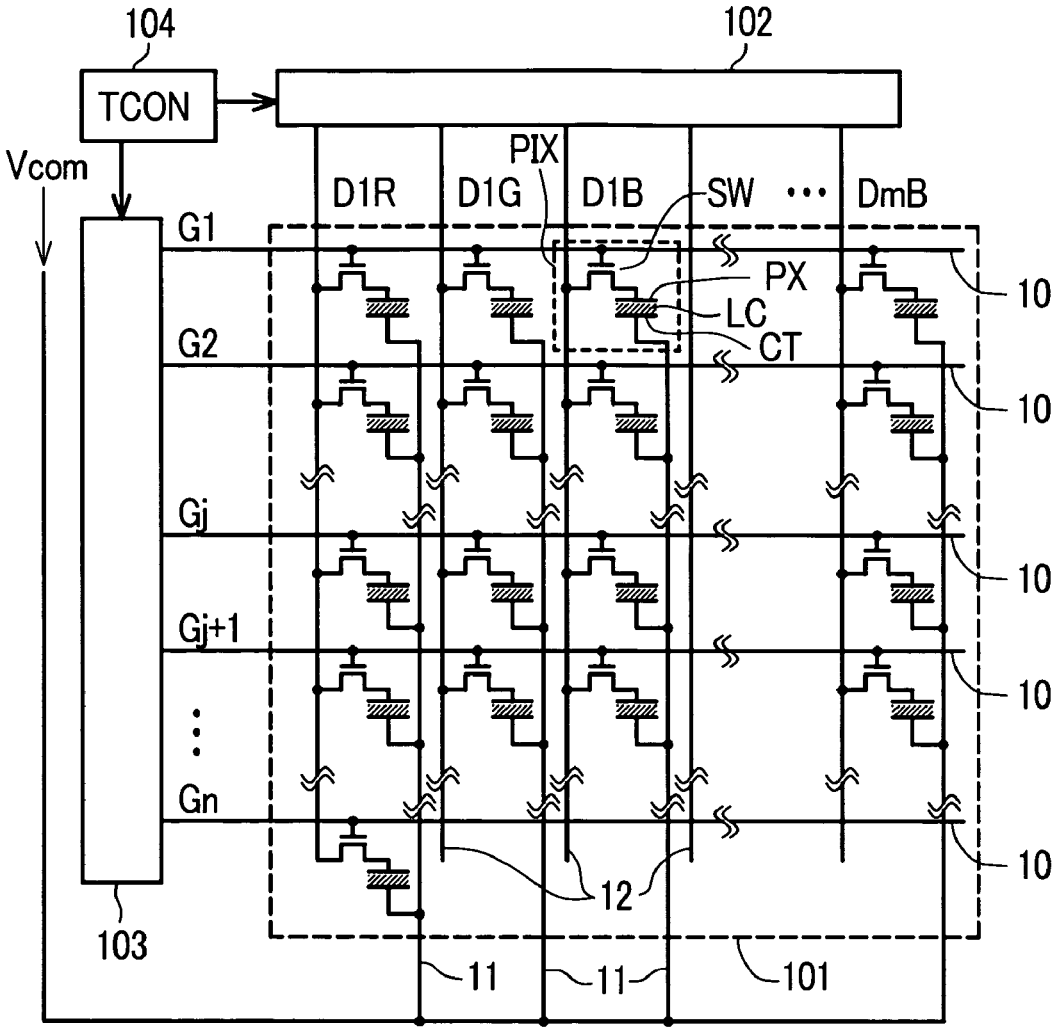
FIG. 9 is a schematic diagram of one example of a pixel array provided to an active matrix type display device.

FIG. 3 is a block diagram showing the overall configuration of the display device of the present invention, while one example of the constitution of the pixel array 101 shown in FIG. 3 and the periphery thereof is shown in FIG. 9. The mentioned timing charts shown in FIG. 1 and FIG. 2 are based on the constitution of the display device (liquid crystal display device) shown in FIG. 3.

Figure 4:
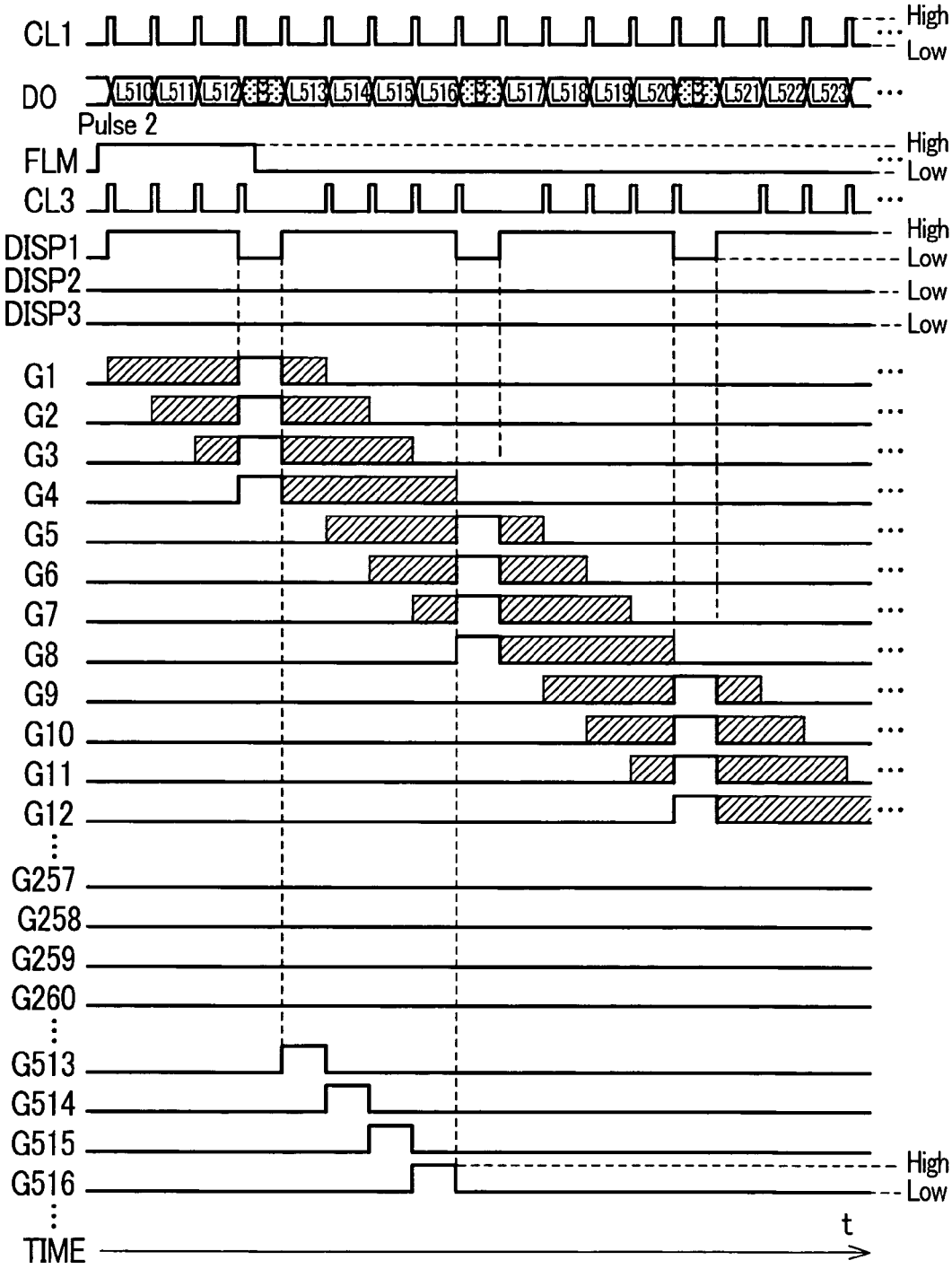
FIG. 4 is a timing diagram showing driving waveforms which select four scanning lines simultaneously during an output period of display signals according to the first embodiment of a liquid crystal display device of the present invention.

FIG. 4 is a timing chart showing another example of the timing for each application of display signal outputs (data driver output voltages) to the pixel array of the display device according to this embodiment and scanning signal lines corresponding to the respective outputs. Out of scanning signal lines to which scanning signals are outputted from a shift-register type scanning driver during an outputting period of display signals, four scanning signal lines are selected, and display signals are supplied to pixel rows which respectively correspond to these scanning signal lines.

Figure 5:
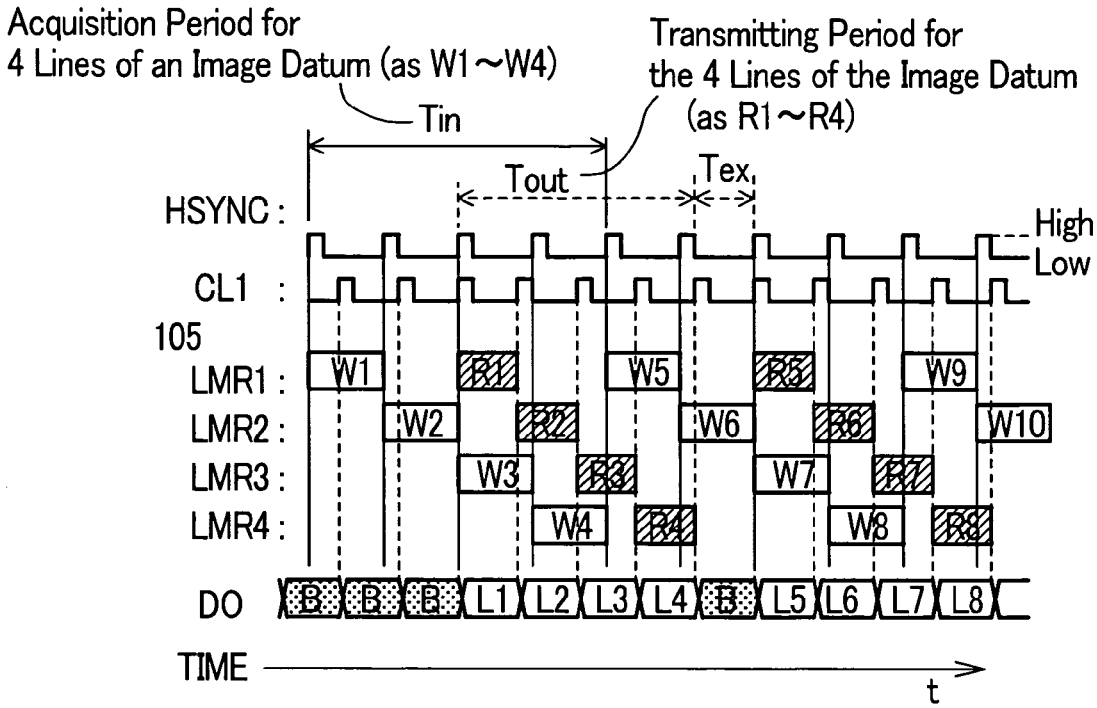
FIG. 5 is a timing diagram showing respective timings for writing image data to a plurality of (for example, four) line memories provided to a liquid crystal display device according to the present invention and for reading out of the image data from the line memories.
Figure 6:
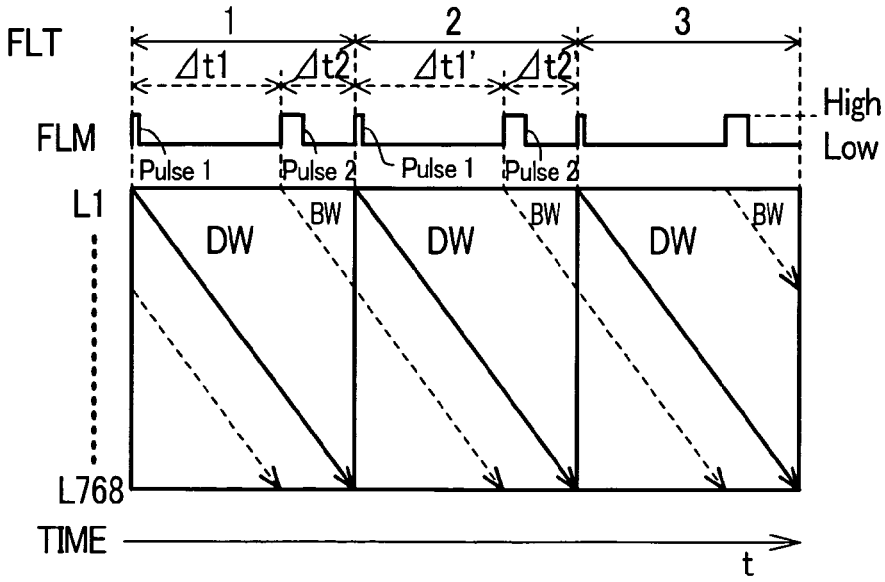
FIG. 6 is a timing diagram showing pixel display timing of every frame period (each one of three continuous frame periods) in the first embodiment of the driving method of the liquid crystal display device according to the present invention.
Figure 7:
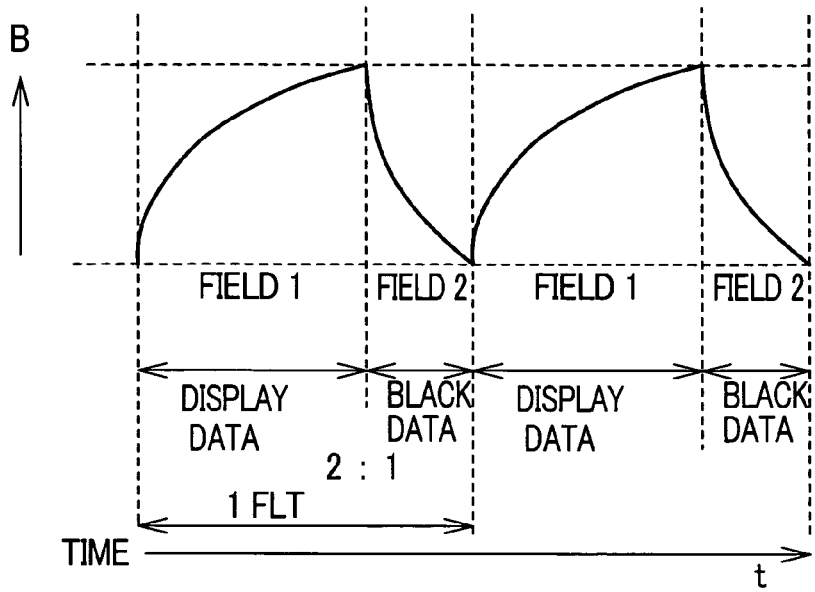
FIG. 7 is a characteristic diagram showing the brightness response to display signals (change of optical transmissivity of a liquid crystal layer corresponding to pixels) when the liquid crystal display device of the present invention is driven in accordance with pixel display timing shown in FIG. 6.

FIG. 5 is a timing chart showing the timing in which image data for 4 lines are written one after another to every other 4 line memories included in a line-memory circuit 105 provided to a display control circuit 104 (see FIG. 3), and the image data is read out from respective line memories and is transferred to a data driver (video signal driver circuit). FIG. 6 relates to a method for driving the display device of the present invention and shows display timing of image data and blanking data according to this embodiment in the pixel array, while FIG. 7 shows the brightness response (change of optical transmissivity of liquid crystal layer corresponding to pixels) when the display device (liquid crystal display device) of this embodiment is driven in accordance with this timing.

Firstly, a general description of the display device 100 of this embodiment will be explained in conjunction with FIG. 3.

The display device 100 includes a liquid crystal display panel (hereinafter referred to as a "liquid crystal panel")

having a resolution of the WXGA class operating as a pixel array 101, which is constituted of a TFT liquid crystal panel. The pixel array 101 having a resolution in the WXGA class is not limited to a liquid crystal panel and is characterized in that 768 pixel rows, each of which has pixels of 1280 dots in the horizontal direction, are juxtaposed in the vertical direction in the screen.

Although the pixel array 101 of the display device of this embodiment is substantially the same as the pixel array of the display device to be explained in conjunction with FIG. 9, due to the resolution thereof, the gate lines 10 consisting of 768 lines and the data lines 12 consisting of 1280 lines are respectively juxtaposed within the screen of the pixel array 101. Further, in the pixel array 101, 983040 pixels PIX, each of which is selected in response to the scanning signal transmitted through one of the former lines and receives the display signal from one of latter lines, are arranged two-dimensionally and images are produced by these pixels PIX.

When the pixel array displays color images, each pixel is divided in the horizontal direction corresponding to the number of primary colors used in the color display. For example, in a liquid crystal panel having a color filter corresponding to three primary colors (red, green, blue) of light, the number of the above-mentioned data lines 12 is increased to 3840 lines and the total number of pixels PIX included in the display screen is also three times as large as the above-mentioned value.

To describe the above-mentioned liquid crystal panel used as the pixel array 101 in this embodiment in more detail, each pixel PIX included in the liquid crystal panel is provided with a thin film transistor (abbreviated as TFT) operating as the switching element SW. Further, each pixel is operated in a so-called normally black-displaying mode in which, the larger the display signal supplied to each pixel, the higher will be the brightness exhibited by a pixel. Not only the pixel of the liquid crystal panel of this embodiment, but a pixel of the above-mentioned electroluminescence array or light emitting diode array, is also operated in the normally black-displaying mode.

In a liquid crystal panel that is operated in the normally black-displaying mode, the greater the potential difference between a gray scale voltage applied to the pixel electrode PX formed in the pixel PIX in FIG. 9 from the data line 12 through the switching element SW and a counter voltage (also referred to as reference voltage, common voltage) applied to the counter electrode CT which faces the pixel electrode PX while sandwiching a liquid crystal layer LC therebetween, the greater the optical transmissivity of the liquid crystal layer LC is elevated so as to increase the brightness of the pixel PIX. That is, with respect to the gray scale voltage which is the display signal of the liquid crystal panel, the remoter the value of the gray scale voltage away from the value of the counter voltage, the more the display signal is increased.

To the pixel array (TFT-type liquid crystal panel) 101 shown in FIG. 3, in the same manner as the pixel array 101 shown in FIG. 9, a data driver (display signal driver circuit) 102 which supplies display signals (gray scale voltages or tone voltages) corresponding to the display data to the data lines (signal lines) 12 formed on the pixel array 101 and scanning drivers (scanning signal driver circuits) 103-1, 103-2, 103-3 which supply scanning signals (voltage signals) to the gate lines (scanning lines) 10 formed on the pixel array 101 are respectively provided. In this embodiment, although the scanning driver is divided into three drivers along the so-called vertical direction of the pixel array 101, the number of these drivers is not limited to 3. Further, these drivers may be replaced with one scanning driver, which performs all of these functions.

A display control circuit (timing controller) 104 transmits the above-mentioned display data (driver data) 106 and timing signals (data driver control signals) 107 for controlling display signal outputs corresponding to the display data to the data driver 102. Further, the display control circuit 104 transmits scanning clock signals 112 and scanning start signals 113 to the respective scanning drivers 103-1, 103-2, 103-3. Although the display control circuit 104 also transfers scan-condition selecting signals 114-1, 114-2, 114-3 corresponding to the scanning drivers 103-1, 103-2, 103-3 to these scanning drivers 103-1, 103-2, 103-3, this function will be explained later. The scan-condition selecting signals are also referred to as display-operation selecting signals in view of the function thereof.

The display control circuit 104 receives image data (video signals) 120 and video control signals 121 inputted to the display control circuit 104 from an external video signal source of the display device 100, such as a television receiver set, a personal computer, a DVD player or the like. Although a memory circuit 105 which temporarily stores the image data 120 is provided in the inside of or in the periphery of the display control circuit 104, in this embodiment, a line memory circuit 105 is incorporated in the display control circuit 104. The video control signals 121 include a vertical synchronizing signal VSYNC which controls a transmission state of the image data, a horizontal synchronizing signal HSYNC, a dot clock signal DOTCLK and a display timing signal DTMG.

The image data which generates an image for one screen in the display device 100 is inputted to the display control circuit 104 in response to (in synchronism with) the vertical synchronizing signal VSYNC. That is, the image data is sequentially inputted to the display device 100 (display control circuit 104) from the above-mentioned video signal source for every cycle (also referred to as vertical scanning period or frame period) defined by the vertical synchronizing signal VSYNC, and the image for one screen is displayed on the pixel array 101 successively at every frame period.

The image data in one frame period is sequentially inputted to the display device by dividing a plurality of line data included in the image data with a cycle (also referred to as horizontal scanning period) defined by the above-mentioned horizontal synchronizing signals HYNC. That is, each image data which is inputted to the display device for every frame period includes a plurality of line data and the image of one screen generated by the line data is generated by sequentially arranging images in the horizontal direction depending on every line data for every horizontal scanning period in the vertical direction. Data corresponding to respective pixels arranged in the horizontal direction in one screen are identified with cycles in which the above-mentioned respective line data are defined by the above-mentioned dot clock signals.

Since the image data 120 and video control signals 121 are also inputted to a display device which uses a cathode ray tube, it is necessary to ensure time for the sweeping of electron lines thereof from the scanning completion position to the scanning start position for every horizontal scanning period and every frame period. This time constitutes a dead time in the transfer of the image information, and, hence, regions which are referred to as retrace periods which do not contribute to the transfer of image information corresponding to the dead time are also provided to the image data 120.

In the image data 120, the regions which correspond to these retrace periods are discriminated from other regions which contribute to the transfer of image information due to the above-mentioned display timing signal DTMG.

On the other hand, the active matrix type display device 100 according to this embodiment generates display signals corresponding to an amount of image data for one line (the above-mentioned line data) at the data driver 102 and these display signals are collectively outputted to a plurality of data lines (signal lines) 12 which are arranged in parallel in the pixel array 101 in response to the selection of the gate lines 10 by the scanning driver 103. Accordingly, theoretically, inputting of the line data to the pixel rows is continued from one horizontal scanning period to the next horizontal scanning period without sandwiching the retrace period therebetween, while inputting of the image data to the pixel array is also continued from one frame period to the next frame period. Accordingly, in the display device 100 of this embodiment, reading out of every image data (line data) for one line from the memory circuit (line memory) 105 using the display control circuit 104 is performed in accordance with the cycle generated by shortening the retrace periods which are included in the above-mentioned horizontal scanning periods (allocated to storing of the image data for one line to the memory circuit 105).

Since this cycle is reflected on an output interval of the display signals to the pixel array 101 to be described later, the cycle is referred to as the horizontal period of the pixel array operation or simply as the horizontal period. The display control circuit 104 generates a horizontal clock CL1 which defines the horizontal period and transfers the horizontal clock CL1 as one of the above-mentioned data driver control signals 107 to the data driver 102. In this embodiment, with respect to the time for storing the image data for one line to the memory circuit 105 (the above-mentioned horizontal scanning period), by shortening time for reading out the image data from the memory circuit 105 (the above-mentioned horizontal period), time for inputting blanking signals to the pixel array 101 for every one frame period is produced.

FIG. 2 is a timing chart showing one example of the inputting (storing) of image data to the memory circuit 105 and outputting (reading-out) of the image data from the memory circuit 105 using the display control circuit 104.

The image data which is inputted to the display device for every frame period FLT defined by the pulse interval of the vertical synchronizing signal VSYNC is, as shown in waveforms of the input data, sequentially inputted to the memory circuit 105 using the display control circuit 104 in response to (in synchronism with) the horizontal synchronizing signal HSYNC which defines the horizontal scanning period HPD including respective retracing periods for every plurality of line data (image data of 1 line) L1, L2, L3, . . . included in the image data. The display control circuit 104 sequentially reads out the line data L1, L2, L3, . . . stored in the memory circuit 105 in accordance with the above-mentioned horizontal clock CL1 or the timing signals similar to the horizontal clock CL1 as shown in the waveforms of the output data.

Here, the retrace periods TR which cause respective line data L1, L2, L3, . . . outputted from the memory circuit 105 to be spaced apart from each other along a time axis TIME are made shorter than the retrace periods TR which cause respective line data L1, L2, L3 . . . inputted to the memory circuit 105 to be spaced apart from each other along the time axis TIME. Accordingly, between the period necessary for inputting the line data to the memory circuit 105 N times (N being a natural number of 2 or more) and the period necessary for outputting these line data from the memory circuit 105 (N-time line data outputting period), a time which is capable of outputting the line data M times (M being a natural number smaller than N) from the memory circuit 105 is produced. In this embodiment, by making use of a so-called extra time in which the image data for M lines is outputted from the memory circuit 105, the pixel array 101 is made to perform a separate display operation.

Here, the image data (line data included in the image data in FIG. 2) is temporarily stored in the memory circuit 105 before being transferred to the data driver 102, and, hence, the image data is read out by the display control circuit 104 during a delay time DLY corresponding to the stored period. When a frame memory is used as the memory circuit 105, this delay time corresponds to one frame period. When the image data is inputted to the display device at the frequency of 30 Hz, one frame period thereof is about 33 ms (milliseconds), and, hence, a user of the display device cannot perceive the delay of display time of the image with respect to an input time of the image data to the display device. However, by providing a plurality of line memories to the display device 100 in place of the frame memory as the above-mentioned memory circuit 105, this delay time can be shortened, the structure of the display control circuit 104 or the peripheral circuit structure can be simplified or an increase in the size can be suppressed.

One example of the driving method of the display device 100 using the line memory for storing a plurality of line data as the memory circuit 105 will be explained in conjunction with FIG. 5. In the driving of the display device 100 according to this embodiment, in the above-mentioned extra time between the period for inputting image data for N lines to the display control circuit 104 and the period for outputting image data for N lines from the display control circuit 104 (period for sequentially outputting the display signals respectively corresponding to the N-line image data from the data driver 102), display signals (hereinafter, these signals, will be referred to as blanking signals) which mask the display signals which are already held in the pixel array (the image data which are inputted to the pixel array in one preceding frame period) are written M times. In this driving method of the display device 100, the first step, in which the display signals are sequentially generated from respective N-line image data using the data driver 102 and the display signals are outputted to the pixel array 101 sequentially (N times in total) in response to the horizontal clocks CL1, and the second step, in which the above-mentioned blanking signals are outputted to the pixel array 101 in response to the horizontal clock CL1 M times, are repeated. Although a further explanation of this driving method of the display device will be explained later in conjunction with FIG. 1, the above-mentioned N value is set to 4 and the above-mentioned M value is set to 1 in FIG. 5.

As shown in FIG. 5, the memory circuit 105 includes four line memories LMR 1 to 4 which perform writing and reading-out of data independently from each other, wherein the image data 120 for every one line which is sequentially inputted to the display device 100 in synchronism with the horizontal synchronizing signal HSYNC are sequentially stored into one of these line memories 1 to 4. That is, the memory circuit 105 has a memory capacity for 4 lines. For example, in an acquisition period Tin of image data 120 for 4 lines by the memory circuit 105, the image data W1, W2, W3, W4 for 4 lines are inputted to the line memory 4 from the line memory 1 sequentially.

The acquisition period Tin of image data extends over a time which is substantially four times as long as the horizontal scanning period defined by the pulse interval of the horizontal synchronizing signal HSYNC included in the video control signals 121. However, before this acquisition period Tin of image data is finished with storing of the image data into the line memory 4, the image data which is stored in the line memory 1, the line memory 2 and the line memory 3 in this period is sequentially read out as the image data R1, R2, R3 using the display control circuit 104. Accordingly, as soon as the acquisition period Tin of image data W1, W2, W3, W4 for 4 lines is finished, it is possible to start the storing of image data W5, W6, W7, W8 for next 4 lines to the line memories 1 to 4.

In the above-mentioned explanation, the reference symbol affixed to every one line of the image data was changed between the time of inputting the image data to the line memory and the time of outputting the image data from the line memory. For example, W1 is affixed to the former and R1 is affixed to the latter. This reflects the fact that the image data for every one line includes the above-mentioned retracing period, and when the image data is read out from any one of the line memories 1 to 4 in response to (in synchronism with) the horizontal clock CL1, which has a higher frequency than the above-mentioned horizontal synchronizing signal HSYNC, the retrace periods included in the image data are shortened. Accordingly, for example, compared to the length of the image data for one line (referred to as line data hereinafter) W1 inputted to the line memory 1 along a time axis, the length of the line data R1 outputted from the line memory 1 along a time axis is shorter, as shown in FIG. 5.

In the period from the inputting of the line data to the line memory to the outputting of the line data from the line memory, even when image information (for example, generating image of one line along the horizontal direction of the screen) included in the line data is not processed, the length of the image information along the time axis can be compressed as described above. Accordingly, between the completion of outputting of the 4-line image data R1, R2, R3, R4 from the line memories 1 to 4 and the start of outputting of the 4-line image data R5, R6, R7, R8 from the line memories 1 to 4, the above-mentioned extra time Tex is generated.

The 4-line image data R1, R2, R3, R4 which are read out from the line memories 1 to 4 are transferred to the data driver 102 as the driver data 106 and display signals L1, L2, L3, L4 which respectively correspond to the image data R1, R2, R3, R4 are produced (display signals L5, L6, L7, L8 being also produced correspond to the image data R5, R6, R7, R8 which are read out next time). These display signals are respectively outputted to the pixel array 101 in response to the above-mentioned horizontal clock CL1 in the order indicated by an eye diagram of the outputting the display signals shown in FIG. 5. Accordingly, by allowing the memory circuit 105 to include at least a line memory (or a mass thereof) having a capacity of the above-mentioned N line, it is possible to input image data of one line inputted to the display device during a certain frame period to the pixel array during this frame period, and, hence, the response speed of the display device in response to the inputting of image data can be enhanced.

On the other hand, as can be clearly understood from FIG. 5, the above-mentioned extra time Tex corresponds to the time for outputting the image data of one line from the line memory in response to the above-mentioned horizontal clock CL1. In this embodiment, another or separate display signal is outputted to the pixel array one time by making use of this extra time Tex. Another display signal according to this embodiment is a so-called blanking signal B which decreases the brightness of the pixel to which another display signal is inputted to a level equal to or below the brightness before another display signal is inputted to the pixel. For example, the brightness of the pixel which is displayed with a relatively high gray scale (white or bright gray color close to white in a monochromatic image display) before one frame period is decreased to a level lower than the above-mentioned level in response to the blanking signal B. On the other hand, the brightness of the pixel which is displayed with a relatively low gray scale (black or dark gray color like charcoal gray close to black in a monochromatic image display) before one frame period is hardly changed even after the inputting of the blanking signal B. This blanking signal B temporarily converts the image generated in the pixel array for every frame period into a dark image (blanking image). Due to such a display operation of the pixel array, even with respect to a hold-type display device, the image display in response to the image data inputted to the display device for every frame period can be performed in the same manner as the image display of an impulse type display device.

By applying the above-mentioned driving method of the display device, which repeats the first step in which N-line image data are sequentially outputted to the pixel array and the second step in which the blanking signal B is outputted to the pixel array M times to the hold-type display device, image display due to the hold-type display device can be performed in the same manner as the image display due to the impulse-type display device. This driving method of the display device is applicable not only to the display device which has been described in conjunction with FIG. 5 and includes the line memory having the capacity of at least N lines as the memory circuit 105, but also, for example, it is applicable to a display device which replaces the memory circuit 105 with a frame memory.

Such a driving method of the display device will be further explained in conjunction with FIG. 1. Although the operation of the display device in the above-mentioned first and second steps is directed to outputting of the display signals using the data driver 102 in the display device 100 shown in FIG. 3, an outputting of the scanning signals (selection of pixel rows) using the scanning driver 103 which is performed corresponding to outputting of the display signals will be described as follows. In the explanation set forth hereinafter, the "scanning signal" which is applied to the gate line (scanning signal line) 10 and selects the pixel row (a plurality of pixels PIX arranged along the gate line) corresponding to the gate line 10 indicates pulses (gate pulses) of the scanning signals which make the scanning signals respectively applied to the gate lines G1, G2, G3, . . . shown in FIG. 1 assume a High state. In the pixel array shown in FIG. 9, the switching element SW, which is provided to the pixel PIX, receives the gate pulse through the gate line 10 connected to the switching element SW and allows the display signal supplied from the data line 12 to be inputted to the pixel PIX.

During the period corresponding to the above-mentioned first step, for every outputting of the display signal corresponding to the N-line image data, the scanning signal which selects the pixel row corresponding to the Y line of the gate line is applied to the Y line of the gate line. Accordingly, the scanning signal is outputted N times from the scanning driver 103. Such an application of the scanning signal is sequentially performed in the direction from one end (for example, an upper end in FIG. 3) to another end of the pixel array 101 (for example, a lower end in FIG. 3) every other Y lines of gate lines for the above-mentioned every outputting of the display signal. Accordingly, in the first step, the pixel rows corresponding to gate lines of (Y×N) lines are selected and the display signals generated based on the image data are supplied to respective pixel rows. FIG. 1 shows output timing (see the eye diagram of data driver output voltage) of the display signals when the value of N is set to 4 and the value of Y is set to 1 and waveforms of the scanning signals which are applied to respective gate lines (scanning lines) corresponding to the output timing. Here, the period of the first step corresponds to the data driver output voltages 1 to 4, 5 to 8, 9 to 12, . . . , 513 to 516, . . . , respectively.

For the data drive output voltages 1 to 4, the scanning signal is sequentially applied to the gate lines G1 to G4. For the next data driver output voltages 5 to 8, the scanning signal is sequentially applied to the gate lines G5 to G8. After a lapse of further time, for the data drive output voltages 513 to 516, the scanning signal is sequentially applied to the gate lines G513 to G516. That is, outputting of scanning signals from the scanning driver 103 is sequentially performed in the direction that the address number (G1, G2, G3, . . . , G257, G258, G259, . . . , G513, G514, G515, . . . ) of the gate line 10 in the pixel array 101 is increased.

On the other hand, during the period corresponding to the above-mentioned second step, for every M-times outputting of the display signal, the scanning signal which selects the pixel rows corresponding to the Z-line of the gate lines is applied to the line Z of the gate lines as the blanking signal. Accordingly, the scanning signal is outputted M times from the scanning driver 103. The combination of gate lines (scanning lines) to which the scanning signal is applied for outputting of the scanning signal from the scanning driver 103 one time is not particularly limited. However, from a viewpoint of holding the display signal supplied to the pixel row in the first step and reducing a load applied to the data driver 102, it is preferable to sequentially apply the scanning signal to every other Z lines of gate lines for every outputting of the display signal. The application of the scanning signal to the gate lines in the second step is sequentially performed from one end of the pixel array 101 to another end of the pixel array 101 in the same manner as the first step. Accordingly, in the second step, the pixel rows corresponding to the gate lines consisting of (Z×M) lines are selected and the blanking signal is supplied to respective pixel rows.

FIG. 1 shows the output timing of the blanking signals B in the second step which follows the first step when the value of M is set to 1 and the value of Z is set to 4 and waveforms of the scanning signals which are applied to respective gate lines (scanning lines) corresponding to the output timing. In the second step which follows the first step in which the scanning signal is sequentially applied to the gate lines G1 to G4, for outputting the blanking signal B one time, the scanning signal is sequentially applied to 4 gate lines ranging from G257 to G260. Then, in the second step which follows the first step in which the scanning signal is sequentially applied to the gate lines G5 to G8, for outputting of the blanking signal B one time, the scanning signal is sequentially applied to 4 gate lines ranging from G261 to G264. Further, in the second step which follows the first step in which the scanning signal is sequentially applied to the gate lines G513 to G516, for outputting the blanking signal B one time, the scanning signal is sequentially applied to 4 gate lines ranging from G1 to G4.

As described above, in the first step, the scanning signal is sequentially applied to four gate lines, respectively, while in the second step, to apply the scanning signal to four gate lines collectively or simultaneously, for example, in response to outputting of the display signal from the data driver 102, it is necessary to match the operation of the scanning driver 103 to respective steps. As mentioned previously, the pixel array used in this embodiment has a resolution of the WXGA class and gate lines consisting of 768 lines are juxtaposed to the pixel array. On the other hand, a group of four gate lines (for example, G1 to G4) which are sequentially selected in the first step and a group of four gate lines (for example, G257 to G260) which are sequentially selected in the second step which follows the first step are spaced apart from each other by the gate lines consisting of 252 lines along the direction that the address number of the gate lines 10 in the pixel array 101 is increased. Accordingly, the gate lines consisting of 768 lines which are juxtaposed in the pixel array are divided into three groups each consisting of 256 lines along the vertical direction thereof (or extending direction of the gate lines) and the outputting operation of scanning signals from the scanning driver 103 is independently controlled for every group. To enable such control, in the display device shown in FIG. 3, three scanning drivers 103-1, 103-2, 103-3 are arranged along the pixel array 101 and the outputting of scanning signals from respective scanning drivers 103-1, 103-2, 103-3 is controlled in response to the scanning state selection signals 114-1, 114-2, 114-3.

For example, when the gate lines G1 to G4 are selected in the first step and the gate lines G257 to G260 are selected in the second step which follows the first step, the scanning state selection signal 114-1 instructs the scanning driver 103-1 to assume a scanning state in which outputting of the scanning signal for sequentially selecting the gate line for continuous 4 pulses of the scanning clock CL3 and stopping of outputting of the scanning signals for one pulse of the scanning clock CL3 which follows the outputting of the scanning signal are repeated. On the other hand, the scanning state selection signal 114-2 instructs the scanning driver 103-2 to assume a scanning state in which stopping of outputting of scanning signals for 4 continuous pulses of the scanning clock CL3 and outputting of scanning signals to 4 line gate lines for 1 pulse of the scanning clock CL3 which follows the stopping of outputting are repeated. Further, the scanning state selection signal 114-3 makes the scanning clock CL3 inputted to the scanning driver 103-3 ineffective and stops outputting of the scanning signal initiated by the scanning clock CL3. The respective scanning drivers 103-1, 103-2, 103-3 are provided with two control signal transfer networks corresponding to the above-mentioned two instructions by the scanning state selection signals 114-1, 114-2, 114-3.

On the other hand, the waveform of a scanning start signal FLM shown in FIG. 1 includes two pulses which rise at points of time t1 and t2. A series of gate line selection operations in the above-mentioned first step are started in response to the pulse (described as pulse 1, hereinafter referred to as the first pulse) of the scanning start signal FLM which is generated at the point of time t1, while a series of gate line selection operations in the above-mentioned second step are started in response to the pulse of the scanning start signal FLM (described as pulse 2, hereinafter referred to as the second pulse) which is generated at the point of time t2.

The first pulse of the scanning start signal FLM also responds to the start of inputting the image data (defined by a pulse of the above-mentioned vertical synchronizing signal VSYNC) to the display device during 1 frame period. Accordingly, the first pulse and the second pulse of the scanning start signals FLM are repeatedly generated every frame period.

Further, by adjusting an interval between the first pulse of the scanning start signal FLM and the second pulse which follows the first pulse of the scanning start signal FLM and an interval between this second pulse and the pulse which follows the second pulse (for example, the first pulse of the next frame period), the time for holding the display signal based on image data in the pixel array during 1 frame period can be adjusted. That is, the pulse interval including the first pulse and the second pulse generated on the scanning start signal FLM can take two different values (time widths) alternately. On the other hand, the scanning start signal FLM is generated by the display control circuit (timing controller) 104. From the above, the above-mentioned scanning state selection signals 114-1, 114-2, 114-3 can be generated in reference to the scanning start signal FLM in the display control circuit 104.

FIG. 1 shows the operation in which every time the image data shown in FIG. 1 are written 4 times in the pixel array for every 1 line, the blanking signal is written in the pixel array one time. As has been explained in conjunction with FIG. 5, such a blanking signal writing operation is completed within the time necessary for inputting the image data for 4 lines to the display device. Further, in response to the above-mentioned operation, the scanning signal is outputted to the pixel array 5 times. Accordingly, the horizontal period necessary for operating the pixel array becomes ⅘ of the horizontal scanning period of the video control signal 121. In this manner, the inputting of image data (display signals based on the image data) and the blanking signal to be inputted to the display device during one frame period to all of the pixels within the pixel array is completed within this 1 frame period.

The blanking signal shown in FIG. 1 generates pseudo image data (hereinafter referred to as blanking data) in the display control circuit 104 and the peripheral circuit thereof. Here, the pseudo image data may be transferred to the data driver 102 and the blanking data may be generated in the data driver 102. Alternatively, a circuit which generates the blanking signal may be preliminarily formed in the data driver 102 and the blanking signal may be outputted to the pixel array 101 in response to a specific pulse of the horizontal clock CL1 transferred from the display control circuit 104.

In the former case, a frame memory is provided in the display control circuit 104 or in the vicinity of the display control circuit 104 and the pixel in which the blanking signal is to be strengthened based on the image data for every frame period (pixel displayed with high brightness due to the image data) stored in the frame memory is specified using the display control circuit 104, and the blanking data which makes the data driver 102 generate blanking signal which differs in darkness in response to the pixel may be generated.

In the latter case, the number of pulses of the horizontal clock CL1 is counted by the data driver 102 so as to make the data driver 102 output the display signal which enables the pixel display black or dark color close to black (for example, color such as charcoal gray) in response to the count number. At a portion of the liquid crystal display device, a plurality of gray scale voltages which determine the brightness of the pixels are generated by the display control circuit (timing converter) 104. In such a liquid crystal display device, a plurality of gray scale voltages are transferred by the data driver 102, the gray scale voltages corresponding to the image data are selected and are outputted to the pixel array by the data driver 102. In the same manner, the blanking signals may be generated by selection of the gray scale voltages in response to pulses of the horizontal clock CL1 due to the data driver 102.

The manner of outputting display signals to the pixel array and the manner of outputting scanning signals to respective gate lines (scanning lines) corresponding to the display signals according to the present invention shown in FIG. 1 are suitable for driving the display device having the scanning driver 103 which has a function of simultaneously outputting the scanning signal to a plurality of gate lines in response to the inputted scanning state selection signal 114. On the other hand, without simultaneously outputting the scanning signal to a plurality of scanning lines to a plurality of scanning lines as explained above, by making the respective scanning drivers 103-1, 103-2, 103-3 sequentially output scanning signals for every one line of the gate lines (scanning lines) for every pulse of the scanning clock CL3, the image display operation according to the present invention can be performed. The image display operation of this embodiment in which inputting of the blanking data into 4 of another pixel rows (the above-mentioned first step in which the blanking data is outputted one time) is repeated every time the image data of 4 lines are sequentially inputted to one of pixel rows (the above-mentioned first step in which the image data are outputted four times) due to such operations of the scanning drivers 103 will be explained in conjunction with respective output waveforms of the display signals and the scanning signals shown in FIG. 4.

With respect to a driving method of the display device which will be explained in conjunction with FIG. 4, the display device shown in FIG. 3 is referred to in the same manner as FIG. 1. Each scanning driver 103-1, 103-2, 103-3 includes 256 terminals for outputting the scanning signals. That is, each scanning driver 103 can output the scanning signals to gate lines consisting of 256 lines at maximum. On the other hand, the pixel array 101 (for example, the liquid crystal display panel) is provided with gate lines 10 consisting of 768 lines and pixel rows which correspond to the respective gate lines. Accordingly, three scanning drivers 103-1, 103-2, 103-3 are sequentially arranged at one side of the pixel array 101 along the vertical direction (extending direction of the data lines 12 provided to the pixel array). The scanning driver 103-1 outputs the scanning signals to a group of gate lines G1 to G256, the scanning driver 103-2 outputs the scanning signals to a group of gate lines G257 to G512, and the scanning driver 103-3 outputs the scanning signals to a group of gate lines G513 to G768 so as to control the image display on the whole screen (whole region of the pixel array 101) of the display device 100.

The display device to which the driving method described in conjunction with FIG. 1 is applied and the display device to which the driving method to be described hereinafter in conjunction with FIG. 4 is applied are the same with respect to the point that they both have the above-mentioned arrangement of scanning drivers. Further, with respect to the provision that the waveform of the scanning start signal FLM includes the first pulse which starts outputting of a series of scanning signals which serve for inputting the image data to the pixel array and the second pulse which starts outputting of a series of scanning signals which are served for inputting the blanking data to the pixel array in every frame period, the driving method of the display device which is explained in conjunction with FIG. 1 and the driving method of the display device which is explained in conjunction with FIG. 4 are in common. Further, also with respect to the provision that the scanning driver 103 acquires the first pulse and the second pulse of the above-mentioned scanning start signal FLM in response to the scanning clock CL3 and, thereafter, terminals (or a group of terminals) from which the scanning signals are to be outputted in response to the scanning clock CL3 are sequentially shifted in response to the acquisition of the image data or the blanking data into the pixel array, the driving method of the display device using the signal waveforms shown in FIG. 1 and the driving method of the display device using the signal waveforms shown in FIG. 4 are common.

However, the driving method of the display device of this embodiment, which will be explained in conjunction with FIG. 4, differs from the driving method of the display device which has been described in conjunction with FIG. 1 in the roles of the scanning state selection signals 114-1, 114-2, 114-3. In FIG. 4, respective waveforms of the scanning state selection signals 114-1, 114-2, 114-3 are indicated as DISP1, DISP2, DISP3. The scanning state selection signals 114, first of all, determine the output operations of the scanning signals in the regions which the scanning state selection signals 114 control (a group of pixels corresponding to a group of gate lines G257 to G512 in case of DISP2, for example) in response to operational conditions applied to these regions.

In FIG. 4, in the period in which the data driver output voltages exhibit outputs of the display signals L513 to L516 in response to the image data of 4 lines (the above-mentioned first step in which the display signals L513 to L516 are outputted), the scanning signals are applied to the gate lines G513 to G516 from the scanning driver 103-3 corresponding to the pixel rows to which these display signals are inputted. Accordingly, the scanning state selection signal 114-3 which is transferred to the scanning driver 103-3 performs a so-called gate line selection for every one line which sequentially outputs the scanning signal for every one line of the gate lines G513 to G516 in response to the scanning clock CL3 (for every outputting of the gate pulse one time). Accordingly, the display signal L513 is supplied to the pixel rows corresponding to the gate line G513 over one horizontal period (defined by the pulse interval of the horizontal clock CL1). Then, the display signal L514 is supplied to the pixel rows corresponding to the gate line G514 over one horizontal period. Subsequently, the display signal L515 is supplied to the pixel rows corresponding to the gate line G515 over one horizontal period. Finally, the display signal L516 is supplied to the pixel rows corresponding to the gate line G516 over one horizontal period.

On the other hand, in the above-mentioned second step which follows the first step and in which these display signals L513 to L516 are sequentially outputted for every horizontal period (in response to the pulse of the horizontal clock CL1), the blanking signal B is outputted in one horizontal period which follows 4 horizontal periods corresponding to the first step. In this embodiment, the blanking signal B which is outputted between outputting of the display signal L516 and the outputting of the display signal L517 is supplied to respective pixel rows corresponding to the group of gate lines G5 to G8. Accordingly, the scanning driver 103-1 is required to perform a so-called 4-line simultaneous gate-line selection which applies the scanning signal to all 4 lines of the gate lines G5 to G8 within the outputting period of the blanking signal B. However, in the display operation of the pixel array according to FIG. 4, as mentioned above, although the scanning driver 103 starts the application of scanning signal to only one gate line in response to the scanning clock CL3 (for the pulse generated one time), the scanning driver 103 does not start the application of scanning signal to a plurality of gate lines. That is, the scanning driver 103 does not simultaneously rise the scanning signal pulses for a plurality of gate lines.

Accordingly, the scanning state selection signal 114-1 transferred to the scanning driver 103-1 applies the scanning signal to at least (Z−1) lines out of Z lines of gate lines to which the scanning signal is to be applied before outputting the blanking signal B, and controls the scanning driver 103-1 such that the application time of the scanning signal (pulse width of the scanning signal) is prolonged to a period which is at least N times as long as the horizontal period. These variables Z, N are the selection number: Z of gate lines in the second step and the outputting number: N of display signals in the first step which are described in the explanation of the first step for writing the image data to the pixel array and the second step for writing the blanking data to the pixel array.

For example, scanning signals are respectively applied to the gate lines G5 to G8 in the following manner. That is, the scanning signal is supplied to the gate line G5 from an outputting start time of the display signal L514 over a period which is 5 times as long as the horizontal period. The scanning signal is supplied to the gate line G6 from an outputting start time of the display signal L515 over a period which is 5 times as long as the horizontal period. The scanning signal is supplied to the gate line G7 from an outputting start time of the display signal L516 over a period which is 5 times as long as the horizontal period. The scanning signal is supplied to the gate line G8 from an outputting completion time of the display signal L516 (outputting start time of the blanking signal B which follows the gate line G8) over a period which is 5 times as long as the horizontal period. That is, although the respective rising times of the gate pulses of a group of gate lines G5 to G8 due to the scanning driver 103 are sequentially shifted for every one horizontal period in response to the scanning clock CL3, by delaying the respective falling times of the respective gate pulses after N horizontal period of the rising time, all of the gate pulses of the groups of gate lines G5 to G8 are made to assume a state in which the gate pulses rise (High in FIG. 4) during the above-mentioned blanking signal outputting period. In controlling outputting of the gate pulses in this manner, it is preferable to design the scanning driver 103 to have a shift resistor operational function. Here, hatched regions indicated in the gate pulses of the gate lines G1 to G12 in which the blanking signal is supplied to the corresponding pixel rows will be explained later.

On the other hand, between this period (the above-mentioned first step in which the display signals L513 to L516 are outputted) and the second step which follows the first step, the display signals are not supplied to the pixel rows which correspond to the group of gate lines G257 to G512 which receive the scanning signals from the scanning driver 103-2. Accordingly, the scanning state selection signal 114-2 which is transferred to the scanning driver 103-2 makes the scanning clock CL3 ineffective for the scanning driver 103-2 during the period extending over the first step and the second step. Such an operation to make the scanning clock CL3 ineffective using the scanning state selection signal 114 is applicable at a given timing to a case in which the display signals and the blanking signals are supplied to the group of pixels within the region to which the scanning signals are outputted from the scanning driver 103 to which the scanning state selection signal 114-2 is transferred.

In FIG. 4, the waveform of the scanning clock CL3 corresponding to the scanning signal output from the scanning driver 103-1 is shown. Although the pulse of the scanning clock CL3 is generated in response to the pulse of the horizontal clock CL1 which defines an output of the interval of the display signal and the blanking signal, the pulses are not generated at the output start time of the display signals L513, L517 . . . . In this manner, the operation to cause the scanning clock CL3 transferred to the scanning driver 103 from the display control circuit 104 to be ineffective at a specific time can be performed using the scanning state selection signal 114. The operation to make the scanning clock CL3 partially ineffective for the scanning driver 103 may be performed such that a signal processing path corresponding to the scanning clock CL3 is incorporated in the scanning driver 103 and the operation of the signal processing path may be started in response to the scanning state selection signal 114 transferred to the scanning driver 103. Here, although not shown in FIG. 4, the scanning driver 103-3 which controls writing of the image data to the pixel array also becomes dead for the scanning clock LC3 at the outputting start time of the blanking signal B. Accordingly, it is possible to prevent the scanning driver 103-3 from erroneously supplying the blanking signal to the pixel rows to which the display signals based on the image data are supplied in the first step which follows the second step due to outputting of the blanking signal B.

Next, the scanning state selection signals 114 make the pulses of the scanning signals (gate pulses) which are sequentially generated in the regions, which the scanning state selection signals 114 respectively control, ineffective at a stage in which the gate pulses are outputted to the gate lines. This function, in the driving method of the display device shown in FIG. 4, makes the scanning state selection signal 114 transferred to the scanning driver 103 concerned with the signal processing inside the scanning driver 103 which supplies the blanking signal to the pixel array. Three waveforms DISP1, DISP2, DISP3 shown in FIG. 4 show those of the scanning state selection signals 114-1, 114-2, 114-3 which are concerned with the signal processing inside the respective scanning drivers 103-1, 103-2, 103-3. When these waveforms DISP1, DISP2, DISP3 are at Low-level, outputting of the gate pulse becomes effective. Further, the waveform DISP1 of the scanning state selection signal 114-1 assumes the High-level during the period in which the display signals are outputted to the pixel array in the above-mentioned first step so as to make outputting of the gate pulse generated by the scanning driver 103-1 during this period ineffective.

For example, the gate pulses which are generated on the scanning signals respectively corresponding to the gate lines G1 to G7 during 4 horizontal periods in which the display signals L513 to L516 are supplied to the pixel array have respective outputs thereof made ineffective as indicated by hatching in response to the scanning state selection signal DISP1 which assumes the High-level during this period. Accordingly, it is possible to prevent the display signals based on the image data from being erroneously supplied to the pixel rows to which the blanking signals are to be supplied during a certain period and hence, the blanking display due to these pixel rows (erasing of images displayed in these pixel rows) can be surely performed and, at the same time, the loss of intensity of the display signals based on the image data per se can be prevented. Further, during one horizontal period in which the blanking signal B is outputted and which is arranged between 4 horizontal periods in which the display signals L513 to L516 are outputted and the next 4 horizontal periods in which the display signals L517 to L520 are outputted, the scanning state selection signal DISP1 assumes the Low-level. Accordingly, the gate pulses which are generated on the scanning signals corresponding to respective gate lines G5 to G8 during these periods are collectively outputted to the pixel array, the pixel rows corresponding to these gate lines consisting of 4 lines are simultaneously selected, and the blanking signals B are supplied to the respective pixel rows.

As described above, in the display operation of the display device shown in FIG. 4, based on the scanning state selection signals 114, it is possible to determine not only the operational state of the scanning driver 103 to which the scanning state selection signal 114 is transferred (the operational state of either one of the above-mentioned first step and the above-mentioned second step or the non-operational state which depends on neither of them), but also the validity of outputting of the gate pulses generated by the scanning driver 103 in response to these operational states. Here, a series of controls of the scanning driver 103 (outputting of scanning signals from the scanning driver 103) based on these scanning state selection signals 114 are started from outputting the scanning signal to the gate line G1 in response to the scanning start signal FLM with respect to both the writing of the display signals based on the image data to the pixel array and the writing of the blanking signals.

FIG. 4 mainly shows the line selection operation (4 line simultaneous selection operation) of the gate lines using the scanning driver 103 which is sequentially shifted by the scanning state selection signal DISP1 in response to the above-mentioned second pulse of the scanning start signal FLM. Although not shown in FIG. 4, due to the operation of the display device in response to the scanning state selection signal DISP1, the selection operation of gate line for every line using the scanning driver 103 is sequentially shifted in response to the first pulse of the scanning start signals FLM. Accordingly, also in the operation of the display device shown in FIG. 4, it is necessary to start the scanning of two types of pixel arrays one time for each in response to the scanning start signal FLM for every frame period, and, hence, as the waveform of the scanning start signal FLM, the first pulse and the second pulse which follows the first pulse appear.

In both of the above-mentioned driving methods of the display device shown in FIG. 1 and FIG. 4, the number of the scanning drivers 103 which are arranged along one side of the pixel array 101 and the number of scanning state selection signals 114 which are transmitted to the scanning drivers 103 can be changed without changing the structure of the pixel array 101 which has been described in conjunction with FIG. 3 and FIG. 9, wherein respective functions which are shared by three scanning drivers 103 may be collectively held by one scanning driver 103 (for example, the inside of the scanning driver 103 is divided into circuit sections respectively corresponding to the above-mentioned three scanning drivers 103-1, 103-2, 103-3).

FIG. 6 is a timing chart showing image display timing of a display device of this embodiment over three continuous frame periods FLT. At the beginning of each frame period, writing of image data DW from the first scanning line (corresponding to the above-mentioned gate line G1) to the pixel array is started in response to the first pulse of the scanning start signal FLM. After a lapse of time: $\Delta t1$ from this point of time, writing of blanking data BW from the first scanning line to the pixel array is started in response to the second pulse of the scanning start signal FLM. Further, after a lapse of time: $\Delta t2$ from the point of time that the second pulse of the scanning start signal FLM is generated, writing of image data to be inputted to the display device to the pixel array in the next frame period is started in response to the first pulse of the scanning start signal FLM. Here, in this embodiment, time: Δt1' shown in FIG. 6 is equal to the time: Δt1 and time: Δt2' shown in FIG. 6 is equal to time Δt2.

With respect to the advance of writing of image data to the pixel array and the advance of writing of the blanking data, although they differ in the number of lines (the former: 1 line the latter: 4 lines) of gate lines which they select during one horizontal period, these writings advance substantially equally with respect to the lapse of time. Accordingly, irrespective of positions of the scanning lines in the pixel array, the period that the pixel rows which correspond to respective scanning lines hold display signals based on the image data (substantially covering the above-mentioned time Δt1: including time for receiving the display signals) and the period in which the pixel rows hold the blanking signal (substantially covering the above-mentioned time: Δt2 including time for receiving the blanking signal) become substantially uniform over the vertical direction of the pixel array. That is, the irregularities of display brightness between the pixel rows (along the vertical direction) in the pixel array can be suppressed.

In this embodiment, 67% and 33% of one frame are respectively allocated to the display period of the image data in the pixel array and the display period of the blanking data as shown in FIG. 6, and the timing adjustment of the scanning start signal FLM corresponding to the allocation of frame period is performed (the above-mentioned times Δt1 and Δt2 are adjusted). However, by changing the timing of the scanning start signal FLM, the display period of the image data and the display period of the blanking data can be suitably changed.

One example of the brightness response of the pixel rows, when the display device is operated at the image display timing shown in FIG. 6, is shown in FIG. 7. In this brightness response, a liquid crystal display panel which has the resolution of WXGA class and is operated in the normally black display mode is used as the pixel array 101 shown in FIG. 3, and display ON data which displays the pixel rows in white are written in the pixel rows as the image data, while display OFF data which displays the pixel rows in black are written in the pixel rows as blanking data. Accordingly, the brightness response B shown in FIG. 7 shows a change of optical transmissivity of the liquid crystal layer corresponding to the pixel rows of the liquid crystal display panel.

As shown in FIG. 7, pixel rows (each pixel included in these pixel rows), during one frame period, respond to the brightness corresponding to the image data first of all and, thereafter, respond to the black brightness. Although the optical transmissivity of the liquid crystal layer responds to the change of an electric field applied to the liquid crystal layer relatively gradually, as clearly understood from FIG. 7, the value of the optical transmissivity sufficiently responds to the electric field corresponding to the image data for every frame period and an electric field corresponding to the blanking data. Accordingly, with respect to an image due to image data generated on the screen (pixel rows) during the frame period, the image is sufficiently erased from the screen (pixel rows) within the frame period and hence, the image is displayed in the same state as an impulse type display device. Due to such an impulse-type response of the image based on the image data, blurring of an animated image which is generated on the image can be reduced. Such an advantageous effect can be obtained in the same manner by changing the resolution of the pixel array or by changing the rate of the retrace period in the horizontal period of the driver data shown in FIG. 2.

In the above-mentioned embodiment, in the first step, the display signals which are generated for every line of image data are sequentially outputted to the pixel array four times and are respectively sequentially supplied to the pixel row corresponding to line of the gate lines, and in the succeeding second step, the blanking signals are sequentially outputted to the pixel array one time and are supplied to the pixel rows corresponding to 4 lines of gate lines. However, the outputting number: N (this value also corresponding to the number of line data written in the pixel array) of the display signals in the first step is not limited to 4, while the outputting number: M of the blanking signals in the second step is not limited to 1. Further, the line number: Y of the gate lines to which the scanning signals (selection pulses) are applied for one-time outputting of the display signals in the first step is not limited to 1, while the line numbers: Z of the gate lines to which the scanning signal is applied for one-time blanking signal output in the second step is not limited to 4. These factors N, M are required to be natural numbers which satisfy the condition that M<N and N is required to be 2 or more. Further, it is also required that the factor Y is a natural number smaller than N/M and the factor Z is a natural number equal to or greater than N/M. Still further, one cycle in which N-time display signal outputting and M-time blanking signal outputting are performed is completed within a period in which N-line image data are inputted to the display device. That is, the value which is (N+M) times as large as the horizontal period in the operation of the pixel array is set to a value equal to or smaller than the value which is N times as large as the horizontal scanning period in the inputting of the image data to the display device. The former horizontal period is defined by the pulse interval of the horizontal clock CL1, while the latter horizontal scanning period is defined by the pulse interval of the horizontal synchronizing signal HSYNC which constitutes one of the video control signals.

According to such operational conditions of the pixel array, during the period Tin in which N-line image data are inputted to the display device, the (N+M) times signal outputting from the data driver 102 is performed, that is, the pixel array operation of 1 cycle consisting of the first step and second step which follows the first step is performed. Accordingly, time (referred to as Tinvention hereinafter) allocated respectively to outputting of display signals and outputting of blanking signals in this one cycle is reduced to a value which is (N/(N+M)) times as large as the time (referred to as Tprior hereinafter) necessary for outputting signal one time for sequentially outputting the display signal corresponding to the N-line image data during the period Tin. However, since the factor M is a natural number smaller than N, according to the present invention, the outputting period Tinvention of the present invention in which signals during one cycle are outputted can ensure a length which is equal to or longer than ½ of the above-mentioned Tprior. That is, from a viewpoint of writing the image data to the pixel array, an advantageous effect described in the above-mentioned SID 01 Digest, pages 994 to 997 is obtained against a technique described in the above-mentioned Japanese Unexamined Patent Publication 2001-166280.

Further, according to the present invention, by supplying the blanking signals to the pixels during the period Tinvention, it is possible to rapidly lower the brightness of the pixel. Accordingly, compared to the technique described in SID 01 Digest, pages 994 to 997, according to the present invention, the video display period and the blanking display period of each pixel row during one frame period can be clearly divided and hence, the motion blur can be efficiently reduced. Further, in accordance with the present invention, although the supply of the blanking signals to the pixels is performed intermittently for every (N+M) times, the blanking signals can be supplied to the pixel row corresponding to Z-line gate lines with respect to 1-time blanking signal outputting and hence, the irregularities of ratio between the video display period and the blanking display period which are generated between the pixel rows can be suppressed. Further, by sequentially applying the scanning signal to the gate line every other Z line of the gate lines for every outputting of the blanking signal, the load for one-time outputting of the blanking signal from the data driver 102 also can be reduced due to the restriction on the number of pixel rows to which the blanking signal is supplied.

Accordingly, the driving of the display device according to the present invention is not limited to the example which has been described in conjunction with FIG. 1 to FIG. 7 and in which N is set to 4, M is set to 1 an Z is set to 4. That is, so long as the above-mentioned conditions are satisfied, the driving of the display device according to the present invention is universally applicable to the whole driving of the hold-type display device. For example, when the image data is inputted to the display device using an interlace method through either one of odd-numbered lines and even-numbered lines for every frame period, the image data of the odd-numbered lines or the even-numbered lines are sequentially applied for every line and the scanning signals are sequentially applied for every 2 lines of gate lines, and the display signals may be supplied to the pixel rows corresponding to them (in this case, at least the above-mentioned factor Y assuming 2). Further, in the driving of the display device according to the present invention, the frequency of the horizontal clock CL1 is set to a value which is ((N+M)/N) times (1.25 times in the examples shown in FIG. 1 and FIG. 4) as large as the frequency of the horizontal synchronizing signal HSYNC. However, the frequency of the horizontal clock CL1 may be increased further so as to narrow the pulse interval and to ensure the operational margin of the pixel array. In this case, a pulse oscillation circuit may be provided to or in the vicinity of the display control circuit 104 and hence, the frequency of the horizontal clock CL1 may be increased in conjunction with the reference signal having frequency higher than that of a dot clock DOTCLK included in the video control signals generated by the pulse oscillation circuit.

With respect to the above-mentioned respective factors, the factor N may preferably be set to the natural number of 4 or more, while the factor M may preferably be set to 1. Further, the factor Y may preferably take the equal value as the factor M, while the factor Z may preferably take the equal value as the factor N.

Second Embodiment

In this embodiment, in the same manner as the above-mentioned first embodiment, with respect to the image data which is inputted to the display device shown in FIG. 3 at the timing shown in FIG. 2, the display signals and the scanning signals are outputted from the data driver 102 with the waveforms shown in FIG. 1 or FIG. 4 and the display is performed in accordance with the display timing shown in FIG. 6. However, in this embodiment, the output timing of the blanking signals with respect to the outputting of the display signals based on the image data shown in FIG. 1 and FIG. 4 is changed every frame period as shown in FIG. 8.

Figure 8:
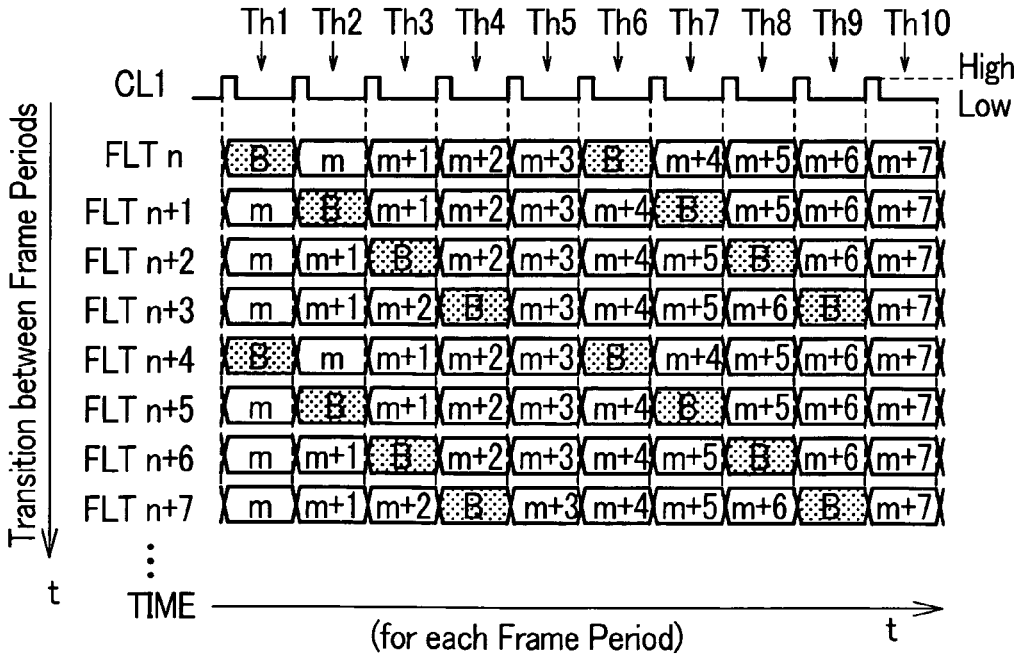
FIG. 8 is a diagram showing the change of display signals (m, m+1, m+2, . . . based on image data and B based on a blanking data) supplied to respective pixel rows corresponding to gate lines G1, G2, G3, . . . over a plurality of continuous frame periods n, n+1, n+2, . . . according to a second embodiment of the driving method of the liquid crystal display device of the present invention.

In the display device using a liquid crystal display panel as the pixel array, the output timing of the blanking signals of this embodiment, as shown in FIG. 8, has an advantageous effect in that the influence of rounding of waveforms of the signals generated in the data lines of the liquid crystal display panel to which the blanking signals are supplied can be dispersed, whereby the display quality of the image can be enhanced. In FIG. 8, periods Th1, Th2, Th3, . . . which respectively correspond to pulses of the horizontal clock CL1 are sequentially arranged in the lateral direction and, in any one of these periods, eye diagrams each of which includes the display signals m, m+1, m+2, m+3, . . . for every 1 line of the image data outputted from the data driver 102 and the blanking signal B are sequentially arranged in the longitudinal direction for every one of continuous frame periods n, n+1, n+2, n+3, . . . . The display signals m, m+1, m+2, m+3 described in this embodiment are not limited to the image data of specific lines and, for example, can be used as the display signals L1, L2, L3, L4 as well as the display signals L511, L512, L513, L514 in FIG. 1.

Every time the image data are written in the pixel array four times in the manner explained in conjunction with the first embodiment, the blanking data are written in the pixel array one time. In this case, periods in which the blanking data is applied to the pixel array shown in FIG. 8 are sequentially changed for every frame from any one of group of periods (for example, a group consisting of the periods Th1, Th6, Th12, . . . ) which are arranged every 4 other periods in the above-mentioned periods Th1, Th2, Th3, Th4, Th5, Th6, . . . to another group of periods (for example, a group consisting of periods Th2, Th7, Th13, . . . ). For example, in the frame period n, before inputting the mth line data into the pixel array (before applying the display signal based on the mth line data to the mth pixel row), the blanking data are inputted to the pixel array (the blanking data is applied to the pixel row corresponding to the given 4 lines of the gate lines). In the frame period n+1, after inputting the mth line data into the pixel array and before inputting the (m+1)th line data into the pixel array, the above-mentioned blanking data are inputted to the pixel array. Inputting of the (m+1)th line data to the pixel array follows that of the mth line data and the display signal based on the (m+1)th line data is applied to the (m+1)th pixel row. In succeeding inputting of respective line data to the pixel array, the display signal based on the line data is applied to the pixel row having the same address (order) as the line data.

In the frame period n+2, after inputting the (m+1)th line data into the pixel array and before inputting the (m+2)th line data into the pixel array, the blanking data are inputted to the pixel array. In the subsequent frame period n+3, after inputting the (m+2)th line data into the pixel array and before inputting the (m+3)th line data into the pixel array, the blanking data are inputted to the pixel array. Thereafter, such inputting of the line data and the blanking data to the pixel array is repeated by shifting or deviating the timing of the blanking data every horizontal period and, in the frame period n+4, the inputting returns to the input pattern of the line data and the blanking data to the pixel array in the frame period n. By repeating a series of operations, the influence of the rounding of the signal waveforms which are generated along the extending direction of data line when not only the blanking signal but also the display signal based on the line data are outputted to respective data lines of the pixel array can be uniformly dispersed so that the quality of image displayed on the pixel array can be enhanced.

In this embodiment, in the same manner as the first embodiment, the display device can be operated at the image display timing shown in FIG. 6. In this embodiment, however, since the timing for applying the blanking signal to the pixel array is shifted every frame period as mentioned above, a point of time for generating the second pulse of the scanning start signal FLM which starts scanning of the pixel array by the blanking signal is deviated corresponding to the frame period. Corresponding to the change of the second pulse generating timing of the scanning start signal FLM, the time: Δt1 indicated in the frame period 1 in FIG. 6 becomes the time: Δt1' which is shorter (or longer) than the time: Δt1 in the succeeding frame period 2, and the time: Δt2 indicated in the frame period 1 becomes the time: Δt2' which is longer (or shorter) than the time: Δt2 in the succeeding frame period 2. To consider "the deviation" of the scanning start time of the pixel array on the display signals based on the line data m which is observed between a pair of frame periods n and n+1 and between another pair of frame periods n+3 and n+4 shown in FIG. 8, in this embodiment, at least one of two time intervals: Δt1, Δt2 corresponding to the pulse interval of the scanning start signal FLM is changed in response to the frame period.

As described above, when the display operation is performed following the image display timing shown in FIG. 6 in accordance with the driving method of the display device according to this embodiment which shifts the outputting period of blanking signal along the time axis direction for every frame period, some change is necessary in setting the scanning start signal. However, the advantageous effects obtained by this embodiment are almost comparable to the advantageous effects obtained by the first embodiment shown in FIG. 7. Accordingly, in this embodiment, the image corresponding to the image data can be displayed on the hold-type display device substantially in the same manner as the impulse-type display device. Further, compared to the hold-type pixel array, the animated images do not damage the brightness and hence, it is possible to perform the display by reducing the motion blur generated in the animated image. Also, in this embodiment, the ratio between the display period of image data and the display period of blanking data during one frame period can be suitably changed by adjusting the timing of the scanning start signal FLM (for example, the distribution of the above-mentioned pulse intervals: Δt1, Δt2). Further, the applicable range of the driving method of this embodiment to the display device is not limited, as in the case of the driving method of the first embodiment, by the resolution of the pixel array (for example, liquid crystal display panel). Still further, in the display device according to this embodiment, in the same manner as the display device of the first embodiment, by suitably changing the ratio of the retrace period included in the horizontal period defined by the horizontal clock CL1, the outputting number: N of display signals in the first step and the line number: Z of the gate lines selected by the second step can be increased or decreased.

Third Embodiment

Figure 10:
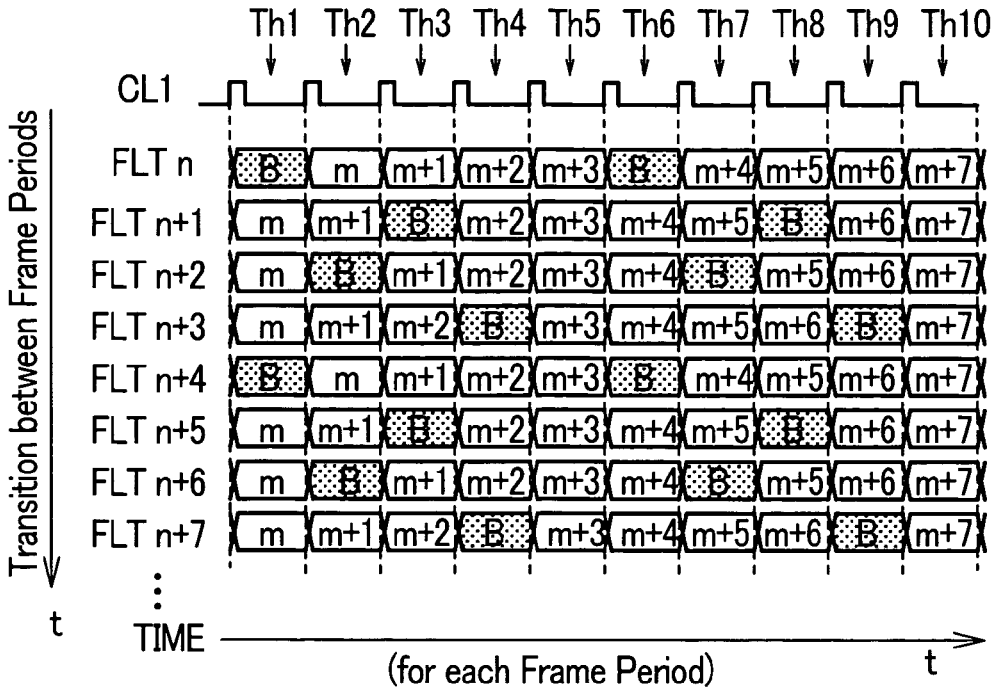
FIG. 10 is a diagram showing the change of display signals (m, m+1, m+2, . . . based on image data and B based on blanking data) supplied to respective pixel rows corresponding to gate lines G1, G2, G3, . . . over a plurality of continuous frame periods n, n+1, n+2, . . . according to one mode of the third embodiment of the driving method of the liquid crystal display device of the present invention.

FIG. 10 is a view which shows the change of display signals (m, m+1, m+2 derived from the image data and B derived from the blanking data) supplied to respective pixel rows corresponding to gate lines G1, G2, G3, according to a third embodiment of the driving method of the display device of the present invention over a plurality of continuous frame periods n, n+1, n+2, . . . . FIG. 10 corresponds to FIG. 8.

In the same manner as the case shown in FIG. 8, with respect to the image data inputted at the timing shown in FIG. 2, the display signals and the scanning signals are outputted from the data driver 102 in waveforms shown in FIG. 1 or FIG. 4 and are displayed in accordance with the display timing shown in FIG. 6. However, in this embodiment, the outputting timing of the blanking signals with respect to outputting of the display signals based on the image data shown in FIG. 1 and FIG. 4 is changed for every frame period.

That is, in the embodiment shown in FIG. 10, in the same manner as the embodiment shown in FIG. 8, the display signals and the scanning signals are outputted from the data driver 102 in waveforms shown in FIG. 1 or FIG. 4 and are displayed in accordance with the display timing shown in FIG. 6. However, in this embodiment, the outputting timing of the blanking signals with respect to outputting of the display signals based on the image data shown in FIG. 1 and FIG. 4 is changed for every frame period.

However, in case of the embodiment shown in FIG. 10, the blanking signals B which are included in the sequentially outputted N-times display signals are, as a matter of course, not juxtaposed in a direction orthogonal to the time axis and have the outputting timing thereof shifted or deviated. Further, the blanking signals B are distributed on a straight line (on the straight line extending from the left upper side to the right lower side in the drawing) such that all of them are not juxtaposed. That is, the blanking signal B of each one of the frames which are sequentially displayed in response to N-times display signals is distributed such that the time-sequential deviation (shift) of the period does not include (N−2) pieces of periods Th1 (Th2, Th3, Th4, . . . ) at maximum with respect to the next blanking signal.

FIG. 10 shows a case in which N is set to N=4. In this case, four blanking signals B in each frame exhibits the generation of one piece of time-sequential deviation or shift of period Th1 (Th2, Th3, Th4, . . . ) with respect to the next blanking signal B.

That is, as shown in FIG. 10, in the periods Th1, Th2, Th3, . . . which correspond to respective pulses of the horizontal clock CL1, the blanking signal of the n-frame is allocated to the period Th1, the blanking signal of the (n+1)-frame is allocated to the period Th3, the blanking signal of the (n+2)-frame is allocated to the period Th2 and, further, the blanking signal of the (n+3)-frame is allocated to the period Th4. Here, after the transition to the (n+4) frame, the above-mentioned relationship is repeated.

From the above, with respect to the blanking signals B of respective frames, the frame which exhibits the time-sequential deviation of the period Th1 (Th2, Th3, Th4, . . . ) with respect to the next blanking signal is only the (n+2) frame.

The reason why this embodiment adopts the above constitution is as follows. For example, when the driving of the display device shown in FIG. 8 is performed, due to the influence of the rounding waveforms, the display data which are outputted next to the blanking signals B of respective frames, that is, the display signals m, m+4, . . . in the n-frame, the display signals m+1, m+5, . . . in the (n+1)-frame, the display signals m+2, m+6, . . . in the (n+2)-frame, the display signals m+3, m+7, . . . in the (n+3) frame are respectively displayed with relatively large brightness and are displayed such that they are arranged linearly on the pixel region. Accordingly, the retracing lines which are relatively bright compared to the other region are displayed (display flow) such that they flow in response to the changeover of respective frames whereby the display flow can be easily observed with the naked eye.

The third embodiment is provided for solving this drawback and is configured such that, as described above, the respective blanking signals B are distributed such that they are not juxtaposed on a straight line which starts from the left upper portion and reaches the right lower portion in FIG. 10. Due to such a constitution, to observe the screen as a whole, the line which receives the influence of rounding of waveforms moves in the downward direction on the screen in the changeover from the n-frame to the (n+1)-frame, moves in the upward direction on the screen in the changeover from the (n+1)-frame to the (n+2)-frame, moves in the downward direction on the screen in the changeover from the (n+2)-frame to the (n+3)-frame, and moves in the upward direction on the screen in the changeover from the (n+3)-frame to the (n+4)-frame, whereby it is possible to make it difficult for a user to observe the display flow with the naked eye.

Figure 11:
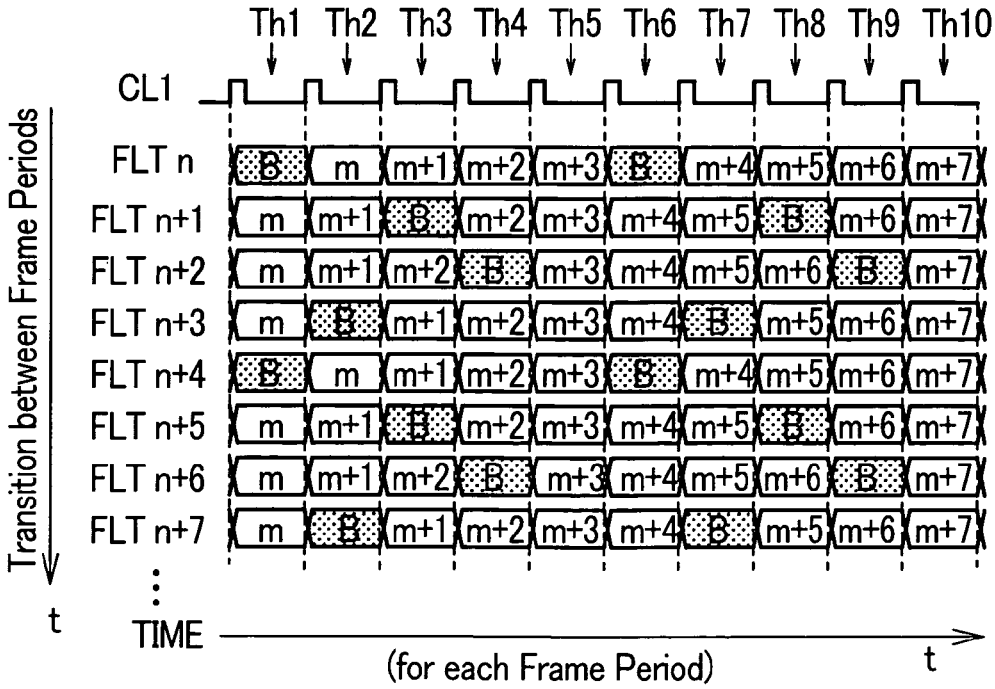
FIG. 11 is a diagram showing the change of display signals (m, m+1, m+2, . . . based on image data and B based on blanking data) supplied to respective pixel rows corresponding to gate lines G1, G2, G3, . . . over a plurality of continuous frame periods n, n+1, n+2, . . . according to another mode of the third embodiment of the driving method of the liquid crystal display device of the present invention.

FIG. 11 is a view which shows another mode based on the above-mentioned same concept and also corresponds to FIG. 8. In the case shown in FIG. 11, with respect to the periods Th1, Th2, Th3, . . . which respectively correspond to the pulses of the horizontal clock CL1, the blanking signal of the n-frame is allocated to the period Th1, the blanking signal of the (n+1)-frame is allocated to the period Th3, the blanking signal of the (n+2)-frame is allocated to the period Th4 and, further, the blanking signal of the (n+3)-frame is allocated to the period Th2. Here, in succeeding frames including the (n+4) frame, the above-mentioned relationship is repeated.

From the above, it is seen that, with respect to the blanking signals B of respective frames, the frame which exhibits the time-sequential deviation of the period Th1 (Th2, Th3, Th4, . . . ) with respect to the next blanking signal is only the (n+2) frame. This mode is substantially equal to the mode shown in FIG. 10.

The third embodiment also can be directly applicable to the other modification shown in the first embodiment. For example, the outputting number: M of display signals in the first step is not limited to 4 and the outputting number: M of blanking signals in the second step is not limited to 1.

Fourth Embodiment

FIG. 12 to FIG. 27 show output waveforms of signals from the display control circuit (timing controller) and respective output waveforms of signals from the scanning driver and the data driver corresponding to these signals which represent as the fourth embodiment of the display device and the driving method thereof according to the present invention, wherein the waveforms are shown in the same manner as those shown in FIG. 4. However, this embodiment shown in FIG. 12 to FIG. 27 differs from the embodiment shown in FIG. 4 in that, as can be clearly understood from the pulses of the scanning start signal FIL, which is depicted at the center of the respective drawings, a boundary between a certain frame period and a frame period next to the certain frame period is arranged at the center in the lateral direction of respective frames.

In the fourth embodiment, at the time of changeover from one frame to the next frame, the number of scanning clocks CL3 which are generated between the blanking signal B which is outputted last in the former frame and the blanking signal B which is outputted first in the next frame is always adjusted to N pieces while preventing the number of scanning clocks CL3 from becoming uncertain or indefinite (becomes 2, 3 or 5).

Figure 28:
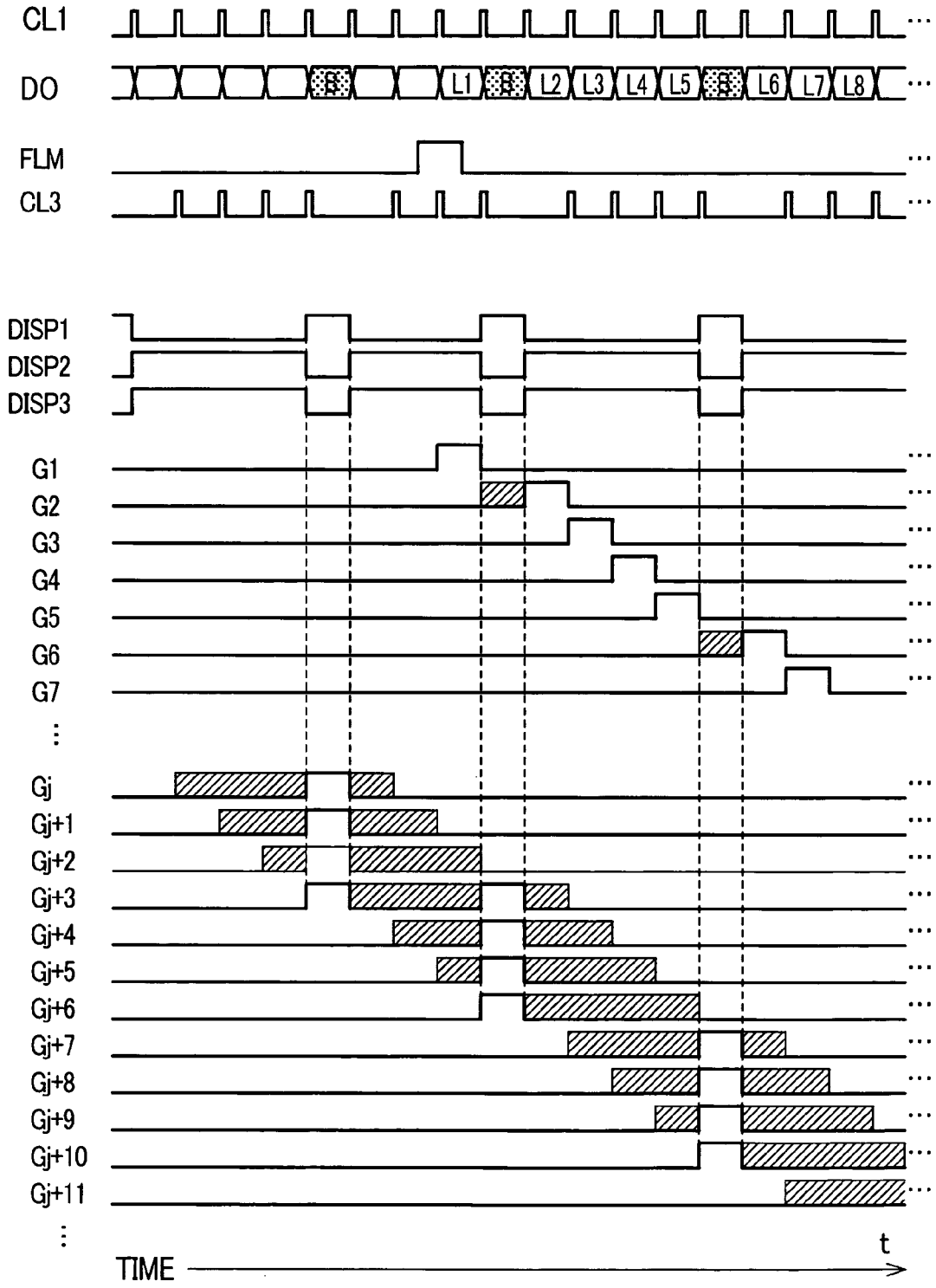
FIG. 28 is a driving waveform diagram showing a drawback that occurs when two blanking signals are generated on the same line by not performing the adjustment of the number of scanning clocks at the time of changing over the frames.

The reason for such an adjustment is as follows. For example, as shown in FIG. 28, there may be a case in which the number of scanning clocks CL3 which are generated between the blanking signal B which is outputted last in the former frame and the blanking signal B which is outputted first in the next frame becomes 3. In this case, there arises a phenomenon that the blanking signal B is written twice in one frame in which the scanning start signal FLM is positioned at the center thereof on the line of the gate lines $G_{j+3}$. In such a case, this line works as a boundary and the ratio between the holding time of the image data and the holding time of the blanking signal B differs between the upper and lower portions of the pixel array and hence, the brightness difference is generated whereby the line portion is displayed darker than other background.

Figure 29:
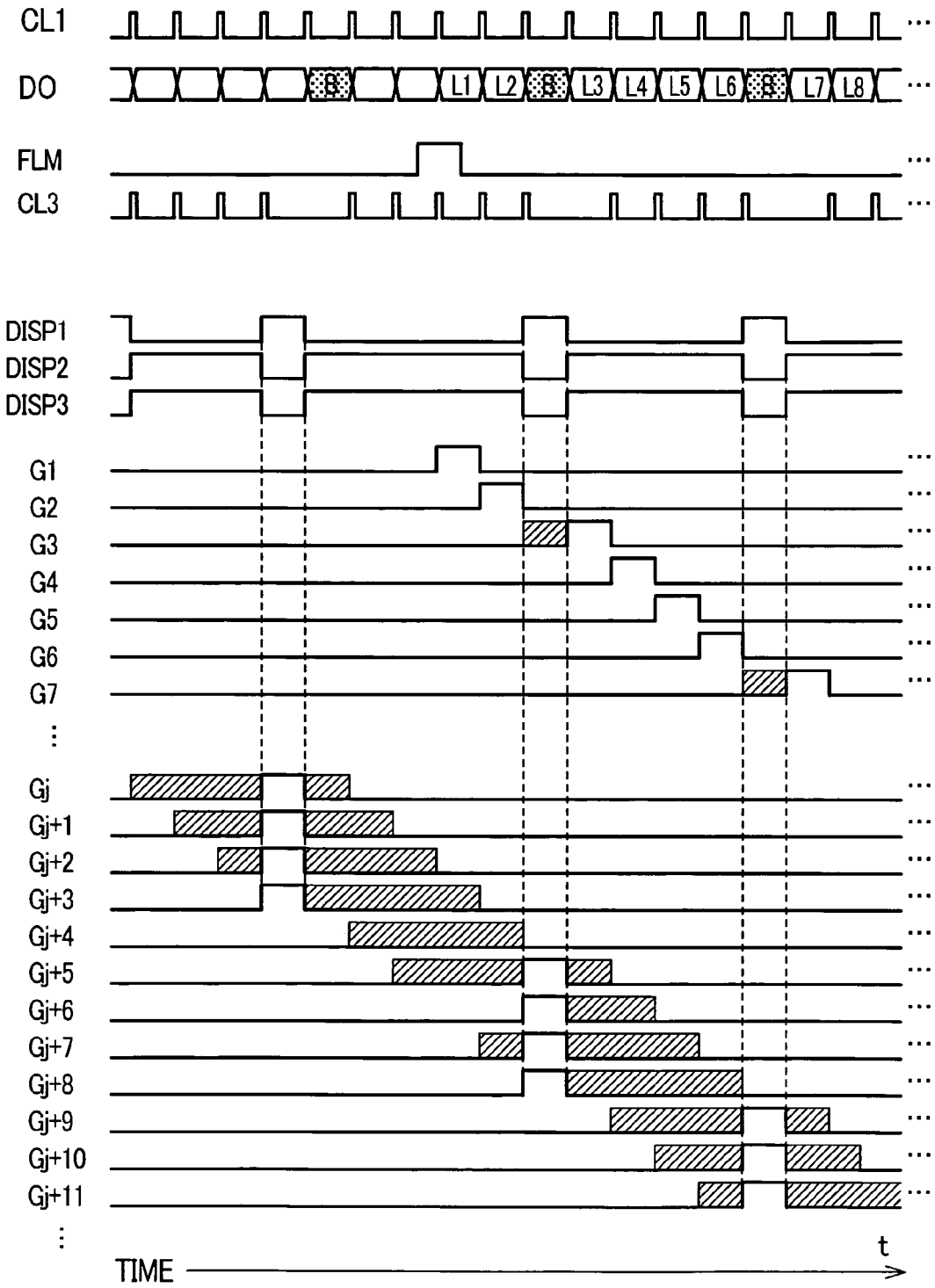
FIG. 29 is a driving waveform diagram showing a drawback that occurs when blanking signals are not generated on a line by not performing an adjustment of the number of scanning clocks at the time of changing over the frames.

Further, as shown in FIG. 29, there may be a case in which the number of scanning clocks CL3 which are generated between the blanking signal B which is outputted last in the former frame and the blanking signal B which is outputted first in the next frame becomes 5. In this case, there arises a phenomenon that the blanking signal B is not written at all in one frame in which the scanning start signal FLM is positioned at the center thereof on the line of the gate lines $G_{j+4}$. In such a case, this line works as a boundary and the ratio between the holding time of the image data and the holding time of the blanking signal B differs between the upper and lower portions of the pixel array and hence, the brightness difference is generated whereby the line portion is displayed brighter than other background.

Accordingly, in this fourth embodiment, as mentioned above, the number of scanning clocks CL3 which are generated between the blanking signal B which is outputted last in the former frame and the blanking signal B which is outputted first in the next frame is always adjusted to N pieces so that the holding time of the image data and the holding time of the blanking signal B are made to agree with each other in accordance with the N frame unit whereby the brightness difference between the upper and lower portions of the pixel array can be eliminated.

Here, since the timing between the input waveform (input data) of the image data to the display control circuit (timing controller) and the output waveform (driver data) from the display control circuit is preliminarily set, the adjustment of the number of the scanning clocks CL3 at the time of changeover of frame can be easily performed using the timing controller (display control circuit) 104, for example.

Hereinafter, a case adopting a method in which the image data for 4 lines and the blanking data for 4 lines are written using the input 4 horizontal periods and the blanking data are distributed using the embodiments shown in FIG. 12 to FIG. 27 will be explained.

Here, in the above-mentioned respective drawings, all of the symbols CL31, CL32, CL33 indicate scanning clocks, wherein the scanning clock CL31 is inputted to the scanning driver 103-1, the scanning clock CL32 is inputted to the scanning driver 103-2 and the scanning clock CL33 is inputted to the scanning driver 103-3.

In this case, although pulses are outputted at the same timing with respect to all of respective scanning clocks CL31, CL32, CL33, one of them serves to display based on the display signals other than the blanking signals B and two remaining scanning clocks serve to display based on the blanking signals B.

Accordingly, with respect to two other remaining scanning clocks, at the time of changeover of frame, the number of scanning clocks which are generated between the blanking signal B which is outputted lastly in the preceding frame and the blanking signal B which is outputted firstly in the next frame can be adjusted.

In such a constitution, first of all, it is judged whether the number of inputting horizontal periods in one frame is a multiple of 4, a multiple of 4+1, a multiple of 4+2 or a multiple of 4+3. Further, the input frames are monitored and the number of inputting horizontal periods is allocated to the first, the second, the third and the fourth frames and this operation is repeated. Based on the above, the case in which the number of inputting horizontal periods is the multiple of 4 is explained hereinafter.

Figure 12:
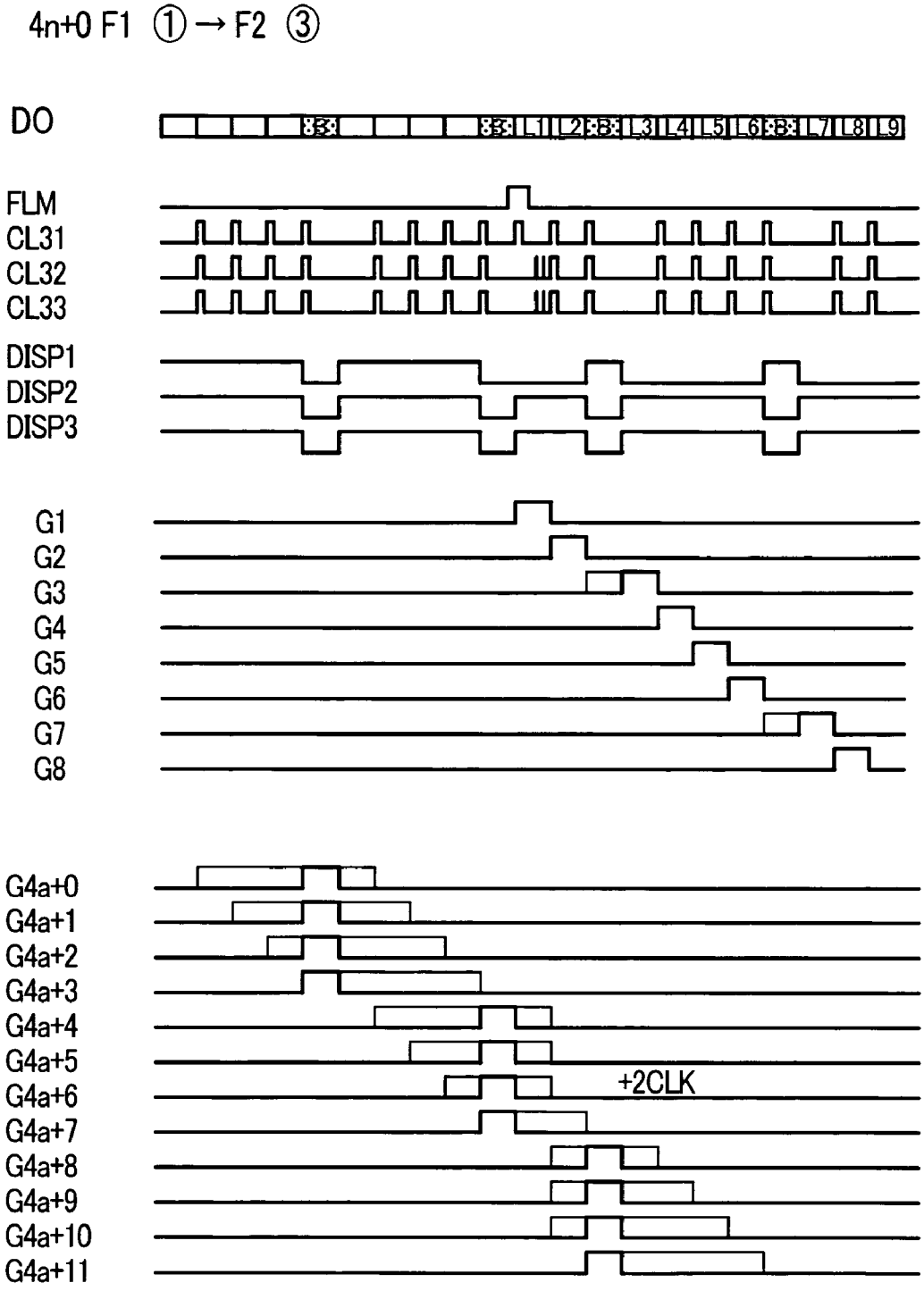
FIG. 12 is a timing diagram showing driving waveforms which simultaneously select 4 scanning lines during an outputting period of display signals according to a fourth embodiment of the driving method of the liquid crystal display device of the present invention, wherein the drawing also shows a changeover portion from the first frame to the second frame, wherein the number of inputting horizontal periods is a multiple of 4.

As shown in FIG. 12, at the time of changeover between the first frame and the second frame, 2 horizontal periods are present between writing of the final blanking signal B to the first frame and writing of the beginning blanking signal B to the second frame. In this manner, during 2 horizontal periods, when the usual scanning clock CL3 is inputted to the scanning driver, the output timing is shifted by only 2 lines and hence, the scanning clock CL3 is short of 2 clocks. Accordingly, the scanning clocks CL3 are added by two clocks which are in short to the beginning one horizontal period of the second frame so as to output 3 pulses.

Figure 13:
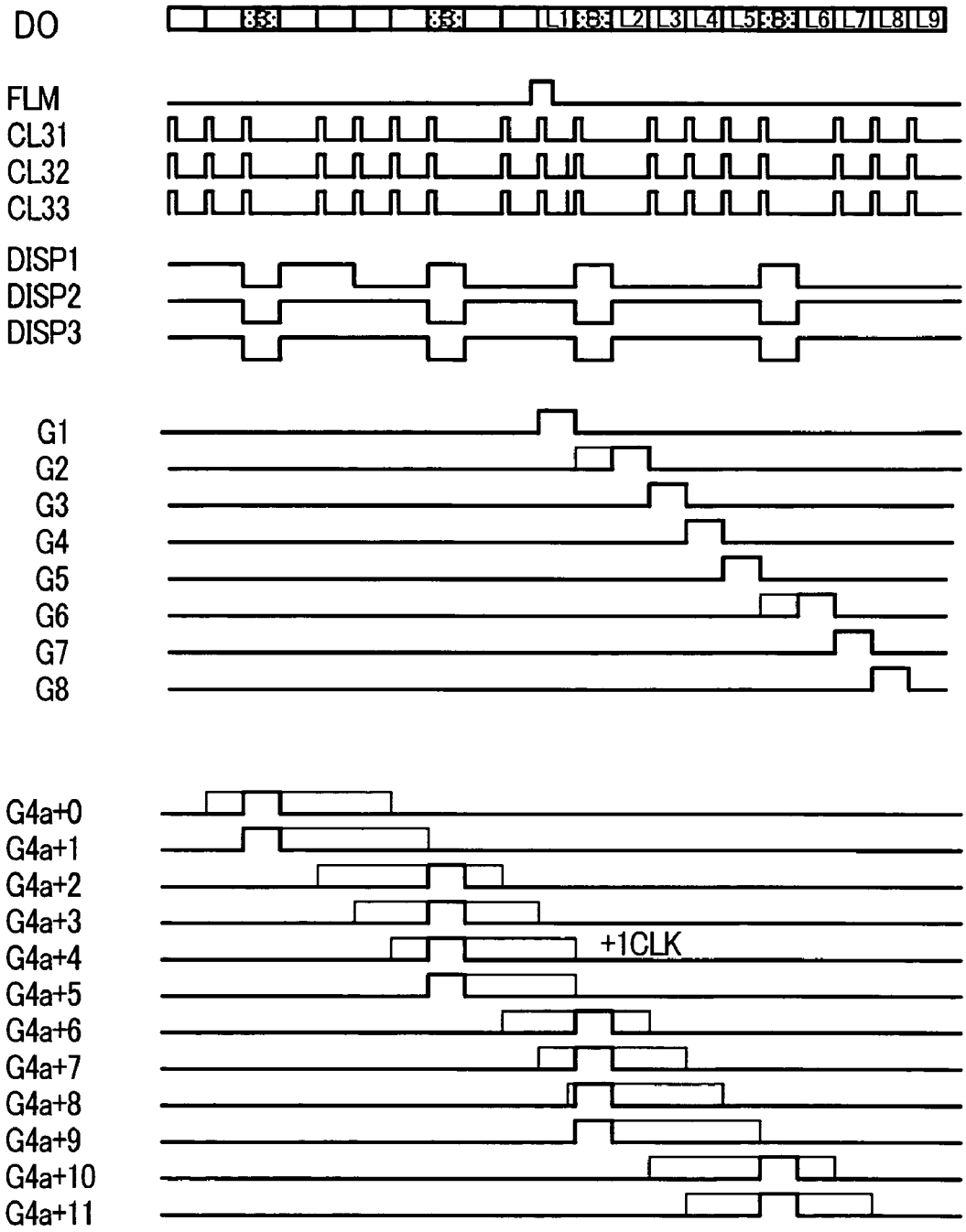
FIG. 13 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the second frame to the third frame, wherein the number of inputting horizontal periods is a multiple of 4.

As shown in FIG. 13, at the time of changeover between the second frame and the third frame, 3 horizontal periods are present between writing of the final blanking signal B to the second frame and writing of the beginning blanking signal B to the third frame. In this manner, during 3 horizontal periods, when the usual scanning clock CL3 is inputted to the scanning driver, the output timing is shifted by only 3 lines and hence, the scanning clock CL3 is short of one clock. Accordingly, the scanning clocks CL3 are added by one clock which is in short to the beginning one horizontal period of the third frame so as to output 2 pulses.

Figure 14:
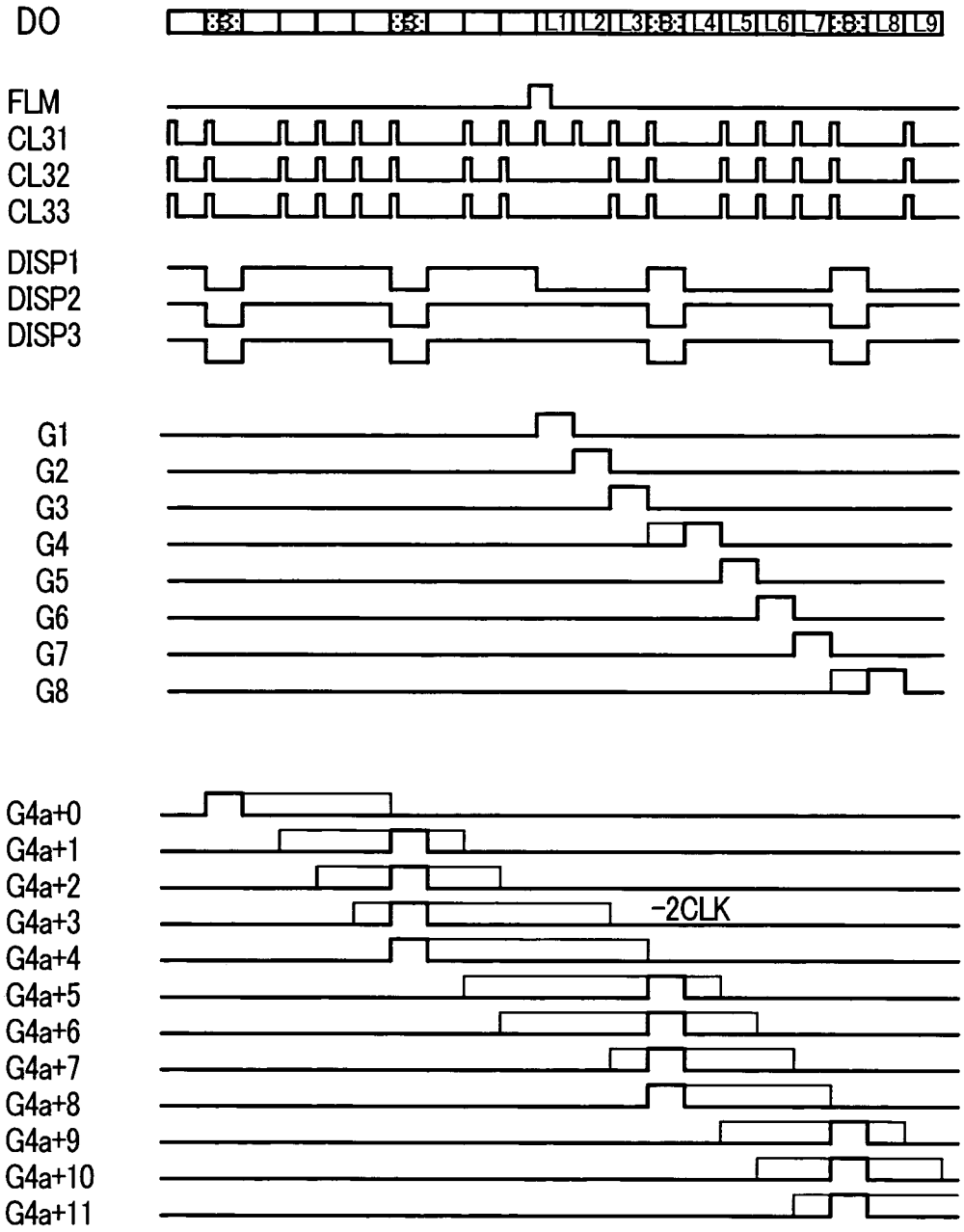
FIG. 14 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the third frame to the fourth frame, wherein the number of inputting horizontal periods is a multiple of 4.

As shown in FIG. 14, at the time of changeover between the third frame and the fourth frame, 6 horizontal periods are present between writing of the final blanking signal B to the third frame and writing of the beginning blanking signal B to the fourth frame. In this manner, during 6 horizontal periods, when the usual scanning clock CL3 is inputted to the scanning driver, the output timing is shifted by 6 lines and hence, two lines in which the blanking signals are not written appears. Accordingly, the scanning clocks CL3 becomes excessive by 2 clocks. Accordingly, the scanning clocks CL3 are stopped from the beginning of the fourth frame by 2 horizontal periods.

Figure 15:
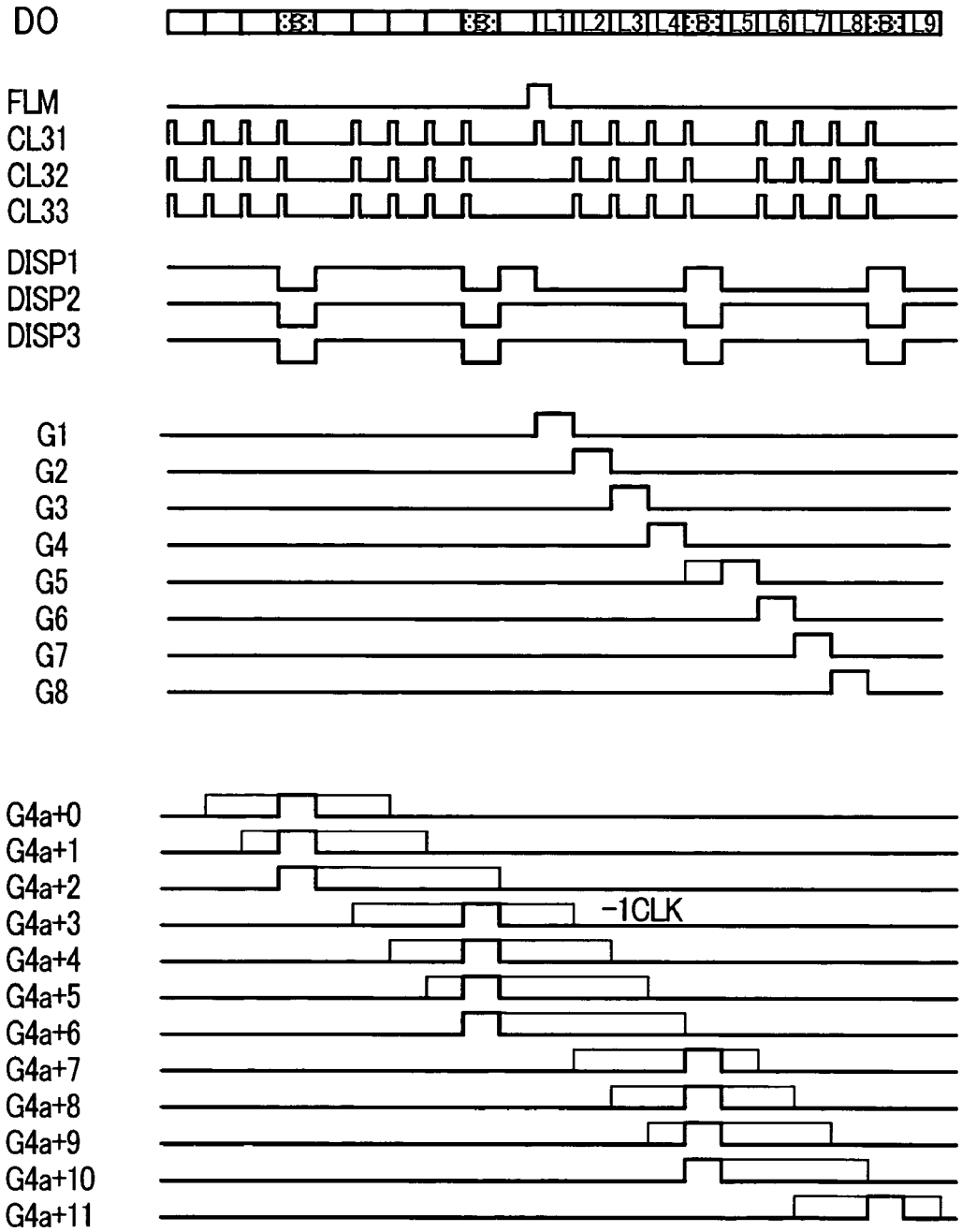
FIG. 15 is a timing diagram showing driving waveforms which simultaneously select 4 scanning lines during an outputting period of display signals to the fourth embodiment of the driving method of the liquid crystal display device of the present invention, wherein the drawing also shows a changeover portion from the fourth frame to the first frame, wherein the number of inputting horizontal periods is a multiple of 4.

As shown in FIG. 15, at the time of changeover between the fourth frame and the first frame, 5 horizontal periods are present between writing of the final blanking signal B to the fourth frame and writing of the beginning blanking signal B to the first frame. In this manner, during 5 horizontal periods, when the usual scanning clock CL3 is inputted to the scanning driver, the output timing is shifted by 5 lines and hence, 1 line in which the blanking signals B are not written appears. Accordingly, the scanning clocks CL3 becomes excessive by one clock. Accordingly, the scanning clocks CL3 are stopped at the beginning horizontal period of the first frame.

Accordingly, writing of the blanking signal B is performed with respect to all lines by 1 time/1 frame so that the favorable display quality can be obtained. To consider four frames in total as a result of adjustment, the scanning clocks CL3 are added by 3 clocks and are stopped by three clocks and hence, the numbers of adjustments agree with each other. Accordingly, the ratio between the image data holding time and blanking signal B holding time agree to each other throughout 4 frames inclusive and hence, the brightness difference between upper and lower portions of the pixel array is eliminated whereby the image quality can be enhanced.

Further, under the premise of the above-mentioned conditions, a case in which the number of inputting horizontal periods is a multiple of 4+1 will be explained. In this case, writing of the blanking signal B is performed by making use of the retracing period for input 4 lines. That is, the output 5 line periods are generated based on the input 4 line periods. Here, the fractions are present when the number of inputting horizontal periods in one frame is a multiple of 4+1. To obviate this situation, 4 frames are set as one unit and the fractions obtained from 4 frames are combined to further generate the output one line period.

Figure 16:
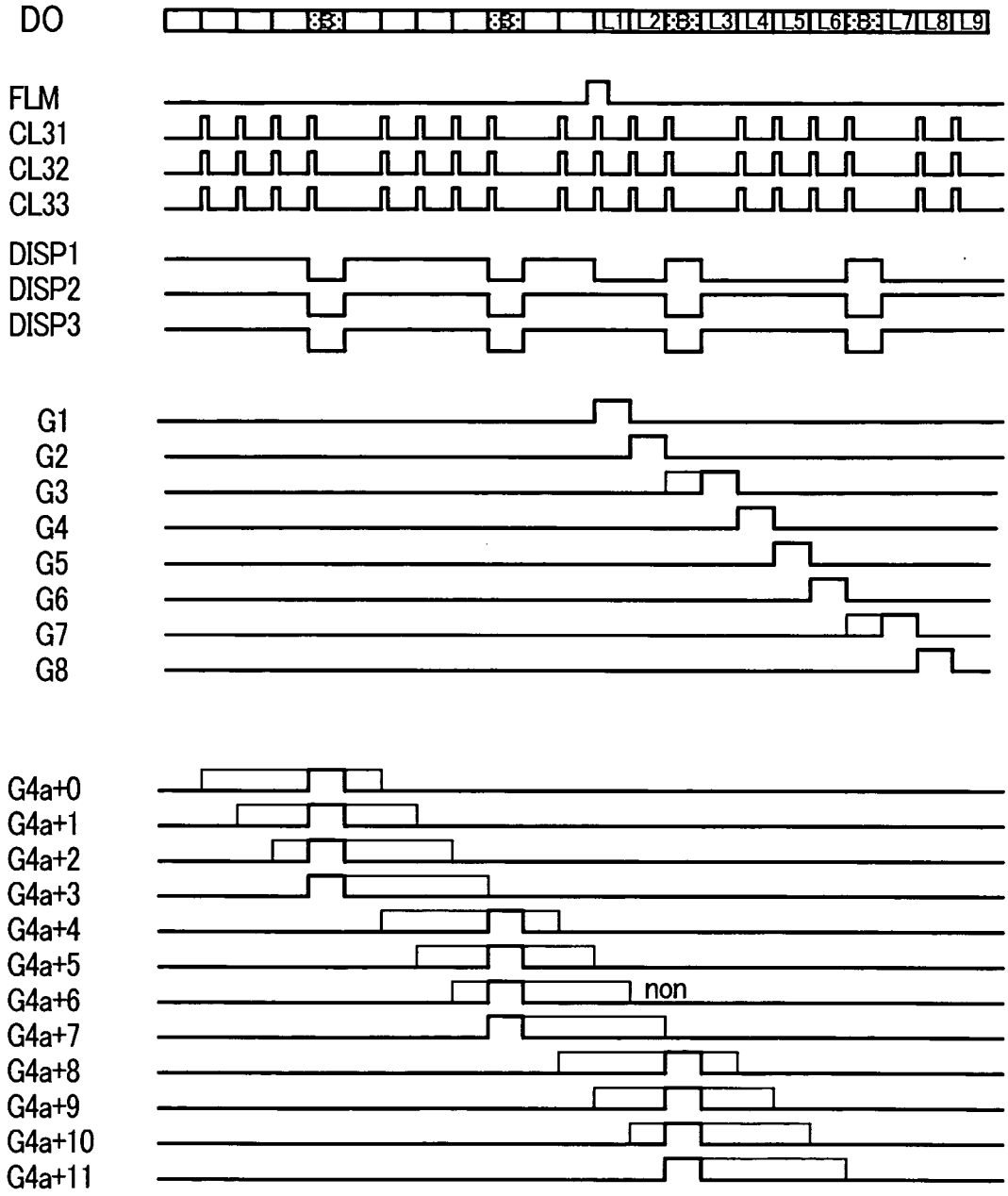
FIG. 16 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the first frame to the second frame, wherein the number of inputting horizontal periods is a multiple of 4+1.

As shown in FIG. 16, at the changeover of the first frame and the second frame, 4 horizontal periods are present between writing of the final blanking signal B in the first frame and writing of the beginning blanking signal B in the second frame. Accordingly, the adjustment of the number of pulses of the scanning clock CL3 is not performed.

Figure 17:
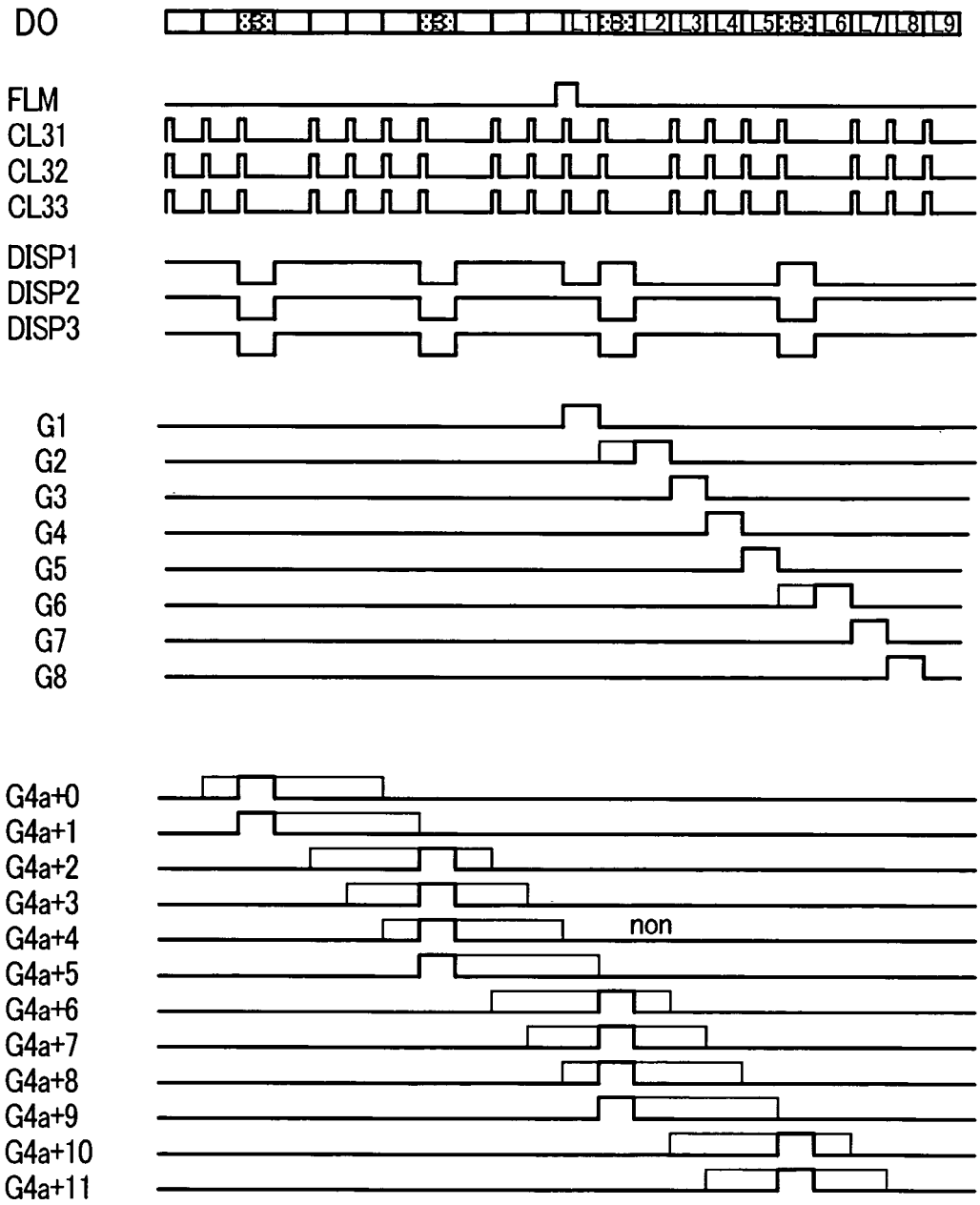
FIG. 17 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the second frame to the third frame, wherein the number of inputting horizontal periods is a multiple of 4+1.

Subsequently, as shown in FIG. 17, at the changeover of the second frame and the third frame, 4 horizontal periods are present between writing of the final blanking signal B in the second frame and writing of the beginning blanking signal B in the third frame. Accordingly, the adjustment of the number of pulses of the scanning clock CL3 is not performed.

Figure 18:
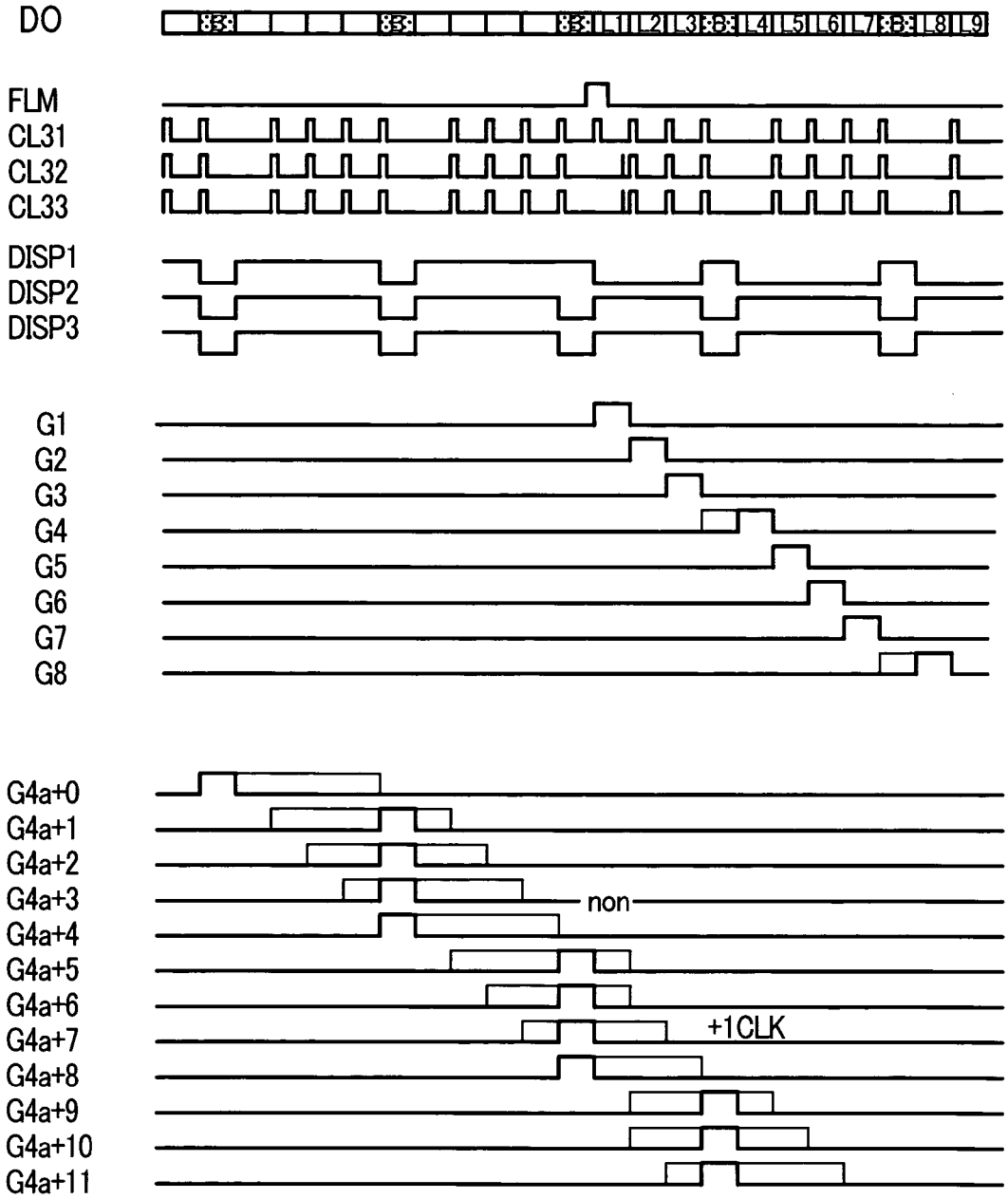
FIG. 18 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the third frame to the fourth frame wherein the number of inputting horizontal periods is a multiple of 4+1.

Then, as shown in FIG. 18, at the changeover of the third frame and the fourth frame, 3 horizontal periods are present between writing of the final blanking signal B in the third frame and writing of the beginning blanking signal B in the fourth frame. In this manner, with respect to 3 horizontal periods, when the usual scanning clock CL3 is inputted to the scanning driver, the output timing is shifted only by 3 lines and hence, one line in which the blanking signal is written twice appears. Accordingly, the scanning clock CL3 is short of one clock. Accordingly, the scanning clock CL3 is added in the beginning one horizontal period of the third frame by a shortage amount of one clock so as to output two pulses.

Figure 19:
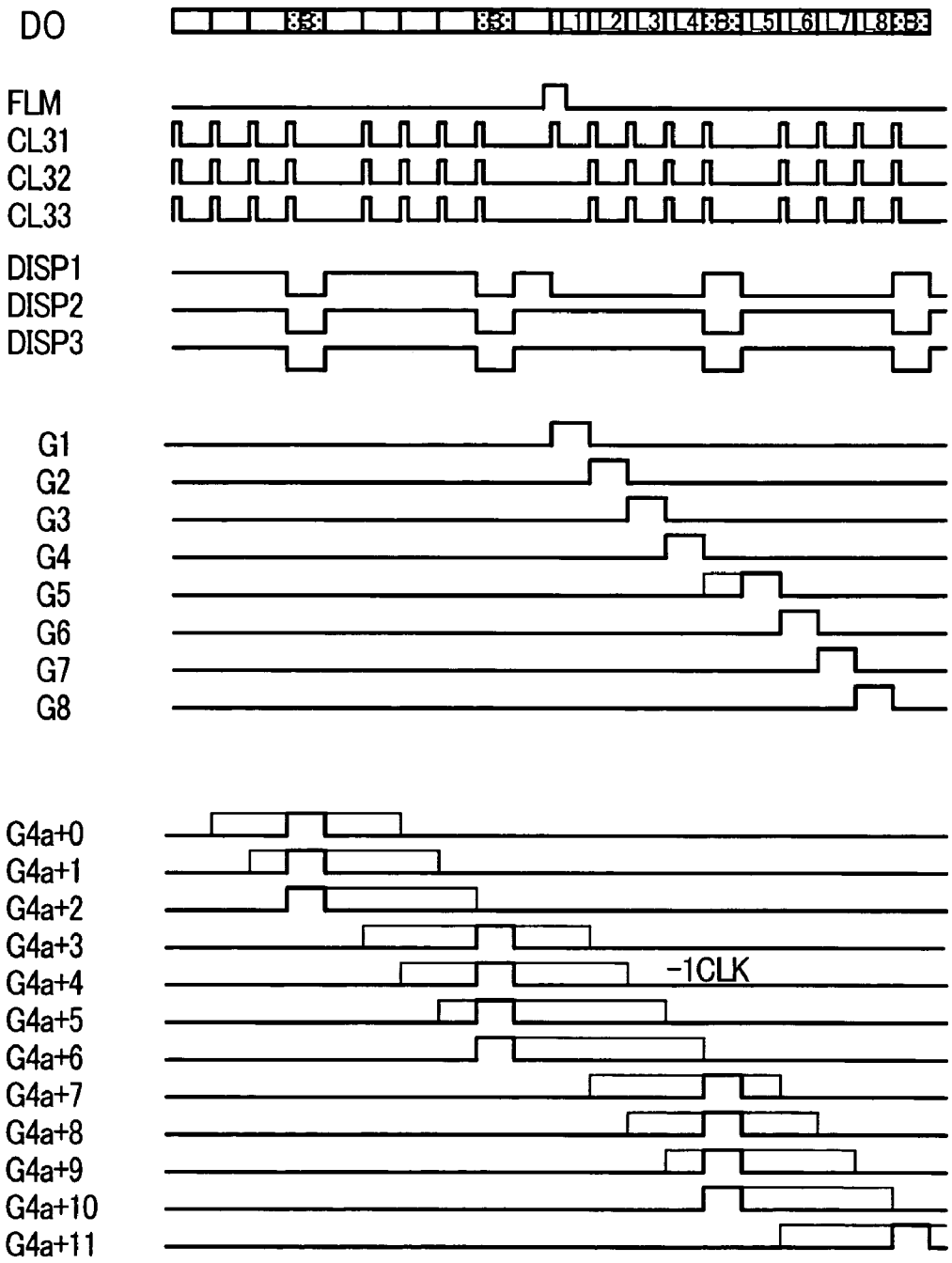
FIG. 19 is a timing diagram showing driving waveforms which simultaneously select 4 scanning lines during an outputting period of display signals explained according to the fourth embodiment of the driving method of the liquid crystal display device of the present invention, wherein the drawing also shows a changeover portion from the fourth frame to the first frame, wherein the number of inputting horizontal periods is a multiple of 4+1.

Then, as shown in FIG. 19, at the changeover of the fourth frame and the first frame, 5 horizontal periods are present between writing of the final blanking signal B in the fourth frame and writing of the beginning blanking signal B in the first frame. In this manner, with respect to 5 horizontal periods, when the usual scanning clock CL3 is inputted to the scanning driver, the output timing is shifted by 5 lines and hence, one line in which the blanking signal B is not written appears. Accordingly, the scanning clock CL3 includes one clock excessively. Accordingly, the scanning clock CL3 is stopped in the beginning of the horizontal period of the first frame.

Accordingly, writing of the blanking signal B is performed with respect to all lines by 1 time/1 frame so that the favorable display quality can be obtained. Further, to consider four frames in total as a result of adjustment, the scanning clock CL3 is added by 1 clock and is stopped by 1 clock and hence, the numbers of adjustments agree to each other. Accordingly, the ratio between the image data holding time and blanking signal B holding time agree to each other throughout 4 frames inclusive over the whole pixel array and hence, the brightness difference between upper and lower portions of the pixel array is eliminated whereby the image quality can be enhanced.

Further, under the premise of the above-mentioned conditions, a case in which the number of inputting horizontal periods is a multiple of 4+2 will be explained. In this case, writing of the blanking signal B is performed by making use of the retracing period for input 4 lines. That is, the output 5 line periods are generated based on the input 4 line periods. Here, the fractions are present when the number of inputting horizontal periods in one frame is a multiple of 4+2. To obviate this situation, the four frames are set as one unit and the fractions obtained from four frames are combined to further generate the output 2 line periods.

Figure 20:
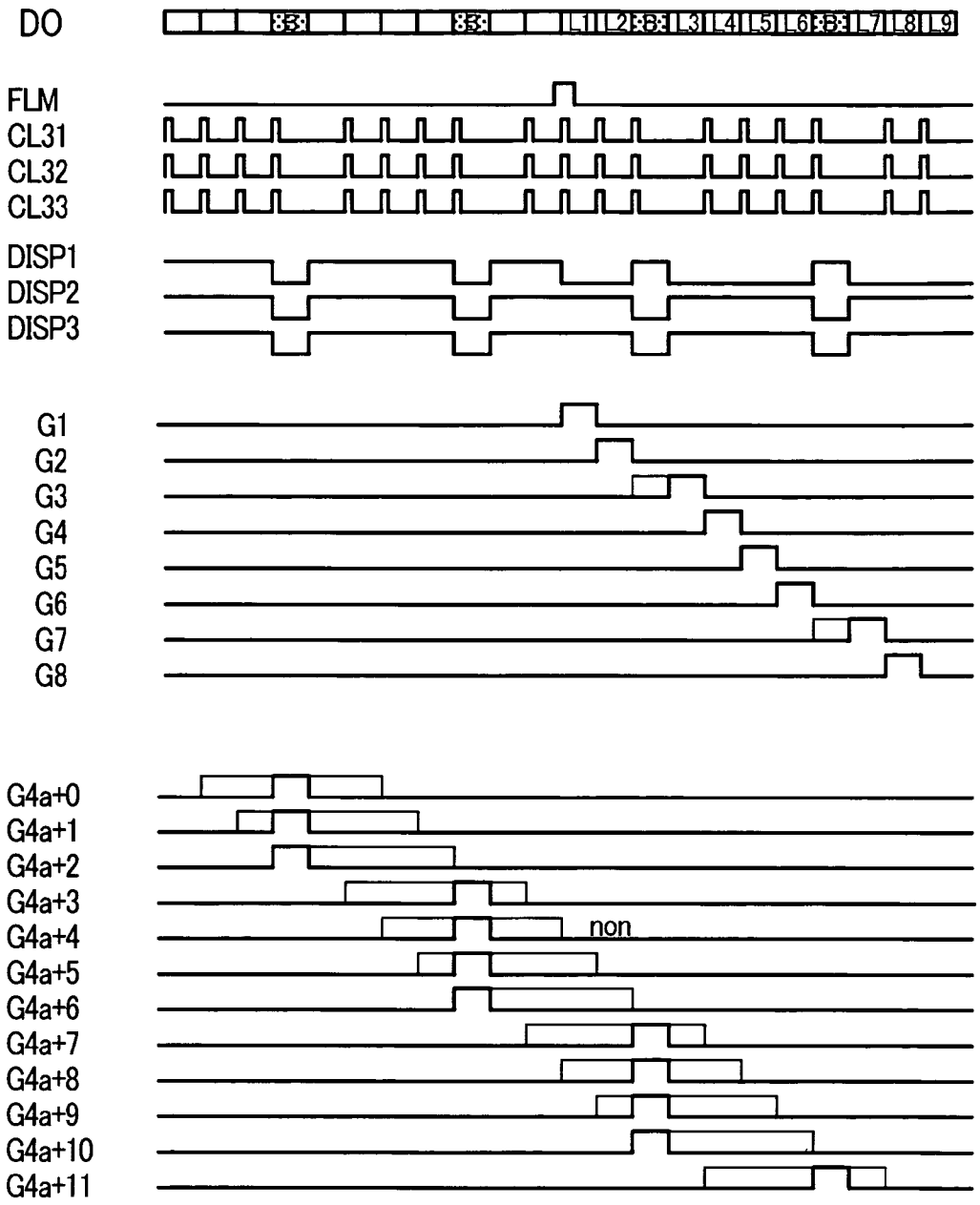
FIG. 20 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the first frame to the second frame, wherein the number of inputting horizontal periods is a multiple of 4+2.

As shown in FIG. 20, at the changeover of the first frame and the second frame, 4 horizontal periods are present between writing of the final blanking signal B in the first frame and writing of the beginning blanking signal B in the second frame. Accordingly, the adjustment of the number of pulses of the scanning clock CL3 is not performed.

Figure 21:
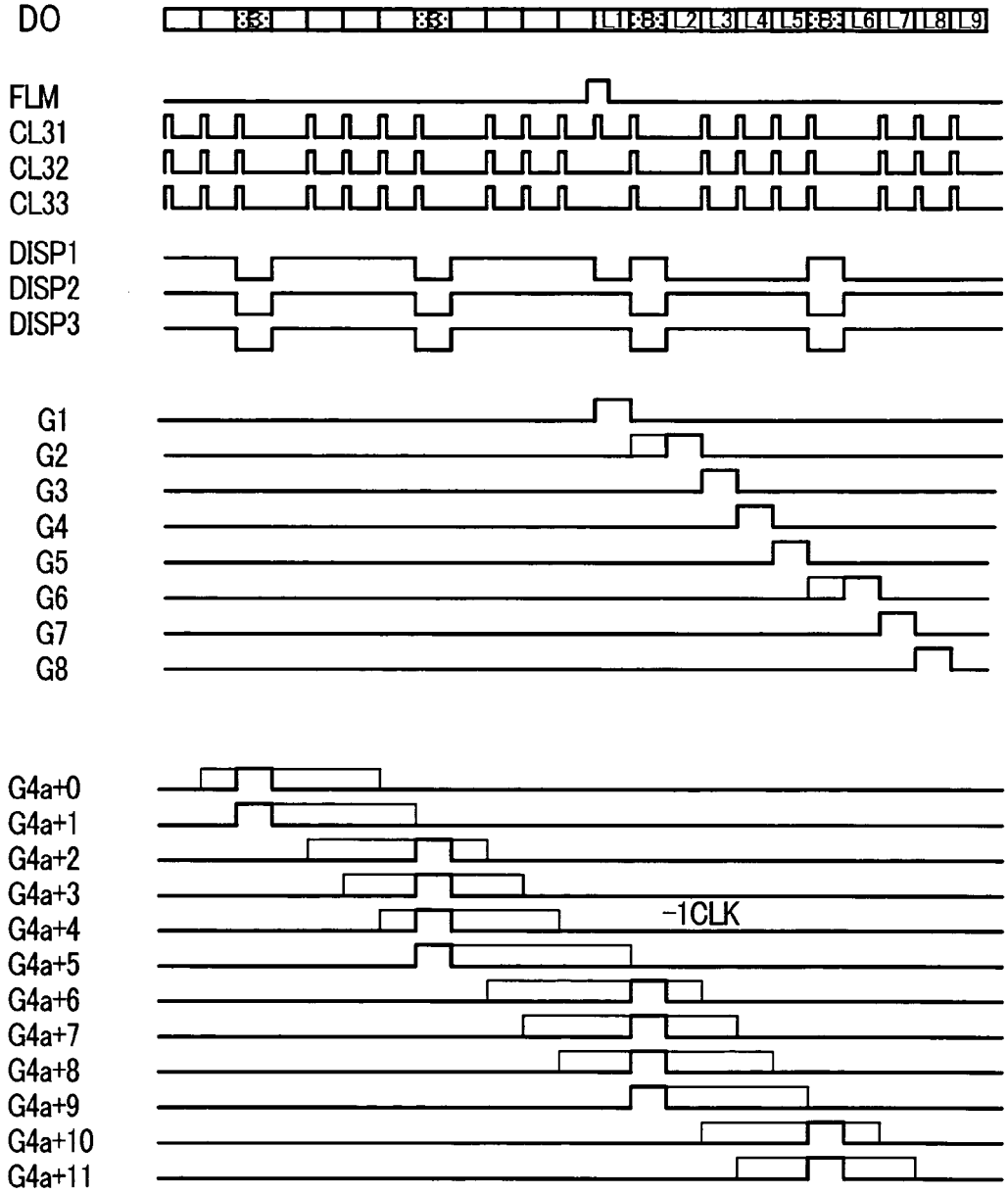
FIG. 21 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the second frame to the third frame, wherein the number of inputting horizontal periods is a multiple of 4+2.

Subsequently, as shown in FIG. 21, at the changeover of the second frame and the third frame, 5 horizontal periods are present between writing of the final blanking signal B in the second frame and writing of the beginning blanking signal B in the third frame. Accordingly, the adjustment of the number of pulses of the scanning clock CL3 is not performed. In this manner, with respect to 5 horizontal periods, when the usual scanning clock CL3 is inputted to the scanning driver, the output timing is shifted by 5 lines and hence, one line in which the blanking data is not written appears. Accordingly, the scanning clock CL3 includes 1 clock excessively. Accordingly, the scanning clock CL3 is stopped in the leading horizontal period the third frame.

Figure 22:
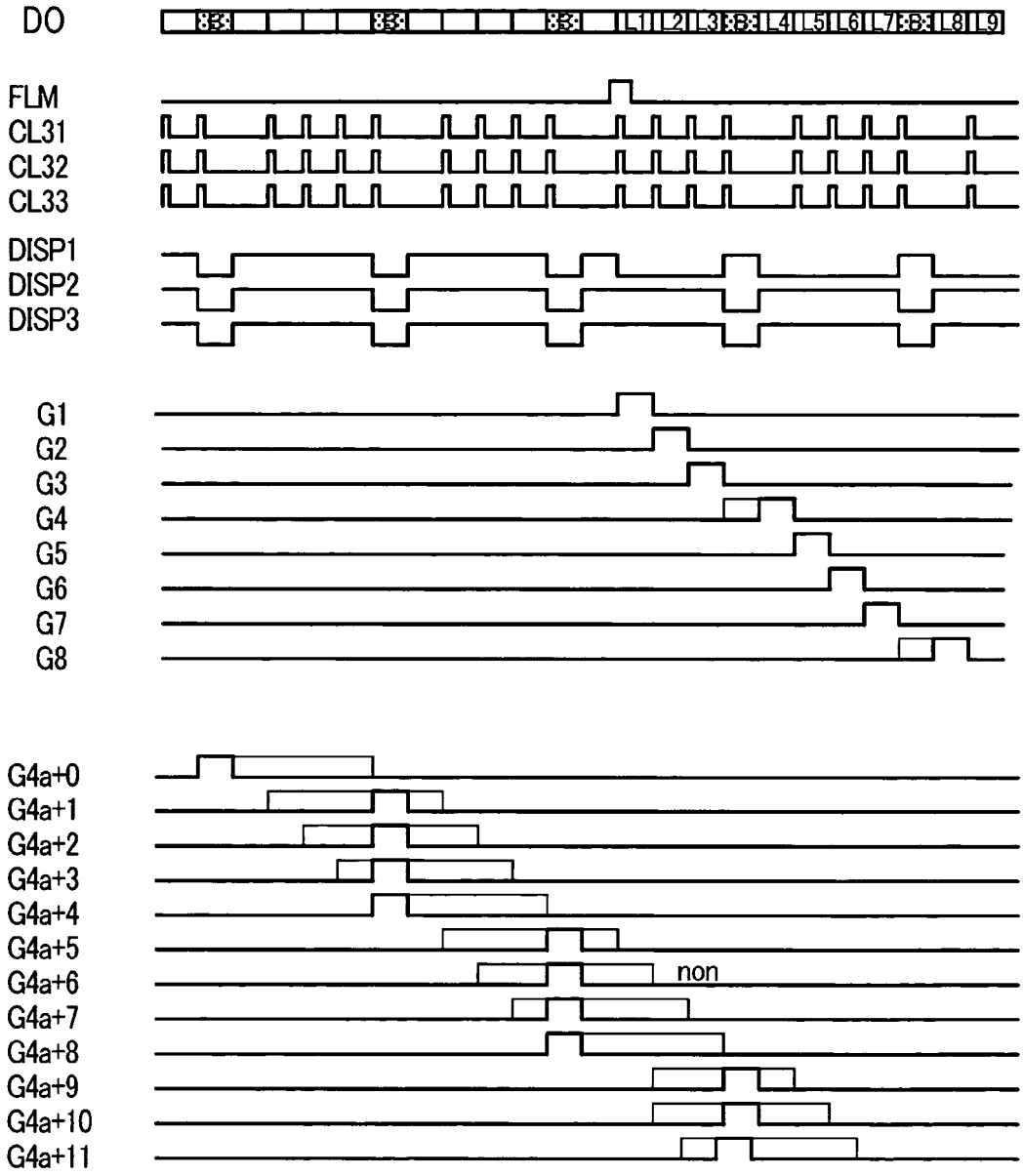
FIG. 22 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the third frame to the fourth frame, wherein the number of inputting horizontal periods is a multiple of 4+2.

Then, as shown in FIG. 22, at the changeover of the third frame and the fourth frame, 4 horizontal periods are present between writing of the final blanking signal B in the third frame and writing of the beginning blanking signal B in the fourth frame. Accordingly, the adjustment of the number of pulses of the scanning clock CL3 is not performed.

Figure 23:
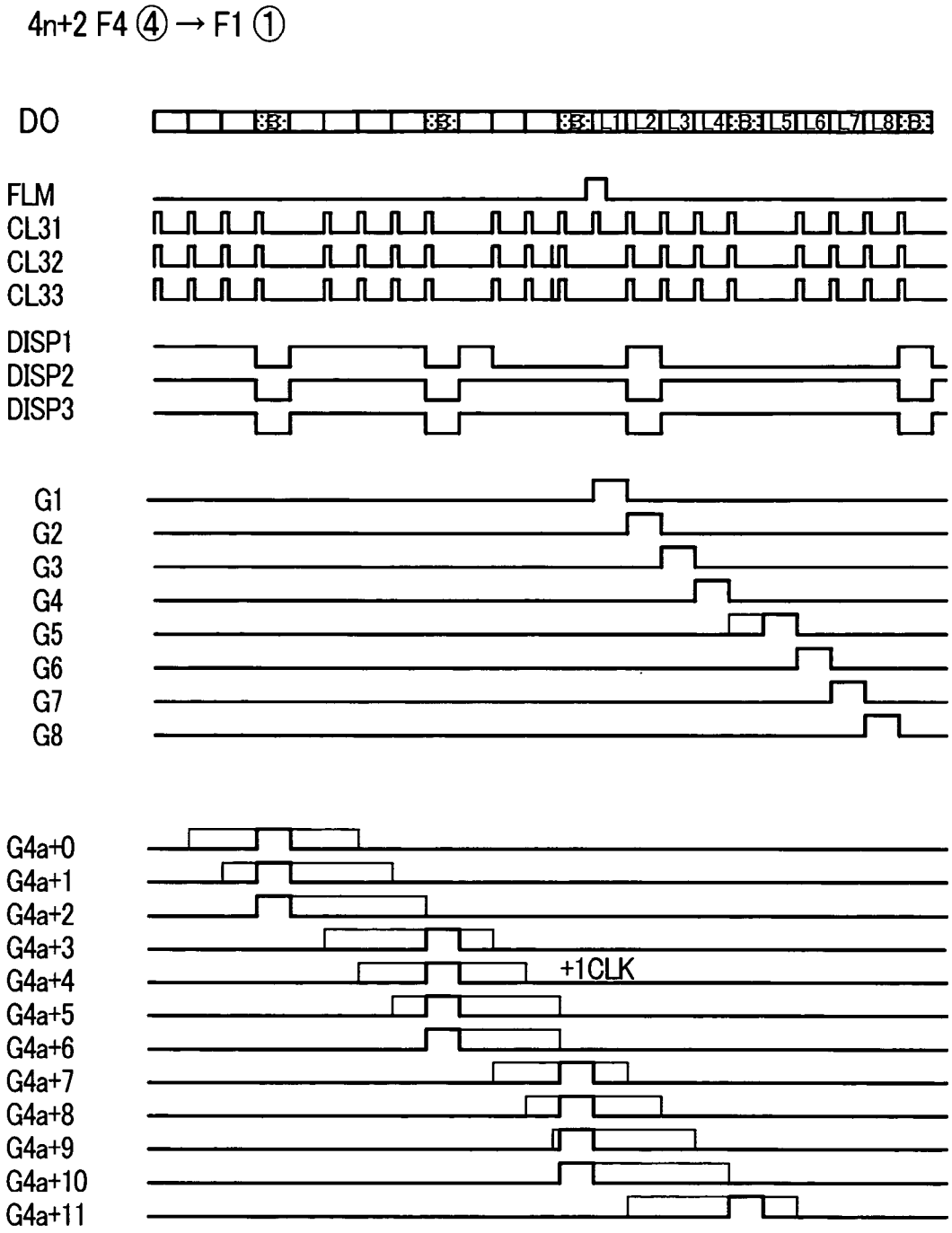
FIG. 23 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the fourth frame to the first frame, wherein the number of inputting horizontal periods is a multiple of 4+2.

Then, as shown in FIG. 23, at the changeover of the fourth frame and the first frame, 3 horizontal periods are present between writing of the final blanking signal B in the fourth frame and writing of the beginning blanking signal B in the first frame. In this manner, with respect to 3 horizontal periods, when the usual scanning clock CL3 is inputted to the scanning driver, the output timing is shifted only by 3 lines and hence, one line in which the blanking signal B is written twice appears. Accordingly, the scanning clock CL3 is short of one clock. Accordingly, the scanning clock CL3 is added in the beginning one horizontal period of one frame by a shortage amount of one clock so as to output two pulses.

Accordingly, writing of the blanking signal B is performed with respect to all lines by 1 time/1 frame so that the favorable display quality can be obtained. Further, to consider four frames in total as a result of adjustment, the scanning clock CL3 is added by one clock and is stopped by one clock and hence, the numbers of adjustments agree to each other. Accordingly, the ratio between the image data holding time and blanking signal B holding time agree to each other throughout 4 frames inclusive over the whole pixel array and hence, the brightness difference between upper and lower portions of the pixel array is eliminated whereby the image quality can be enhanced.

Further, under the premise of the above-mentioned conditions, a case in which the number of inputting horizontal periods is a multiple of 4+3 is explained.

In this case, writing of the blanking signal B is performed by making use of the retracing period for input 4 lines. That is, the output 5 line periods are generated based on the input 4 line periods. Here, the fractions are present when the number of inputting horizontal periods in one frame is a multiple of 4+3. To obviate this situation, the four frames are set as one unit and the fractions obtained from four frames are combined to further generate the output 2 line periods.

Figure 24:
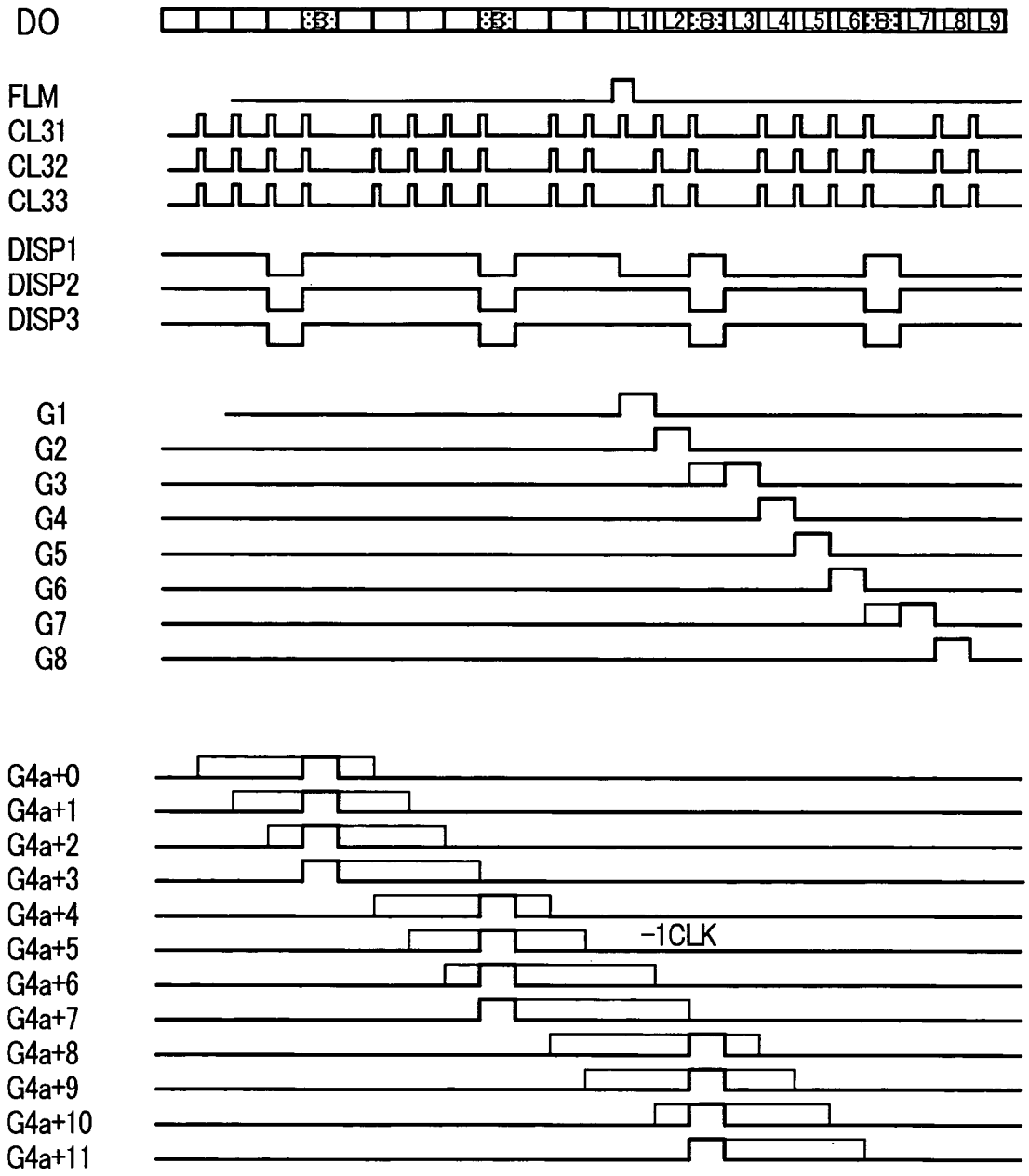
FIG. 24 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the first frame to the second frame, wherein the number of inputting horizontal periods is a multiple of 4+3.

As shown in FIG. 24, at the changeover of the first frame and the second frame, 5 horizontal periods are present between writing of the final blanking signal B in the first frame and writing of the beginning blanking signal B in the second frame. In this manner, with respect to 5 horizontal periods, when the usual scanning clock CL3 is inputted to the scanning driver, the output timing is shifted by 5 lines and hence, one line in which the blanking signal B is not written appears. Accordingly, the scanning clock CL3 includes one clock excessively. Accordingly, the scanning clock CL3 is stopped in the heading horizontal period of the second frame.

Figure 25:
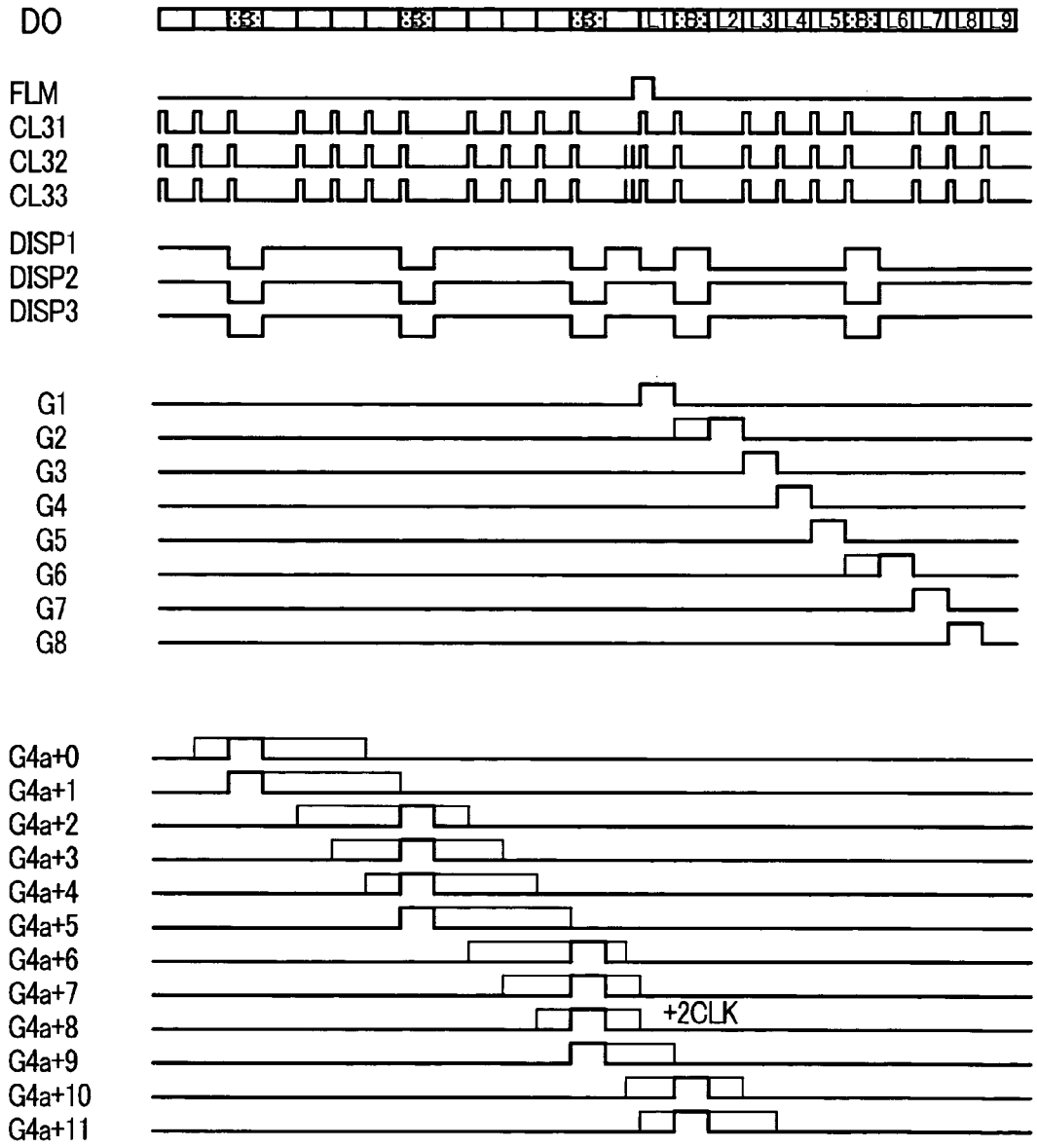
FIG. 25 is a timing showing driving waveforms which simultaneously select 4 scanning lines during an outputting period of display signals according to the fourth embodiment of the driving method of the liquid crystal display device of the present invention, wherein the drawing also shows a changeover portion from the second frame to the third frame, wherein the number of inputting horizontal periods is a multiple of 4+3.

Subsequently, as shown in FIG. 25, at the changeover of the second frame and the third frame, 2 horizontal periods are present between writing of the final blanking signal B in the second frame and writing of the beginning blanking signal B in the third frame. In this manner, with respect to 2 horizontal periods, when the usual scanning clock CL3 is inputted to the scanning driver, the output timing is shifted only by 2 lines and hence, two lines in which the blanking signal B is written twice appear. Accordingly, the scanning clock CL3 is short of 2 clocks. Accordingly, the scanning clock CL3 is added in the beginning one horizontal period of the third frame by a shortage amount of 2 clocks so as to output three pulses.

Figure 26:
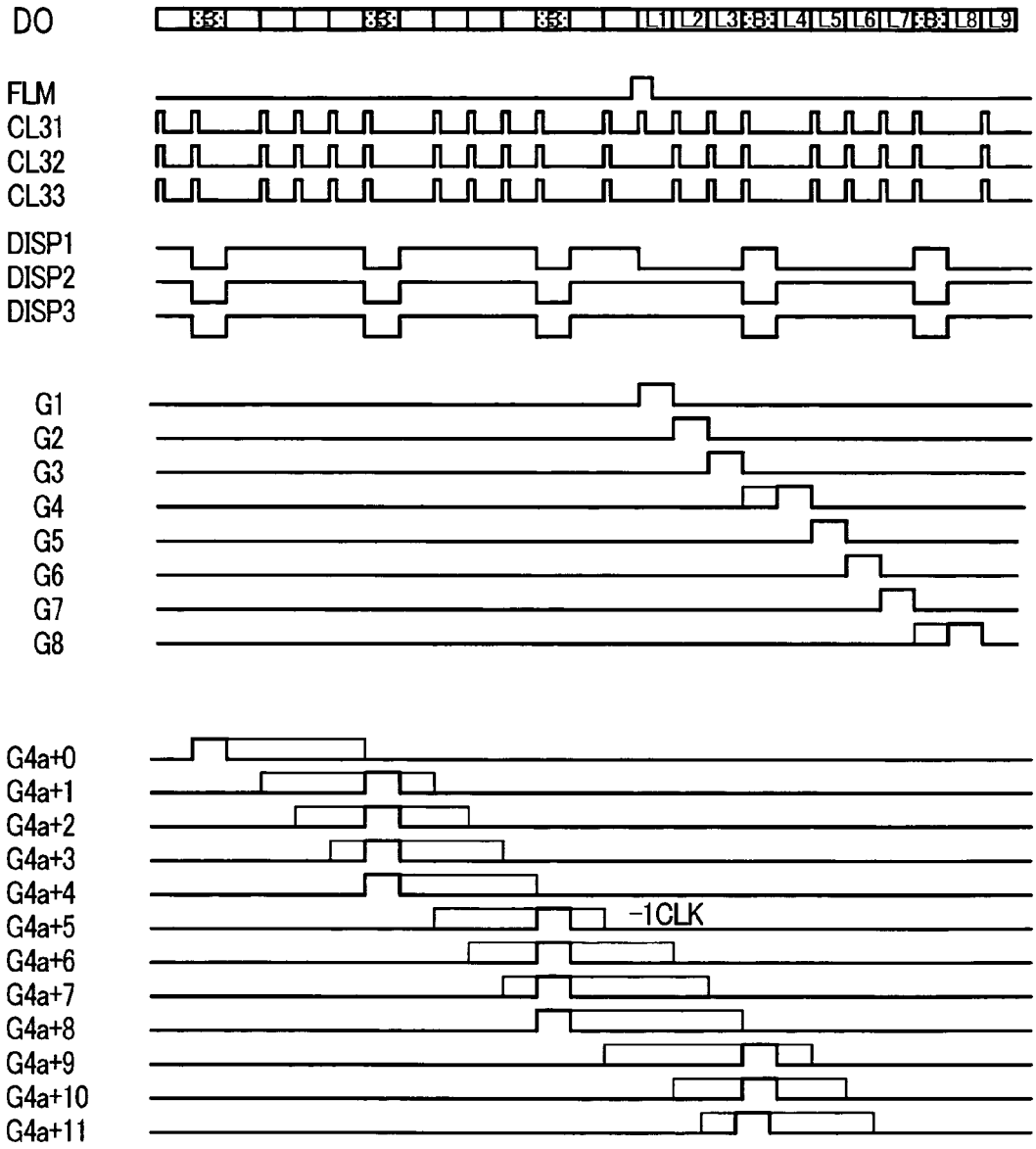
FIG. 26 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the third frame to the fourth frame, wherein the number of inputting horizontal periods is a multiple of 4+3.

Then, as shown in FIG. 26, at the changeover of the third frame and the fourth frame, 5 horizontal periods are present between writing of the final blanking signal B in the third frame and writing of the beginning blanking signal B in the fourth frame. In this manner, with respect to 5 horizontal periods, when the usual scanning clock CL3 is inputted to the scanning driver, the output timing is shifted by 5 lines and hence, one line in which the blanking signal B is not written appears. Accordingly, the scanning clock CL3 includes one clock excessively. Accordingly, the scanning clock CL3 is stopped in the beginning horizontal period of the second frame.

Figure 27:
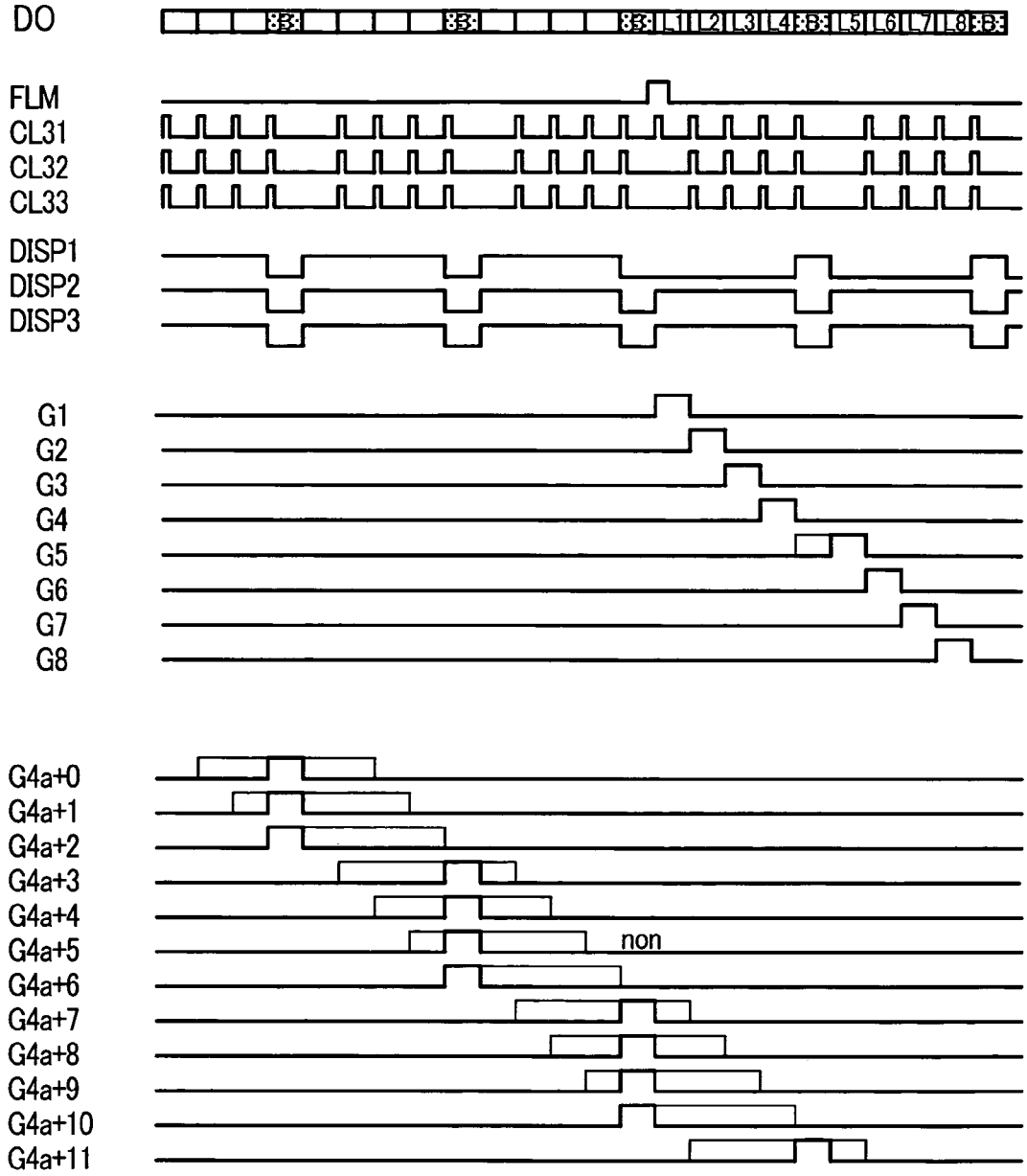
FIG. 27 is a timing diagram showing driving waveforms which simultaneously select 4 scanning lines during an outputting period of display signals according to the fourth embodiment of the driving method of the liquid crystal display device of the present invention, wherein the drawing also shows a changeover portion from the fourth frame to the first frame, wherein the number of inputting horizontal periods is a multiple of 4+3.

Then, as shown in FIG. 27, at the changeover of the fourth frame and the first frame, 4 horizontal periods are present between writing of the final blanking signal B in the fourth frame and writing of the beginning blanking signal B in the first frame. Accordingly, the adjustment of the number of pulses of the scanning clock CL3 is not performed.

Accordingly, writing of the blanking signal B is performed with respect to all lines by 1 time/1 frame so that the favorable display quality can be obtained. Further, to consider four frames in total as a result of adjustment, the scanning clock CL3 is added by 2 clocks and is stopped by 2 clocks and hence, the numbers of adjustments agree to each other. Accordingly, the ratio between the image data holding time and the blanking data B holding time agrees to each other throughout 4 frames inclusive over the whole pixel array and hence, the brightness difference between upper and lower portions of the pixel array is eliminated whereby the image quality can be enhanced.

The fourth embodiment can be also directly applicable to the modification shown in the first embodiment. For example, the outputting number: M of display signals in the first step is not limited to 4 and the outputting number: M of blanking signals in the second step is not limited to 1.

Fifth Embodiment

Figure 30:
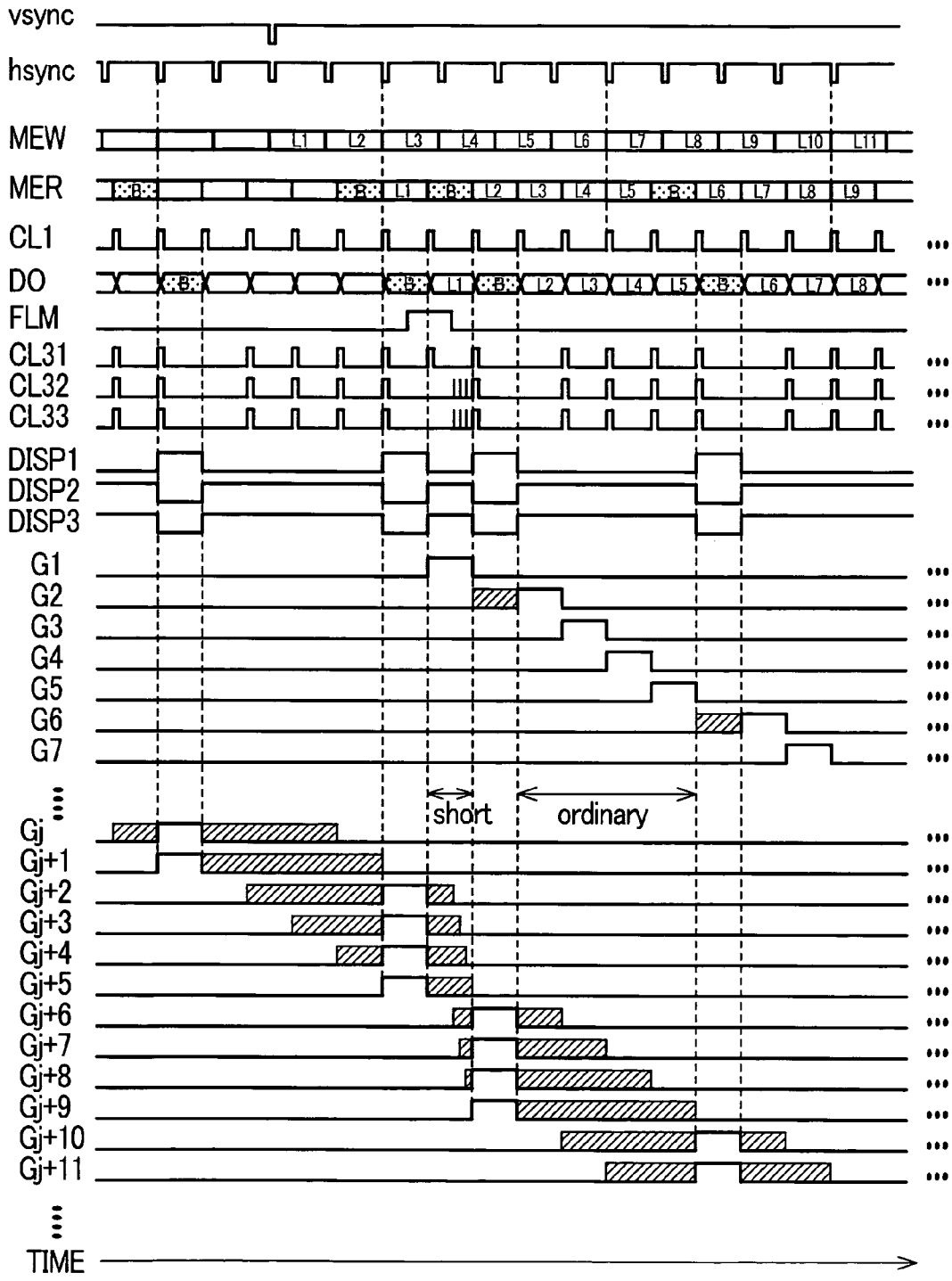
FIG. 30 is a timing diagram showing driving waveforms which simultaneously select 4 scanning lines during an outputting period of display signals according to the fifth embodiment of the driving method of the liquid crystal display device of the present invention, wherein the drawing also shows a changeover portion in a frame n+2 in FIG. 34, wherein the number of inputting horizontal periods is a multiple of 4.
Figure 31:
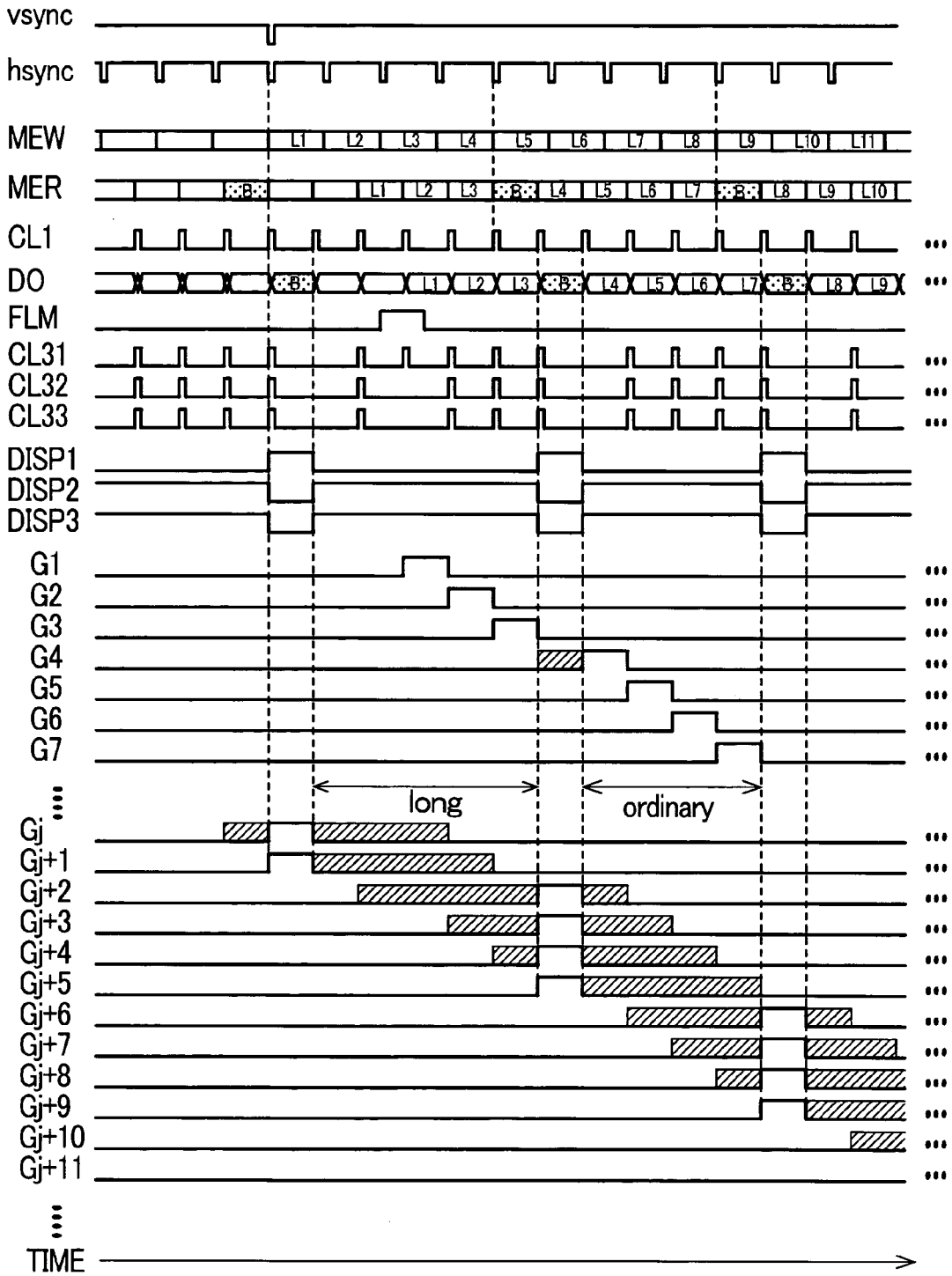
FIG. 31 a timing diagram showing driving waveforms which simultaneously select 4 scanning lines during an outputting period of display signals according to the fifth embodiment of the driving method of the liquid crystal display device of the present invention, wherein the drawing also shows a changeover portion in a frame n+3 in FIG. 34, wherein the number of inputting horizontal periods is a multiple of 4.

FIG. 30 and FIG. 31 show output waveforms of signals from a display control circuit (timing controller) which represents the fifth embodiment of the display device and the driving method thereof according to the present invention and output waveforms from a scanning driver and a data driver corresponding to the display control circuit in the same mode as the output waveforms shown in FIG. 12 to FIG. 27. Also, in this case, as can be clearly understood from the pulses of the scanning start signals FLM depicted at the centers of the respective drawings, this embodiment is similar to the previous embodiment shown in FIG. 12 to FIG. 27 in that the boundary between a certain frame period and the next frame period is indicated at the respective centers in the lateral direction.

Here, in contrast to the views shown in FIG. 12 to FIG. 27, the timing for writing the respective image data into the line memory circuit 105 (memory writing) and the timing for reading out the respective image data from the line memory circuit 105 are also depicted in FIG. 30 and FIG. 31.

Further, the output waveforms shown in FIG. 30 and FIG. 31, in the same manner as the constitution shown in FIG. 10, are determined on the premise of the constitution which changes the output timing of the blanking signals in response to outputting of the display signals based on the image data for every frame period, wherein the output waveforms at the frame n+2 in FIG. 24 depicted corresponding to FIG. 10 are shown in FIG. 30 and the output waveforms at the frame n+3 in FIG. 24 depicted corresponding to FIG. 10 are shown in FIG. 31.

First of all, in FIG. 30, in the vicinity of a boundary between a certain frame period and a frame period next to the certain frame period, the last blanking signal in the certain frame period is read out and, thereafter, at the time of reading out the next image data, the reading is delayed for 3 horizontal periods and, eventually, the next blanking signal is read out after 5 horizontal periods.

In the same manner, in FIG. 31, in the vicinity of a boundary between a certain frame period and a frame period next to the certain frame period, at the time of reading out the next image data after reading out the last blanking signal in the certain frame period, the reading is delayed for one horizontal period and, eventually, the next blanking signal is read out after 5 horizontal periods.

In this case, as can be understood from the respective timings for memory writing MEW and memory reading MER shown in FIG. 30 and FIG. 31, assuming that the addresses in the memory are mem1, mem2, mem3, mem4, mem5 and mem6, as seen in the drawing, the reading timing of mem1 is superposed on the writing timing of mem6 and hence, the line memory for at least 6 lines becomes necessary.

Figure 35:
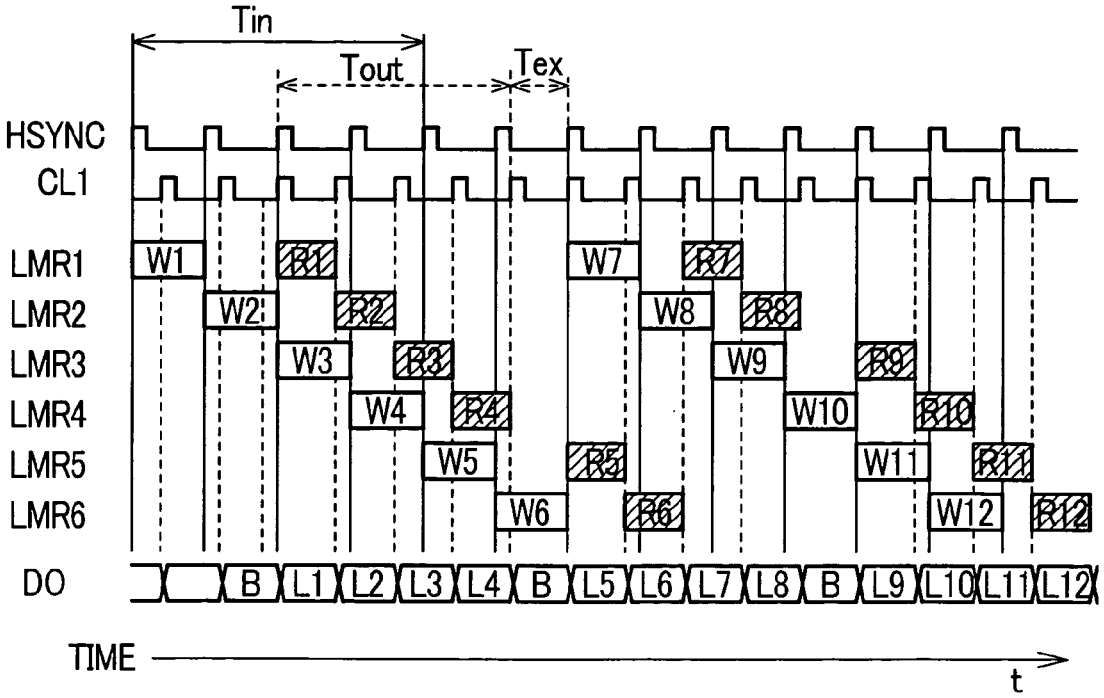
FIG. 35 is a timing chart for showing writing of image data to respective line memories and reading-out of the image data from the respective line memories according to the fifth embodiment of the liquid crystal display device of the present invention.

FIG. 35 shows a chart which shows the writing and reading timings of respective image data when the line memory LMR for 6 lines is provided.

By adopting such a constitution, in the vicinity of the boundary between the certain frame period and the frame period next to the certain period, the time-sequential interval between the last blanking signal in the certain frame period and the first blanking signal in the frame period next to the certain frame period is set to be equal to the time-sequential interval between a certain blanking signal other than such blanking signals and a blanking signal next to the certain blanking signal.

In other words, in the step in which the frames are sequentially changed over, by shifting the timing for outputting the display data at a changeover point of the frame, the interval between the certain blanking signal and the next blanking signal is set to a fixed value.

By adopting such a constitution, it is possible to obviate a phenomenon in which the blanking signals B are written twice or are not written at all in one frame in which the scanning start signal FLM is positioned at the center in a specified gate line as in the case of the above-mentioned embodiment shown in FIG. 12 to FIG. 27 (fourth embodiment) whereby a drawback in which the ratio between the image data holding time and the blanking data holding time differs can be obviated.

However, the display device according to this embodiment has an advantageous effect in that the further enhancement of the display quality can be achieved compared to the enhancement of the display quality achieved by the fourth embodiment.

Figure 32:
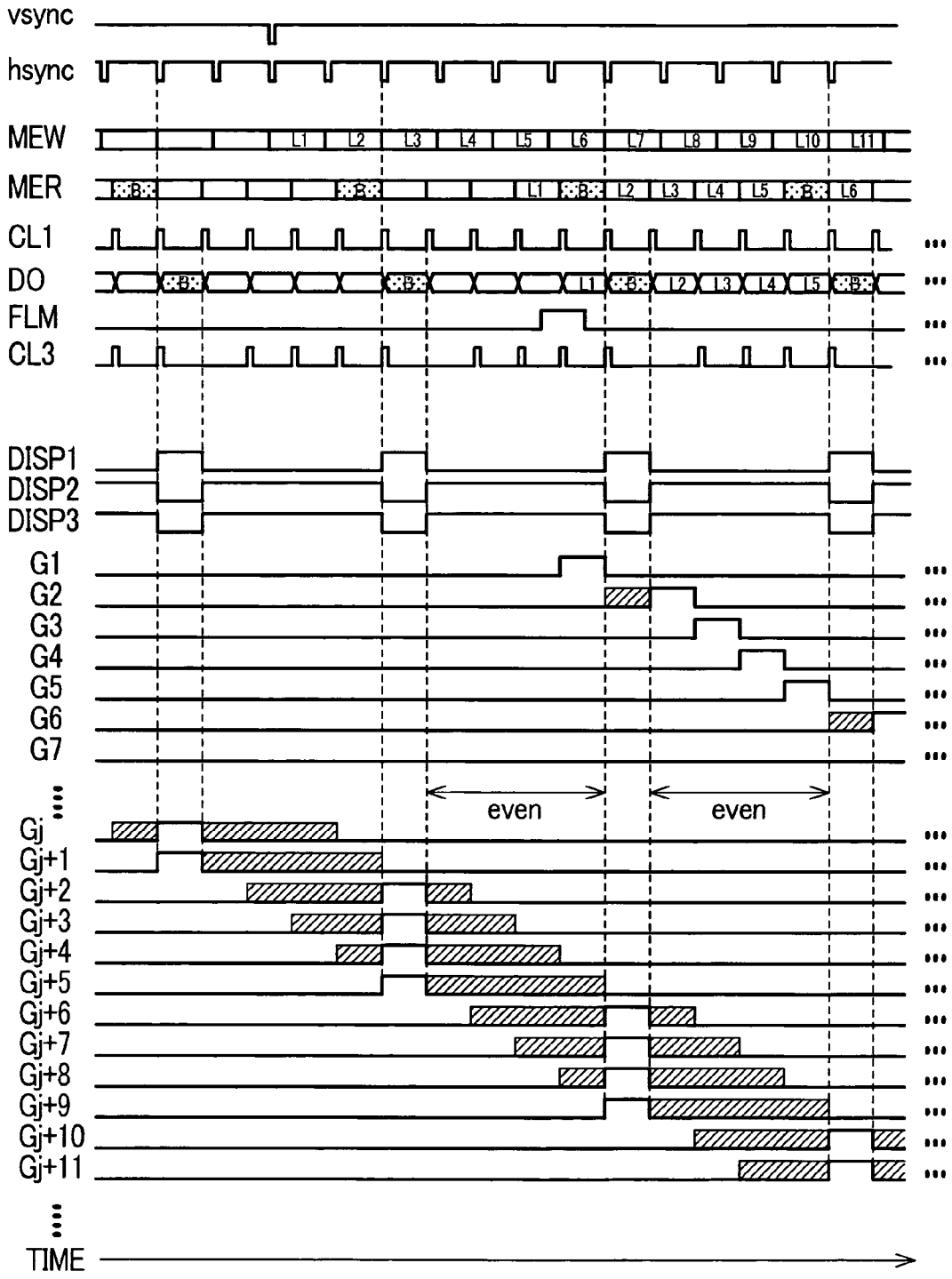
FIG. 32 is a timing diagram corresponding to FIG. 30, showing a drawback when the fourth embodiment is applied.

FIG. 32 is a view corresponding to the above-mentioned FIG. 30, wherein in the same manner as the fourth embodiment, the number of scanning clocks CL3 generated between the blanking signal which is outputted last in the preceding frame and the blanking signal which is outputted first in the succeeding frame is always adjusted to N pieces (four in FIG. 32).

Figure 33:
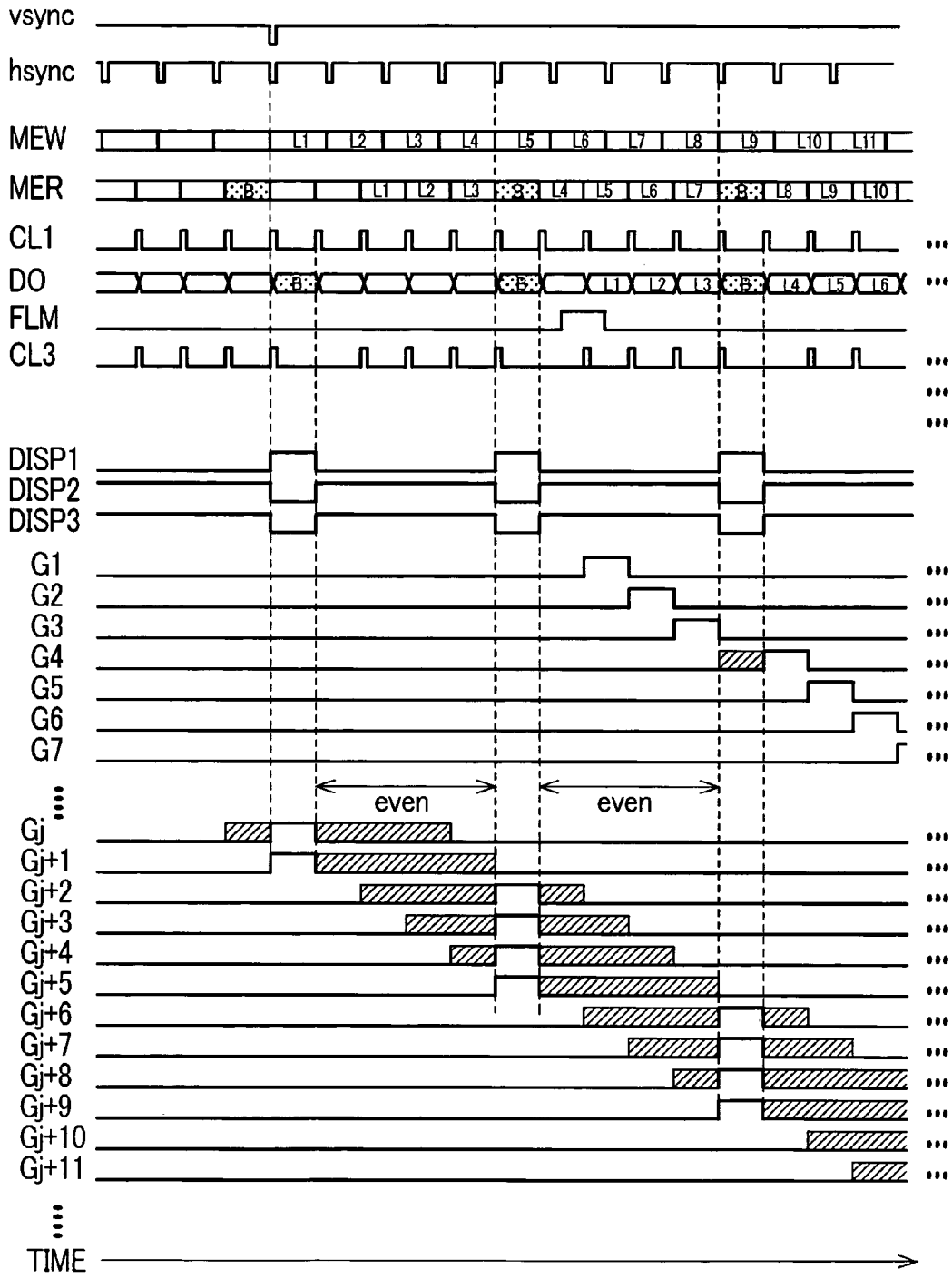
FIG. 33 is a timing diagram corresponding to FIG. 31, showing a drawback when the fourth embodiment is applied.
Figure 34:
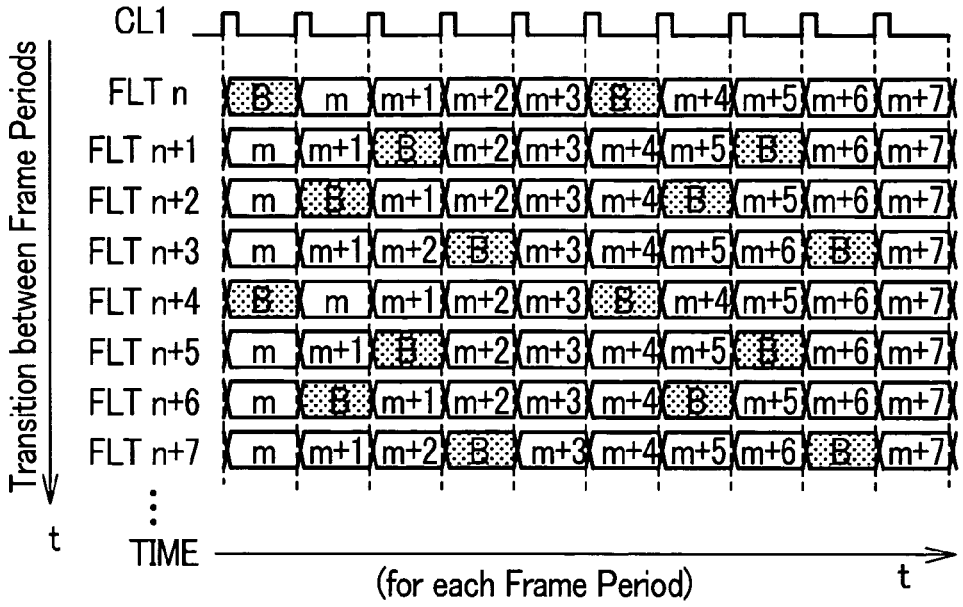
FIG. 34 is a diagram showing the change of display signals supplied to respective pixel rows corresponding to gate lines G1, G2, G3, . . . over a plurality of continuous frame periods n, n+1, n+2, . . . according to the fifth embodiment of the driving method of the liquid crystal display device of the present invention.

FIG. 33 is a view corresponding to the above-mentioned FIG. 31, wherein also in the same manner as the fourth embodiment, the number of the scanning clocks CL3 generated between the blanking signal which is outputted last in the preceding frame and the blanking signal which is outputted first in the succeeding frame is always adjusted to 4 pieces.

In this case, in FIG. 32, it is understood that in the vicinity of a boundary between a certain frame period and a frame period next to the certain frame period, a time-sequential interval between the last blanking signal in the certain frame period and a first blanking signal in the frame period next to the certain frame period is set to be shorter than a time-sequential interval between a certain blanking signal other than these blanking signals and a blanking signal next to the certain blanking signal. In the same manner, in FIG. 33, it is understood that in the vicinity of a boundary between a certain frame period and a frame period next to the certain frame period, a time-sequential interval between a last blanking signal in the certain frame period and a first blanking signal in the frame period next to the certain frame period is set to be longer than a time-sequential interval between a certain blanking signal other than these blanking signals and a blanking signal next to the certain blanking signal.

In this case, to observe the image of the display device, in which the frames are sequentially changed over, with the naked eye, there is observed a phenomenon in which, out of the gate lines of the display device, in the vicinity of the boundary between the certain frame period and the frame period next to the certain frame period, at portions of gate lines (for example, gate line $G_{j+2}$ to $G_{j+9}$ in FIG. 32 or gate line $G_{j+2}$ to $G_{j+5}$ in FIG. 33) corresponding to portions where the time-sequential interval between the last blanking signal in the certain frame period and the first blanking signal in the frame period next to the certain frame period is prolonged or shortened, the change of brightness of the pixels becomes larger than the change of brightness of the pixels in other portions of the gate lines.

The display device described in connection with the fifth embodiment is configured, as described above, such that the interval between the certain blanking signal and the next blanking signal is set to a fixed value even in the step where the frame is sequentially changed over, and, hence, it is possible to achieve an advantageous effect in that the above-mentioned phenomenon is not observed at all.

The constitutional feature described in connection with the embodiment 5 is directly applicable to other modifications described in connection with other embodiments. For example, the number M of outputtings of the display signal in the first step is not limited to 4 and the number M of outputtings of the blanking signal in the second step is not limited to 1.

As can be clearly understood from the foregoing explanation, according to the display device and the driving method of the present invention, it is possible to prevent the generation of the display flow of a brightness line on the screen.

Further, the present invention can obtain uniformity in a black display in respective frames.

What is claimed is:

1. A display device comprising:

a pixel array in which a plurality of pixel rows each of which includes a plurality of pixels arranged in parallel along the first direction are arranged in parallel along the second direction which intersects the first direction;

a scanning driver circuit which selects the plurality of respective pixel rows in response to a scanning signal;

a data driver circuit which supplies a display signal to the respective pixels included in at least one row selected in response to the scanning signal out of the plurality of pixel rows; and a display control circuit which controls a display operation of the pixel array, wherein lines of image data are inputted to the data driver circuit one after another for every horizontal scanning period of the image data, the data driver circuit alternately repeats (i) a first step for generating a display signal corresponding to each one of the lines of the image data one after another for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the display signal outputted in the first step of the image data is delayed from a memory in which the display signal is stored in the vicinity of a boundary between one frame period and a frame period next to the one frame period within a time-sequential interval between the display signal which is outputted in the second step of the last image data in a certain frame period and the display signal which is outputted from the second step of the first image data in the next frame period.

2. A display device according to claim 1, wherein outputting of the display signal outputted in the second step of the image data is performed with a time-sequential deviation which differs in displaying of respective frames, and the display signal of each frame is distributed such that the display signal does not include (N-2) pieces of time-sequential deviation of the fixed period at maximum with respect to the corresponding display signal of the next frame.

3. A display device according to claim 1, wherein in the vicinity of a boundary between a certain frame period and a frame period next to the certain frame period, a time-sequential interval between the display signal which is outputted in the second step of the last image data in the certain frame period and the display signal which is outputted in the second step of the first image data in the next frame period is set substantially equal to a time-sequential interval between the display signal which is outputted in the second step of other certain image data and the display signal which is outputted in the second step of the next image data.

4. A display device according to claim 1, wherein the number Y of the respective pixel rows selected in the first selection step in response to each output of the display signal in the first step is 1 and the number N of the display signal outputs in the first step is not smaller than 4, and the number Z of the respective pixel rows selected in the second selection step in response to each output of the display signal in the second step is not smaller than 4 and the number N of the display signal outputs in the second step is 1.

5. A driving method for a display device in which to a display device which comprises a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, lines of image data are inputted one after another for every horizontal scanning period, wherein the data driver circuit alternately repeats (i) a first step for generating a display signal corresponding to each one of the lines of the image data one after another and outputting the display signal to the pixel array N-times (N being a natural number equal to or greater than 2) and (ii) a second step for generating a display signal which makes the luminance of the pixels lower than the luminance of the pixel in the first step and outputting the display signal to the pixel array M-times (M being a natural number smaller than N), the scanning driver circuit, in response to inputting of a scanning clock, alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the display signal outputted in the first step of the image data is delayed from a memory in which the display signal is stored in the vicinity of a boundary between one frame period and a frame period next to the one frame period within a time-sequential interval between the display signal which is outputted in the second step of the last image data in a certain frame period and the display signal which is outputted from the second step of the first image data in the next frame period.

6. A driving method for a display device according to claim 5, wherein in the vicinity of a boundary between a certain frame period and a frame period next to the certain frame period, a time-sequential interval between the display signal which is outputted in the second step of the last image data in the certain frame period and the display signal which is outputted in the second step of the first image data in the next frame period is set substantially equal to a time-sequential interval between the display signal which is outputted in the second step of other certain image data and the display signal which is outputted in the second step of the next image data.

7. A driving method for a display device according to claim 5, wherein the number Y of the respective pixel rows selected in the first selection step in response to each output of the display signal in the first step is 1 and the number N of the display signal outputs in the first step is not smaller than 4, and the number Z of the respective pixel rows selected in the second selection step in response to each output of the display signal in the second step is not smaller than 4 and the number N of the display signal outputs in the second step is 1.

* * * * *